US006170939B1

(12) United States Patent
Ujita et al.

(10) Patent No.: US 6,170,939 B1
(45) Date of Patent: Jan. 9, 2001

(54) LIQUID STORING CONTAINER FOR RECORDING APPARATUS

(75) Inventors: Toshihiko Ujita, Yamato; Koji Yamakawa; Masanori Takenouchi, both of Yokohama; Sadayuki Sugama, Tsukuba; Kenjiro Watanabe, Tokyo; Torachika Osada; Kazuhiro Nakajima, both of Yokohama; Takayoshi Tsutsumi; Hidemi Kubota, both of Tokyo; Yasuo Kotaki, Yokohama; Keiichiro Tsukuda, Kawasaki; Yohei Sato, Yokohama, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 08/690,345

(22) Filed: Jul. 26, 1996

Related U.S. Application Data

(60) Continuation-in-part of application No. 08/444,867, filed on May 19, 1995, now abandoned, which is a division of application No. 08/098,872, filed on Jul. 29, 1993.

(30) Foreign Application Priority Data

| | | |
|---|---|---|
| Jul. 31, 1992 | (JP) | 4-205106 |
| Aug. 31, 1992 | (JP) | 4-230797 |
| Aug. 31, 1992 | (JP) | 4-231788 |
| Oct. 20, 1992 | (JP) | 4-281867 |
| Nov. 2, 1992 | (JP) | 4-294309 |
| Jan. 19, 1993 | (JP) | 5-006931 |
| Jan. 19, 1993 | (JP) | 5-006933 |
| Feb. 18, 1993 | (JP) | 5-029429 |

(51) Int. Cl.[7] ..... B41J 2/175

(52) U.S. Cl. ..... 347/86

(58) Field of Search ..... 347/85, 86, 87, 347/92, 93, 49

(56) References Cited

U.S. PATENT DOCUMENTS

| | | | | |
|---|---|---|---|---|
| 4,153,902 | * | 5/1979 | Kanayama | 347/93 |
| 4,313,124 | | 1/1982 | Hara | 347/57 |
| 4,345,262 | | 8/1982 | Shirato et al. | 347/10 |
| 4,383,263 | | 5/1983 | Ozawa et al. | 347/30 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,608,577 | | 8/1986 | Hori | 347/66 |
| 4,680,696 | | 7/1987 | Ebinuma et al. | 347/85 |

(List continued on next page.)

FOREIGN PATENT DOCUMENTS

| | | | | |
|---|---|---|---|---|
| 3401071 | | 7/1985 | (DE) | B41J/27/00 |
| 0378240 | * | 7/1990 | (EP) | 347/86 |

(List continued on next page.)

OTHER PUBLICATIONS

J. Fox, "Ink Container and Connection Valve for TIJ Printing System, " Xerox Disclosure Journal, vol. 16, No. 1 (Jan./Feb. 1991), pp. 11–13.

*Primary Examiner*—N. Le
*Assistant Examiner*—Michael Nghiem
(74) *Attorney, Agent, or Firm*—Fitzpatrick, Cella, Harper & Scinto

(57) ABSTRACT

A liquid storing container employable for an ink jet recording apparatus includes a housing, a storing area containing a porous ink absorbing member, a valve mechanism, a filter in contact with the porous member, and a stopper. The liquid storing container is detachably connected to an ink jet recording head, where the valve mechanism allows an outflow of ink to the ink jet head through the joint portion when connected to an ink feed pipe, and closes the joint portion when disconnected from the ink feed pipe.

6 Claims, 64 Drawing Sheets

U.S. PATENT DOCUMENTS

| | | | | |
|---|---|---|---|---|
| 4,723,129 | | 2/1988 | Endo et al. | 347/56 |
| 4,740,796 | | 4/1988 | Endo et al. | 347/56 |
| 4,771,295 | * | 9/1988 | Baker et al. | 347/87 |
| 4,806,032 | | 2/1989 | Gragg et al. | 400/194 |
| 4,847,637 | | 7/1989 | Watanabe et al. | 347/30 |
| 4,936,544 | * | 6/1990 | Bartholomew | 251/149.6 |
| 5,008,688 | | 4/1991 | Ebinuma et al. | 347/86 |
| 5,138,344 | | 8/1992 | Ujita | 347/86 |
| 5,231,424 | | 7/1993 | Kaneko et al. | 347/29 |
| 5,245,360 | | 9/1993 | Ebinuma et al. | 347/86 |
| 5,502,479 | | 3/1996 | Ishinaga et al. | 347/93 |

FOREIGN PATENT DOCUMENTS

| | | | | |
|---|---|---|---|---|
| 0381392 | | 8/1990 | (EP) . | |
| 0408241 | | 1/1991 | (EP) . | |
| 0418822 | | 3/1991 | (EP) . | |
| 0419192 | | 3/1991 | (EP) . | |
| 0444654 | * | 9/1991 | (EP) | 347/93 |
| 0488829 | | 12/1991 | (EP) | B41J/2/175 |
| 0480473 | | 4/1992 | (EP) . | |
| 0486309 | | 5/1992 | (EP) . | |
| 0496620 | | 7/1992 | (EP) . | |
| 0503497 | | 9/1992 | (EP) . | |
| 0529879 | | 3/1993 | (EP) . | |
| 0535686 | | 4/1993 | (EP) . | |
| 0546544 | | 6/1993 | (EP) . | |
| 0546832 | | 6/1993 | (EP) . | |
| 0547921 | | 6/1993 | (EP) | B41J/2/175 |
| 0553535 | | 8/1993 | (EP) . | |
| 0560729 | | 9/1993 | (EP) . | |
| 0562717 | | 9/1993 | (EP) . | |
| 2268911 | | 1/1994 | (GB) | B41J/2/175 |
| 54-056847 | | 5/1979 | (JP) . | |
| 59-123670 | | 7/1984 | (JP) . | |
| 59-138461 | | 8/1984 | (JP) . | |
| 60-071260 | | 4/1985 | (JP) . | |
| 60-137656 | | 7/1985 | (JP) . | |
| 61-249757 | | 11/1986 | (JP) . | |
| 62-142650 | * | 6/1987 | (JP) | 347/86 |
| 63-022653 | | 1/1988 | (JP) . | |
| 1-186331 | | 7/1989 | (JP) . | |
| 2-039945 | | 2/1990 | (JP) . | |
| 2-192954 | | 7/1990 | (JP) . | |
| 3-169563 | | 7/1991 | (JP) | B41J/2/175 |
| 3-288653 | | 12/1991 | (JP) | B41J/2/175 |
| 4-11057 | | 4/1992 | (JP) | B41J/2/175 |
| 4-110157 | * | 4/1992 | (JP) | 347/93 |
| 4-144755 | | 5/1992 | (JP) | B41J/2/175 |
| 5-104735 | | 4/1993 | (JP) . | |

* cited by examiner

LIQUID STORING CONTAINER FOR RECORDING APPARATUS

This application is a continuation of application Ser. No. 08/444,867 filed May 19, 1995, now abandoned which in turn is a division of application Ser. No. 08/098,872, filed Jul. 29, 1993.

BACKGROUND OF THE INVENTION

1. Field of the Invention

The present invention relates generally to a liquid storage container. More particularly, the present invention relates to a liquid storage container for storing a liquid usable as a recording agent for a recording apparatus such as an ink jet recording apparatus, a photoelectrical copying machine, a facsimile unit or the like. In addition, the present invention relates to a recording unit integrally including a liquid storing container of the foregoing type. Additionally, the present invention relates to a recording apparatus having a recording unit of the foregoing type mounted thereon. Further, the present invention relates to a method of filling a liquid storage container of the foregoing type with liquid from the outside.

2. Description of Related Art

A conventional liquid injection recording apparatus (hereinafter referred to as an ink jet recording apparatus) is generally constructed such that a recording head for discharging ink therefrom and an ink storing section associated with the recording head are separately arranged as individual components at different positions located away from each other but they are operatively connected to each other via an ink feeding system inclusive of an ink feeding pipe interposed therebetween.

Because of a necessity for extending a long ink feeding pipe between both the components, the conventional ink jet recording apparatus constructed in the above-described manner has problems in the piping operation, and moreover, vaporized ink or air is liable to invade the apparatus. To cope with the foregoing problems, the assignee common to the present invention proposed an ink jet recording apparatus of the type that an recording head and an ink storing section are united with each other in the form of an integral unit (cartridge), as disclosed in official gazettes of Japanese Patent Application Laying-open Nos. 61-249757, 63-22653 and 2-192954. According to the proposals, the aforementioned problems associated with evaporation of ink and invasion of air can be obviated, and the advantage attainable from the proposals is that any unskilled-user can easily handle an ink feeding system including an ink storing section because no piping operation is required.

However, when ink in the ink jet recording apparatus is completely consumed a user should purchase a new cartridge having a recording head and an ink tank cartridge integrated with each other so as to allow the used ink cartridge to be exchanged with a new one. In practice, there often arises an occasion that ink in the cartridge is completely consumed but the recording head is unavoidably exchanged with a new one although it has still some running life. In the circumstances as mentioned above, many requests have been raised from users for providing an ink jet recording apparatus which assures that a recording head including highly functional components such as piezoelectric elements, silicon wafers or the like can fully and effectively be utilized.

To satisfactorily meet these requests, the assignee proposed an on-carriage type ink jet recording apparatus including a recording head and an ink tank cartridge integrated with each other without any necessity for performing a piping operation wherein the recording head can fully be utilized over its entire running life, and moreover, the recording head can be disconnected from the ink tank cartridge when the latter is exchanged with a new one. With this on-carriage type ink jet recording apparatus constructed in that way, an empty ink tank cartridge can repeatedly be exchanged with a new one until the recording head reaches the end of its running life. As long as ordinary documents are printed with the ink jet recording apparatus, a series of recording operation can sequentially be performed for several thousand sheets of paper with a single recording head while only the empty ink tank cartridge is repeatedly exchanged with a new one. With the on-carriage type ink jet recording apparatus, when any recording operation can not be performed any more because the running life of the recording head expires, a user is required to purchase a new recording head so that a recording operation can be restarted with the new recording head. In addition, the assignee made various kinds of proposals with respect to an ink storing container to be integrated with a recording head in practical use.

As a printing technique, hardware and software for personal computers advance year by year in the aforementioned circumstances, it becomes possible to perform each printing operation with greater ease and a more beautiful appearance. On the other hand, the performance required from a recording apparatus is increased with improved versatility. Although there often arises the question as to whether a dye based ink should be used or a pigment based ink should be used, each of these inks has its own features. This makes it difficult to finally determine the type of ink to be selected. In other words, a user is required to make a decision at his discretion as to which type of ink to be used. This tendency is remarkably intensified at present because users increasingly employ color printing. In addition, it is expected that various types of inks each having different physical and chemical properties are put in practical use. This fact has a significant effect on designing of an ink tank cartridge. Thus, there arises a necessity for preparing an ink tank cartridge corresponding to each type of ink to be used.

Another-problem is concerned with an optimal working volume of ink tank cartridge which should be determined corresponding to a certain kind of ink. For example, in the case that a user frequently performs recording operations, it is desirable for him or her to print many sheets of paper with the reduced number of exchanging operations each performed for exchanging an empty ink tank cartridge with a new one. On the contrary, when a user prints a small number of sheets every time a recording operation is performed by him or her, it is economically unacceptable for the following reason to use an ink tank cartridge containing a large quantity of ink. Specifically, when the recording head is kept inoperative for a long time after a small quantity of ink is consumed for each recording operation, volatile components contained in ink are vaporized therefrom, causing coloring substances to be adversely transformed. For this reason, a user is required to exchange the ink tank cartridge with a new one every time a recording operation is performed. This leads to the result that he or she is spending money for unused ink remaining in the exchanged ink tank cartridge. In the circumstances as mentioned above, many requests have been raised from many users for providing an ink tank cartridge which is simple in structure and contains a small quantity of ink. On the other hand, for a user who prints a large number of sheets at every recording operation, there is a need of preparing an ink tank cartridge containing a possibly large quantity of ink in the restrictively predetermined working volume thereof. In this case, it is desirable that each recording operation is achieved at a low printing cost although the ink tank cartridge is produced at an expensive cost. This shows merely an example of explaining the current tendency that it is expected that various types of advanced techniques will be developed with respect to the ink jet recording apparatus in future. In addition, it is anticipated that each ink tank cartridge is constructed with a different structure corresponding to a common recording head.

In the case that an exchangeable type ink tank cartridge is used for the ink jet recording apparatus, it is necessary that measured be taken for the purpose of preventing dust or similar foreign materials from entering the ink jet recording head when a porous ink absorbing member molded of an elastic material is employed as means for retaining ink in the ink tank cartridge. In practice, however, since fine fractures are torn or peeled away from the porous ink absorbing member during each recording operation, it is additionally necessary that a filtering member is disposed in an ink flow path in order to prevent the fine fractures from entering the recording head. To this end, the filter may be disposed on the ink tank side. In this case, a filter should be disposed on every ink tank cartridge. This is because if a filter is disposed only the recording head side, there arises a malfunction in that dust or similar foreign materials are deposited on the filter, causing the latter to be clogged with the dust or the like before the running life of the recording head expires.

To assure that the ink jet recording apparatus is designed with smaller dimensions, it is obviously required that the ink tank-cartridge itself is designed with smaller dimensions. To this end, the working volume of the ink tank cartridge should restrictively be determined. However, since a quantity of ink to be consumed by the recording head corresponding to a predetermined content of recording is kept constant regardless of the dimensions of the ink jet recording apparatus, it is required that a running cost of the ink tank cartridge is taken into account for the purpose of designing each ink tank cartridge with smaller dimensions on the assumption that the ink tank cartridge containing no ink is exchanged with a new one. To meet the requirement, it is highly requested that an utilization efficiency of the ink stored in the ink tank cartridge increased as high as possible.

However, to satisfy the foregoing request, the ink jet recording apparatus has the following problems to be solved. Specifically, to improve reliability of each recording operation, air (bubbles) accumulated in the recording head as time elapses or introduced in an ink flow path when the ink tank cartridge is exchanged with a new one should be removed from the ink. To this end, a pump arranged in the ink jet recording apparatus is driven to removably suck the air together with the ink discharged from ink discharging orifices. An extra quantity of ink sucked together with the air with the aid of the pump is wasted as it cannot be used for recording. In the case of a conventional comparatively large-sized ink jet recording apparatus, since an ink tank cartridge has certain a allowance in respect to an ink storing capacity, when a power source of the ink jet recording apparatus is turned on, a pump is automatically driven once per 72 hours so as to increase reliability of each recording operation. In addition, when the ink jet recording apparatus is designed with sufficient allowance in respect of a capacity of sucking ink per each pumping operation as well as an ink sucking pressure induced by the pump, air bubbles can reliably be removed from the recording head and the ink tank cartridge in the ink jet recording apparatus.

However, in the case of a small-sized ink tank cartridge having a small ink storing capacity, when a large quantity of ink is wasted by performing the same pumping operation as mentioned above, a frequency of repeatedly exchanging each ink tank cartridge containing no ink with a new one is increased, causing a user to endure a troublesome exchanging operation accompanied by an increased running cost. Thus, the advantageous effect attained by designing each ink tank cartridge with smaller dimensions is reduced or lost. To cope with the foregoing problem, a proposal was made as to a process of minimizing a quantity of ink to be uselessly pumped out together with air bubbles per each pumping operation.

To assure that an ink tank cartridge can be disconnected from a recording head on a printer carriage, it is inevitably necessary to dispose a valve mechanism in the ink tank cartridge in order to prevent ink from leaking from the ink tank cartridge by quickly sealably closing an ink flow path with the valve mechanism after the ink tank cartridge is disconnected from the recording head. In addition, a filter is disposed in the recording head on the downstream side of the valve mechanism. The volume between the ink storing section and the filter is called a valve space. When the ink tank cartridge and the recording head are connected to and disconnected from each other several times for some reason, there arise malfunctions that air bubbles enter the valve space, resulting in each recording operation being unstably achieved after the ink tank cartridge is connected to the recording head. Moreover, ink feeding is interrupted due to the invasion of the air bubbles in the course of certain recording operations. To obviate the foregoing malfunctions, it suffices that the pump is driven in the same manner as the conventional ink jet recording apparatus. However, when the quantity of ink that is wasted each pumping operation is restrictively reduced for the small-sized ink jet recording apparatus in the above-described manner, there arises a problem as noted below.

The foregoing problem will be described below with reference to FIGS. 3A to 3C and FIGS. 4A to 4C. For example, when an ink tank cartridge 2-1 and an ink jet recording head 2-2 are frequently connected to and disconnected from each other or when an assembly of the ink tank cartridge 2-1 and the ink jet recording head 202 is kept inoperative for a long time of several months, a large part of the ink held in the space defined between the ink jet recording head 2-2 and a valve space 2-3 is lost due to vaporization of the ink. In this case, ink can not satisfactorily be fed to the ink jet recording head 2-2 merely by a single pumping operation achieved by a pump 2-4 having a predetermined flow rate. In such a case, it is necessary to continuously perform the same pumping operations several times in order to compensate for the shortage of pumping capacity.

As is apparent from FIGS. 3A to 3C, in the case that the pumping operations are intermittently performed several times, the ink 2-5 once sucked in the ink jet recording head 2-2 in the course of each pumping operation is caused to return to an ink reservoir 2-7. To prevent an occurrence of ink return flow as mentioned above, it is recommended that adequate means for preventing the ink 2-5 from reversely flowing to the ink reservoir 2-7, e.g., a cap 2-6 for retaining the ink pressure in the valve space 2-3, as shown in FIGS. 4A to 4C, is continuously brought in close contact with the ink jet recording head 2-2 during a series of pumping operations. However, the arrangement of the cap 2-6 with high reliability maintained during the pumping operations prevents the ink jet recording apparatus from being designed with smaller dimensions. In addition, another problem is that the ink jet recording apparatus is fabricated at an increased cost.

For example, when a porous member is received in an ink tank cartridge as disclosed in an Japanese Patent Publication No. 3-41351, it is necessary that a filter is brought in close contact with the porous member. However, in the case of an ink jet recording unit of the type including an ink jet recording head and an ink tank cartridge disconnectable from each other, when a user erroneously repeatedly connects a single ink tank cartridge to the opposing ink jet recording head and disconnects the former from the latter, the porous member received in the ink tank cartridge is adversely transformed, resulting in the filter disposed in the ink jet recording head failing to come in close contact with the porous member. Thus, there is a possibility that ink can not correctly be fed to the ink jet recording head. In addition, in the case that air bubbles enter the ink tank cartridge, there is a possibility that the air bubbles enter an ink feeding path during a certain recording operation, causing droplets of ink to be incorrectly discharged from ink discharging orifices.

In view of the fact that a large quantity of ink remains in the porous member without any feeding of the ink to the ink jet recording head, many proposals were made in order to obviate the foregoing malfunction. Among the proposals, one proposal is such that a quantity of projecting of a projection from the recording head side toward the porous member is restrictively determined so as to allow the projection to properly come in contact with the porous member. Another proposal is such that a plurality of ribs are caused to extend along the inner wall surface of the ink tank cartridge in order to distribute the atmospheric air introduced into the ink tank cartridge via an atmospheric air intake port over the surface of the porous member.

Although the above-mentioned proposals are certainly effective for coping with various kinds of requests raised from many users now that ink jet recording apparatuses are increasingly put into practical use, it has been clarified by the invertors that a mutual relationship among components each constituting an ink jet recording apparatus serving as a printer unit is not hitherto recognized as an unstable factor but has an unexpected technical significance.

Especially, in the case that the ink jet recording apparatus serving as a printer unit is integrally installed in information processing equipment such as a personal computer or the like so that the whole information processing equipment is constructed with smaller dimensions, the real recognition of the foregoing mutual relationship is effectively useful for a fabricating the ink jet recording apparatus.

SUMMARY OF THE INVENTION

The present invention has been made in consideration of the aforementioned background.

An object of the present invention is to provide a liquid storage container which is simple in structure and has a high utilization efficiency of liquid such as ink or the like.

Other object of the present invention is to provide an ink container which is simple in structure and can be produced at an inexpensive cost.

Another object of the present invention is to provide an ink jet recording unit including an ink jet recording head and an ink tank cartridge normally connected to each other wherein there do not arise malfunctions that a filter disposed in the ink jet recording head is clogged with dust or similar foreign materials, and moreover, air bubbles invade in the ink tank cartridge when the ink jet recording head is disconnected from the ink tank cartridge.

Another object of the present invention is to provide an ink tank which assures that ink is stably fed to discharging orifices at a high ink utilization efficiency.

Further another object of the present invention is to provide a mechanism for connecting an ink jet recording head to an ink tank cartridge wherein each recording operation can be achieved at an inexpensive cost with the mechanism, the ink jet recording head can be connected to a different kind of ink tank cartridge with the aid of the mechanism to meet the request raised from a user, and moreover, the mechanism can practically be used for a long time.

Further another object of the present invention is to provide an ink container which assures that ink to be consumed can be retained at a high efficiency.

Still further another object of the present invention is to provide a method of filling a liquid storing container with-liquid wherein a liquid absorbing member made of a porous material is received in the liquid storing container as liquid retaining means so that the liquid is safely filled in the liquid storing container at a high efficiency.

According to a first aspect of the present invention, there is provided a liquid storage container, being connectable to a recording means for recording with a liquid as a recording agent and discharging the liquid in response to a sucking operation of a sucking means while the liquid to be fed to the recording means is stored in the liquid storage container, wherein the liquid storing container comprises a joint portion to be connected to a liquid inflow path on the recording means side, the joint portion including a liquid outflow path for feeding the liquid from a liquid storing section to the liquid inflow path therethrough, and a sum of the volume of the liquid outflow path and the volume as measured from a liquid inflow port of the liquid inflow path to a liquid discharging portion is determined to be smaller than a quantity of liquid to be discharged per each liquid sucking operation.

According to a second aspect of the present invention, there is provided a liquid storage container, being connectable to a recording means for recording with a liquid as a recording agent and discharging the liquid in response to a sucking operation of a sucking means while the liquid to be fed to the recording means is stored in the liquid storage container, wherein the liquid storing container comprises a joint portion to be connected to a liquid inflow path having a filter on the recording means side, the joint portion including a liquid outflow path for feeding the liquid from a liquid storing section to the liquid inflow path therethrough, and a sum of the volume of the liquid outflow path and the volume as measured from a liquid inflow port of the liquid inflow path to the filter is determined to be smaller than a quantity of liquid to be discharged per each liquid sucking operation.

According to a third aspect of the present invention, there is provided a recording unit comprising a liquid storage container comprising a housing having an opening portion formed thereon, a cylindrical-shaped member projected inside of the housing while surrounding the opening portion therewith, a first filter disposed on the innermost end of the cylindrical-shaped member, a liquid absorbing member received in the housing while coming in contact with the filter, and a valve body disposed to be displaced in the cylindrical-shaped member so as to be biased in such a direction as to close the opening, a recording head comprising a cylindrical-shaped member having a liquid path formed therein to make communication with discharging orifices therethrough, the sleeve-shaped member being able to be inserted into the opening portion, and a second filter disposed in the liquid path, and sealing means for sealing between the liquid storage container and the recording head when both connected to each other, wherein the volume as measured between the first filter and the second filter is determined to be smaller than a quantity of liquid suction achieved by liquid sucking means of a recording apparatus having the recording unit mounted thereon per each liquid sucking operation.

With the liquid storage container and the recording unit constructed according to the first to third aspects of the present invention, the volume of liquid flow paths of the recording means and the liquid storage container are determined in such a manner as to establish the following inequality.

$$Cv<Pv-Hv$$

where Pv represents a quantity of liquid flow per each sucking operation to be performed by sucking means such as a pump or the like arranged in a liquid jet recording apparatus, Hv represents a volume of the flow path formed in the recording head, wherein in the case that no filter is disposed in the flow path, the foregoing volume is coincident with a volume of the flow path as measured from a flow path inlet port to an orifice, while in the case that a filter is disposed in the flow path, it is coincident with a volume of the flow path as measured from the flow path inlet port to the filter, and Cv represents a volume of the flow path in the liquid storage container.

When the above inequality is established among the three factors, the liquid storage container can be realized without any necessity for increasing the value preset for single suction achieved per each pumping operation performed by pumping means in the ink jet recording apparatus. Thus, the present invention can provide a liquid storage container which is designed and produced with small dimensions at an inexpensive cost while maintaining a high ink utilization efficiency. In addition, the present invention can provide a recording unit and a liquid jet recording apparatus each of which includes a liquid storage container of the foregoing type while it is firmly received therein.

According to a fourth aspect of the present invention, there is provided an ink jet recording unit comprising an ink jet recording head and an ink tank cartridge, the ink jet recording unit being exchangeably mounted on a carriage of an ink jet recording apparatus to effect recording on a recording medium therewith by discharging droplets of ink to the recording medium, wherein the ink jet recording-unit comprises a connecting mechanism for connecting the ink jet recording head and the ink tank cartridge to each other and disconnecting them from each other, and a connecting portion for bringing a flow path in the ink jet recording head in sealable contact with a flow path in the ink tank cartridge when the ink jet recording head and the ink tank cartridge are connected to each other.

With the ink jet recording unit having the ink jet recording head and the ink tank cartridge arbitrailly connected to and disconnected from each other according to the fourth aspect of the present invention, the ink jet recording head and the ink tank cartridge can reliably be connected to each other to make sealable communication between both the flow paths with the aid of a simple and inexpensive connecting mechanism. In addition, the ink jet recording head and the ink tank cartridge can easily be disconnected from each other so as to enable the ink tank cartridge to be exchanged with a new one when ink in the ink tank cartridge is substantially fully consumed.

Among the connecting force obtainable from the connecting mechanism, the disconnecting force obtainable from a disconnecting mechanism arranged in the ink jet recording apparatus for disconnecting the ink tank cartridge from the ink jet recording head and the repulsive resilient force of a coil spring disposed in the valve mechanism, the following inequalities are established.

$$Fj-Fv<Fl$$

$$Fj>>Fv$$

where Fj represents a connecting force effective for connecting the ink jet recording head to the ink tank cartridge, Fl represents a disconnecting force of the disconnecting mechanism of the ink jet recording apparatus, and Fv represents a repulsive resilient force obtainable from the coil spring of the valve mechanism disposed in the ink tank cartridge.

According to a fifth aspect of the present invention, there is provided an ink container comprising a housing having a first opening portion and a second opening portion formed thereon, and an ink absorbing member for storing ink being received in the housing the first opening portion being connected to an ink discharging section, and the second opening portion being communicated with the outside when the first opening portion is connected to the ink discharging section, wherein when the first opening portion is connected to the ink discharging section, the power relationship between a capillary power Ka arising in a connecting portion between the ink absorbing member and the ink injecting section connected to each other and a capillary power Kb arising in the region located adjacent to the connecting portion is represented by the following inequality, $$Ka\ (\text{at the time of connection}) \geqq Kb$$

the capillary power Ka arising in the connecting portion immediately after the first opening portion is disconnected from the ink discharging section varies as represented by the following inequality, and $$Ka\ (\text{at the time of connection}) \geqq Ka\ (\text{at the time of disconnection})$$

at this time, the power relationship between the capillary power Ka arising in the connecting portion and the capillary power Kb arising in the region located adjacent to the connecting portion is represented by the following inequality.

$$Ka\ (\text{at the time of disconnection}) \leqq Kb$$

In general, the capillary power arising in the ink absorbing member molded of a foamed synthetic resin or the like is variably determined depending on a size of each pore in the ink absorbing member, a surface tension appearing on the surface of ink, and a contact angle. The capillary power increases in proportion to the reduction of the pore size by compression. The increment of the capillary power leads the increment of the ink retaining power of the ink absorbing member.

With the ink container constructed according to the fifth aspect of the present invention, when the ink container is connected to an ink discharging unit, distribution of the capillary power arising in the ink absorbing member is determined as represented by the following inequality established between the capillary power Ka arising in the connection portion between the ink absorbing member and the ink discharging unit when the ink container is connected to the ink discharging unit and the capillary power Kb arising in the region located adjacent to the connecting portion.

$$Ka\ (\text{at the time of connection}) \geqq Kb$$

As ink is discharged from the ink discharging section, the ink retained in the ink absorbing member on the connecting portion side where the large capillary power ka arises is consumed ahead of the ink retained in the ink absorbing member in the region located adjacent to the connecting portion where the capillary power Kb arises, causing the ink to be successively displaced to the side where the larger ink retaining power is present. Thus, there does not arise a malfunction that feeding of the ink in the connecting portion of the ink discharging section where the capillary power Ka arises is interrupted in the course of ink consumption.

With the ink container constructed in that way, the capillary power Ka arising in the ink absorbing member in the connecting portion between the ink absorbing member and the ink discharging section immediately after the ink container is disconnected from the ink discharging section is represented by the following inequality compared with the capillary power Ka at the time of connection therebetween.

$$Ka\ (\text{at the time of connection}) \geqq Ka\ (\text{at the time of disconnection})$$

In addition, the capillary power Ka at the time of disconnection is represented by the following inequality compared with the capillary power Kb arising in the region located adjacent to the connecting portion.

$$Ka\ (\text{at the time of disconnection}) \leqq Kb$$

In other words, since an intensity of the capillary power Ka arising in the ink absorbing member at the connecting portion is reduced when the ink container is disconnected from the ink discharging section, an extra quantity of ink contained not only over the whole surface of the ink absorbing member at the connecting portion but also in the interior of the ink absorbing member is absorbed in the ink absorbing member, resulting in the ink being sealably retained in the ink absorbing member.

Thus, there does not arise a malfunction that the ink leaks from the ink absorbing member via the first opening portion.

According to a sixth aspect of the present invention, there is provided an ink jet recording unit comprising;

a first filter disposed in an ink intake port of an ink jet recording head adapted to discharge ink from discharging orifices, and a second filter disposed in an ink feed port of an ink tank cartridge to be connected to the ink intake port of the ink jet recording head.

With the ink jet recording unit constructed according to the sixth aspect of the present invention, the first filter is disposed in the ink intake port of the ink jet recording head and the second filter is disposed in the ink feed port of the ink tank cartridge, whereby there does not arise a malfunction that the first filter disposed on the ink jet recording head side is clogged with dust or similar foreign materials, and moreover, there does not arise a necessity for controllably removing the dust from the ink. In addition, since the second filter is disposed in the ink tank cartridge, it is reliably brought in close contact with the porous ink absorbing member. This makes it possible to stably feed the ink to the ink jet recording head.

According to a seventh aspect of the present invention, there is provided an ink tank cartridge having an atmospheric air intake port and an ink outflow port formed thereon at positions different from each other so as to allow ink to be fed to the outside from the ink outflow port, the ink tank cartridge having an ink absorbing member made of a porous material received therein, wherein a plurality of ribs are formed along an inner wall of the ink tank cartridge so as to enable atmospheric air taken through the atmospheric intake port to be distributed over one surface of the ink absorbing member on the atmospheric air intake port side, at least one side surface of the ink absorbing member, and one surface of the ink absorbing member on the ink outflow port side.

With the ink tank cartridge constructed according to the seventh aspect of the present invention, the ink can smoothly be fed from the ink absorbing member to an ink discharging energy generating section by smoothly distributing the atmospheric air taken in the ink tank cartridge over the surface of the ink absorbing member.

According to an eighth aspect of the present invention, there is provided a mechanism for connecting an ink jet recording head having an ink discharging function to an ink receiving container for receiving ink therein, wherein the ink jet recording head and the ink receiving container are connected to each other with a pipe-shaped connecting member interposed therebetween, the connecting member comprising an elastic sealing member for sealably closing at least the space between the ink jet recording head and the ink receiving container from the outside therewith.

According to a ninth aspect of the present invention, there is provided an ink jet recording unit comprising;

an ink jet recording head exhibiting an ink discharging function for discharging ink from ink discharging orifices thereof, the ink jet recording head comprising a sleeve-shaped connecting portion projecting from a housing thereof, the connecting portion having a flow path formed therein to make communication with the ink discharging orifices of the ink jet recording head, an ink receiving container comprising a housing having an opening portion formed thereon, a cylindrical-shaped member projecting inward of the housing while surrounding the opening portion therewith, and an ink absorbing member received in the housing, and a connecting member comprising a pipe-shaped member inserted into the cylindrical-shaped member with a diameter larger than that of the sleeve-shaped connecting portion, and an elastic sealing member fitted around the outer periphery of the pipe-shaped member to come in contact with at least the housing of the ink jet recording head.

According to a tenth aspect of the present invention, there is provided an ink jet recording unit comprising;

an ink jet recording head exhibiting an ink discharging function for discharging ink from ink discharging orifices thereof, the ink jet recording head comprising a sleeve-shaped connecting portion having a flow path formed therein to make communication with the ink discharging orifices of the ink jet recording head and an annular elastic member fitted around the base end of the sleeve-shaped connecting portion, an ink receiving container comprising a housing having an opening portion formed thereon, a cylindrical-shaped member projecting inward of the housing while surrounding the opening portion therewith, and an ink absorbing member received in the housing, and a connecting member comprising a pipe-shaped member having a first pipe-shaped portion to be inserted into the cylindrical-shaped member and a second pipe-shaped portion having a diameter larger than that of the annular elastic member, and an elastic sealing member fitted around the outer periphery of the pipe-shaped member.

With the ink jet recording unit constructed according to the eighth embodiment to the tenth embodiment of the present invention, since the ink jet recording head is connected to the ink receiving container via the pipe-shaped connecting member having the elastic sealing member fitted therearound, when the ink jet recording head is connected to the ink receiving portion so as to allow the ink to be fed to the ink jet recording head from the ink absorbing member via a connecting port of the ink receiving container, the ink jet recording head and the ink receiving container can liquidtightly be connected to each other via the connecting member. In addition, when the connecting member is inserted into the ink receiving container via the connecting port of the ink receiving container, the ink absorbing member is compressed by the connecting member at the foremost end of the latter, causing ink flow to be positively promoted via the compression of the ink absorbing member. In the case that an ink bag is received in the ink receiving container, the ink jet recording head can be connected directly to the ink receiving container without a necessity for disposing any connecting member. Thus, it is not always required that the ink jet recording unit is designed to assume only such a type that the ink receiving container is exchangeably connected to the ink jet recording head.

According to an eleventh aspect of the present invention, there is provided an ink container of which housing is formed with an atmospheric air intake port, the ink container having ink to be fed to recording means received therein, wherein the housing of the ink container comprises a cutout portion along one of the surfaces thereof having the atmospheric air intake port formed thereon.

The ink container constructed according to the eleventh aspect of the present invention is advantageously employable for the case that it is designed with smaller dimensions such that a large ink absorbing member is received in the small ink container so as to allow a possibly large quantity of ink to be stored in the ink absorbing member. In this case, the inner wall surface of the ink container having an atmospheric air intake port and a cutout portion formed thereon comes in direct contact with the porous ink absorbing member made of a spongy material so that intense compression of the ink absorbing member is borne not only by the atmospheric air intake port but also by the cutout portion of the ink container with an increased contact area. Thus, an adequate intensity of ink retaining power of the ink absorbing member can be maintained at a high efficiency in the region inclusive of the atmospheric air intake port without any local compression of the ink absorbing member.

In addition, since an optimal quantity of ink is filled in the ink absorbing member, there do not arise malfunctions that ink leaks from the ink absorbing member during transportation under a severe condition of high temperature, and moreover, a wide temperature cycle ranging from a low temperature to a high temperature is repeated, causing ink leakage to occur with the ink absorbing member.

According to a twelfth aspect of the present invention, there is provided a liquid storing container including a receiving case in which a porous member having a large number of pores communicated with each other therein is received in the compressed state under an atmospheric pressure introduced through an atmospheric air intake port formed on the receiving case with a small diameter, the liquid storing container comprising, an end filter to which liquid is fed from an end part of the porous member while the end filter comes in contact with the end part of the porous member, and a plurality of symmetrical surfaces with respect to the center of the end -filter at a contact portion where the porous member comes in contact with the end filter, the surfaces each extending in the direction of feeding liquid at the contact portion.

The liquid container constructed according to the twelfth aspect of the invention is proposed in consideration of factors each having a significant effect on the liquid displacement state associated with distribution of the compressed state of the porous member over the whole peripheral surface of the latter on the liquid feeding side of the porous member received in the liquid storing container in the compressed state (i.e., the liquid feeding side positionally offset from the center of the porous member in the longitudinal direction). A characterizing feature of the liquid storing container consists in that liquid storing container includes a plurality of symmetrical surfaces each extending in the liquid feeding direction with respect to the center of a contact portion to the porous member. In the case of a liquid storing container having a triangular sectional shape and a contct portion at the center thereof, it has three symmetrical surfaces, and in the case of a liquid storing container having a circular sectional shape and also a contact portion at the center thereof, it has an infinite number of symmetrical surfaces. Each symmetrical surface serves as an element for uniformly distributing of the liquid flowing toward the contact portion over the symmetrical surface. This technical concept is not hitherto known with the conventional liquid storing container. According to the twelfth aspect of the invention, since the local concentration of a gas within the porous member which is generated in response to the feeding of the liquid is avoided, whole balance of the porous member can be suitably maintained. Especially, in the case of the liquid storing container having a triangular sectional shape or a polygonal sectional shape of which each side is dimensioned to have a width of 200 mm or less, the liquid storing container is advantageously employable with an increased advantageous effect.

According to a thirteenth aspect of the preset invention, there is provided a liquid storing container including a receiving case in which a porous member having a large number of pores communicated with each other therein is received in the compressed state under an atmospheric pressure introduced through an atmospheric air intake port formed on the receiving case with a small diameter, the liquid storing container comprising, a circular end filter to which liquid is fed from an end part of the porous member while the filter comes in contact with the end part of the porous member, and wherein a shortest distance as measured from the periphery of a contact portion of the circular end filter to the receiving case is dimensioned to be smaller than the diameter of the contact range where the circular end filter comes in contact with the porous member.

With the liquid storing container constructed according to the thirteenth aspect of the present invention, since the porous member is brought in contact with the inner surfaces of the liquid storing container in the compressed state in the presence of unstable factors therebetween, the contact portion of the porous member compressed by the end filter is caused to have a governable effect on the whole structure of the liquid storing container so as to assure stable feeding of the liquid. To this end, it is recommendable that the shortest distance between the end filter and the receiving case is dimensioned to be smaller than the diameter of the compressed portion (contact portion) of the end filter. Especially, when the shortest distance as measured from the periphery of the contact portion of the end filter to the inner wall surface of the receiving case is dimensioned to be about a half of the diameter of the contact part of the end filter (as represented by a value of a half of the diameter multiplied by a numeral 1.3), an advantageous effect attainable from the liquid storing container becomes very stable.

According to a fourteenth aspect of the present invention, there is provided a liquid storing container including a receiving case in which a porous member having a large number of pores communicated with each other therein is received in the compressed state under an atmospheric pressure introduced through an atmospheric air intake port formed on the receiving case with a small diameter, the liquid storing container comprising, an end filter to which liquid is fed from an end part of the porous member, while the filter comes in contact with the end part of the porous member, and wherein a sectional area of the porous member as measured along the transverse plane positionally coincident with the contact part of the end filter is determined to lie within the range from 4 or more to 6.0 or less times the sectional area of the contact part of the porous member.

In contrast with the liquid storing container constructed according to the twelfth aspect and the thirteen aspect of the present invention wherein the factors each having a significant effect on the liquid displacement state in the liquid storing container are taken into account, a characterizing feature of the liquid storing container constructed according to the fourteenth aspect of the present invention consists in that the relationship between the sectional area of the contact part of the end filter and the sectional area of the porous member is specifically defined. As long as the sectional area of the porous member as measured along the transverse plane positionally coincident with the contact part of the end filter is determined to lie within the range from 3.0 or more to 6.5 or less times the sectional area of the contact part of the porous member, the collective liquid displacement state of the liquid required for performing recording operations toward the contact portion of the end filter can be maintained while permitting the free flow state of the atmospheric air over the whole surface of the porous member. Especially, when the sectional area of the porous member as measured in that way is determined to lie within the range of 4.0 or more to 6.0 or less times the sectional area of the contact portion of the porous member, feeding of the liquid can be achieved with higher stability regardless of how the sectional contour of the porous member at the contact portion of the end filter slightly varies depending on peripheral conditions associated with the receiving case of the liquid storing container.

According to a fifteenth aspect of the present invention, there is provided a liquid storing container including a receiving case in which a porous member having a large number of pores communicated with each other therein is received in the compressed state under an atmospheric pressure introduced through an atmospheric air intake port formed on the receiving case with a small diameter, comprising a contact member, comes in contact with the porous member at one end thereof on the liquid feeding side, for compressing the porous member therewith so as to receive liquid fed from the one end of the porous member, and wherein a compression ratio of the compressed volume of the porous member induced by compression with the contact member to the original volume of the porous member prior to the compression is smaller than that of the compressed volume of the porous member in the ultimately compressed state induced by compression with inner surfaces of the receiving case.

With the liquid storing container constructed according to the fifteenth aspect of the present invention, the relationship between the liquid displacement condition in the longitudinal direction of the porous member and the liquid displacement condition within the range from the outer periphery of the porous member to the contact member, i.e., an end filter located at the contact portion of the porous member is taken into account based on the knowledge that the foregoing relationship is closely associated with the compressed state of the porous member. Since the compression ratio in the longitudinal direction is smaller than that in the radial direction, the liquid in the porous member located on the opposite side to the contact portion of the end filter can easily be displaced to the contact portion side so that collective liquid feeding to the part of the porous member located in the vicinity of the contact portion of the end filter can be achieved by the multiplicative function attainable from the liquid displacement in the radial direction. Thus, for example, in the case that the liquid is quickly discharged or injected by the function of suction induced by a pump, it can be displaced in the porous member without any particular problem. Especially, when the compression ratio is substantially equalized over the whole surface of the porous member within a deviation of ±5%, more preferably within a deviation of ±2%, the desirable collective liquid state can be maintained over the whole periphery of the porous member for a long time. In addition, when a difference between the compression ratio of the porous member in the longitudinal direction and the compression ratio of the same in the radial direction lies within the range from 0.05 or more to 0.25 or less, more preferably within the range from 0.09 or more to 0.18 or less, the liquid in the porous member having a long length can effectively be displaced in the porous member while maintaining excellent quick restorability to the original state of the porous member at the time when the liquid is abnormally distributed in the porous member due to exterior factors such as mechanical vibration, manual vibration or the like.

Finally, according to a sixteenth aspect of the present invention, there is provided a method of filing a liquid storing container with liquid wherein the liquid storing container comprises a porous member having a large number of pores communicated with each other therein, the porous member being received in a receiving case of the liquid storing container, a filter portion adapted to come in close contact with the porous member, a valve portion serving to sealably isolate the filter portion from the outside, the valve portion being displaced at the time of liquid feeding so as to permit the filter portion to make communication with the outside, and an atmospheric air intake port through which atmospheric air is introduced into the receiving case to make communication with the porous member, wherein when the valve portion is displaced, a space sufficient to temporarily store the liquid between the filter portion and the valve portion is formed in the receiving case; and the liquid storing container is filled with the liquid by displacing the valve portion from the outside while the communicated state is maintained between the filter portion and the valve portion.

The liquid filling method of the present invention is employable not only for the purpose of initially filling the liquid storing container with liquid but also for the purpose of refilling the liquid storing container with liquid. When the liquid storing container is constructed by adequately combining one or more selected from the group of technical concepts as mentioned above with each other, liquid filling can be achieved more stably. With the liquid storing container as defined in claim 55, since the filter is preliminarily brought in close contact with the porous member for the purpose of liquid feeding, liquid filling can reliably be achieved regardless of the number of compressions of the porous member without any necessity for applying mechanical pressure to the porous member while the liquid is uniformly distributed in the porous member. In addition, the liquid can gradually be fed to the liquid storing container without irregular distribution of the liquid in the porous member while the liquid is temporally stored in the space between the filter portion and the valve portion. Since the filter portion is disposed in the ink storing container by utilizing the foregoing space, there does-not arise a malfunction that the filter portion is damaged or injured in the course of each filling operation.

When the boundary of the filter portion is defined and an area of the same is calculated, it is obvious that effectively available values are employed for the purpose of definition and calculation as mentioned above, provided that these values lie within the range which assures that the liquid can flow through the filter portion.

Other objects, features and advantages of the present invention will become apparent from reading of the following description which has been made in conjunction with the accompanying drawings.

BRIEF DESCRIPTION OF THE DRAWINGS

FIGS. 51A to 51C show by way of sectional views an ink tank cartridge constructed according to a twenty fourth embodiment of the present invention wherein FIG. 51A is a cross-sectional view of the ink tank carriage taken along line 51A—51A in FIG. 51B, FIG. 51B is a sectional view of the ink tank cartridge take along line 51B—51B in FIG. 51A, and FIG. 51C is a sectional view of the ink tank cartridge taken along line 51C—51C in FIG. 51A;

DETAILED DESCRIPTION OF THE PREFERRED EMBODIMENTS

The present invention will now be described in detail hereinafter with reference to the accompanying drawings which illustrate preferred embodiments thereof.

Figure 1:
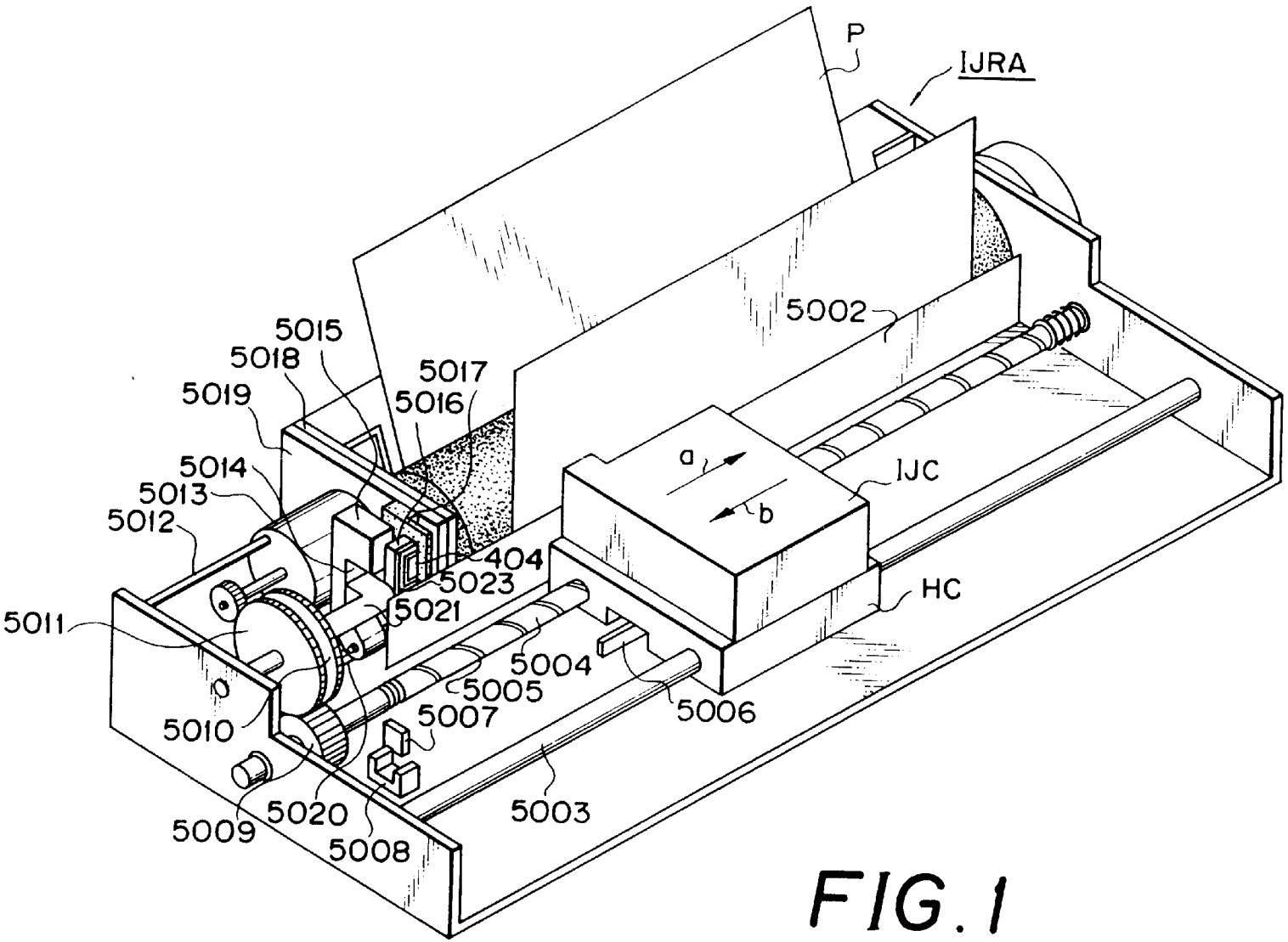
FIG. 1 is a perspective view which shows by way of example of an ink jet recording apparatus to which the present invention is applied.

An ink jet recording apparatus IJRA to which the present invention is applied will be described below with reference to FIG. 1. The ink jet recording apparatus IJRA includes a carriage HC on which an ink jet recording unit IJC is removably mounted. The carriage HC includes a pin (not shown) adapted to come in engagement with a spirally extending groove 5005 on a lead screw 5004. As a driving motor 5013 is rotated in the normal direction or in the reverse direction, the lead screw 5004 is rotated by the motor 5013 via driving power transmitting gears 5011 and 5009 so as to allow the carriage HC to reciprocally move not only in the a arrow-marked direction but also in the b arrow marked direction. In the drawing, reference numeral 5002 designates a thrusting plate for thrusting a recording medium such as a paper, a film for an OHP, a fabric or the like against a platen 5000 within the displacement range of the carriage HC, and reference numerals 5007 and 5008 designate photo-couplers. The photo-couplers 5007 and 5008 serve as home position detecting means for optically recognizing the presence of a lever 5006 of the carriage HC so as to shift the direction of the motor 5013 from the normal direction to the reverse direction and vice versa. Reference numeral 5016 designates a supporting member for supporting a cap member 404 for capping the-front surface of an ink jet recording head therewith, and reference numeral 5015 designated a suction means for sucking in the cap member 404.

The suction means 5015 evacuates waste ink via an opening 5023 within the cap member 404 so as to recover the ink jet recording head.

Reference numeral 5017 designates a cleaning blade, and reference numeral 5019 designates a displacing member for displacing the cleaning blade 5017 in the forward/rearward direction. The displacing member 5019 is supported by a support plate 5018. The configuration of the cleaning blade 5017 should not be limited only to the shown one. Alternatively, any type of conventional cleaning plate may be employed for the same purpose. Reference numeral 5012 designates a lever for starting the actuation of the suction means 5015. As a cam 5020 adapted to be engaged with the carriage HC is displaced, the lever 5012 is displaced so as to properly control the driving power of the driving motor 5013 with the aid of hitherto known power transmitting means such as clutch shifting means or the like.

While the carriage HC is located within the home position range, the lead strew 5005 is rotated so as to allow the carriage HC to assume predetermined positions corresponding to the capping, the cleaning and the sucking as mentioned above.

(Embodiment 1)

Figure 5:
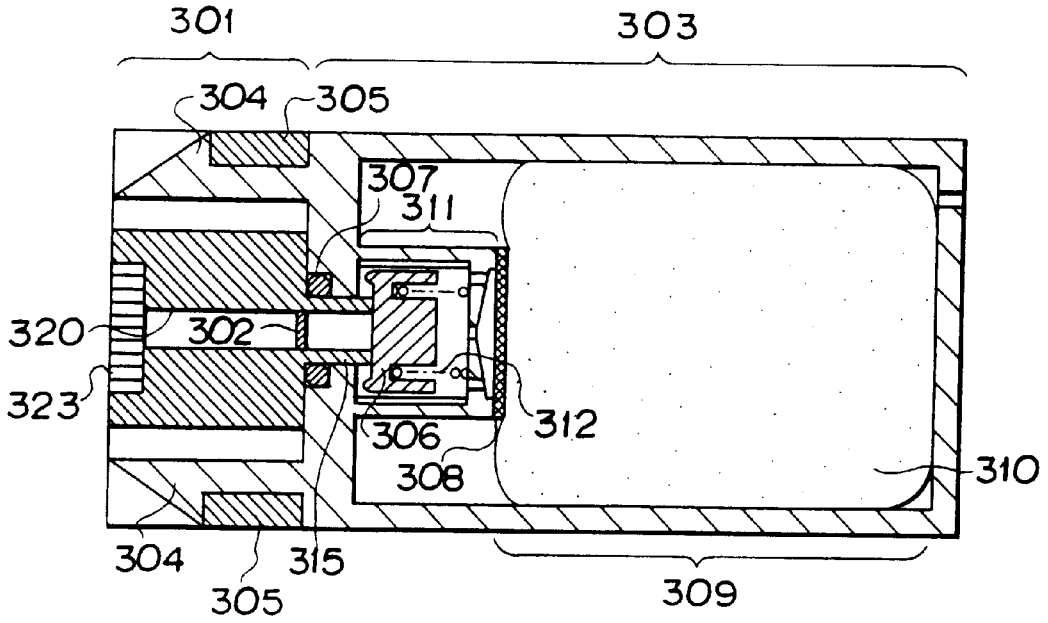
FIG. 5 is a sectional view of an ink jet recording unit constructed according to a first embodiment of the present invention.
Figure 6:
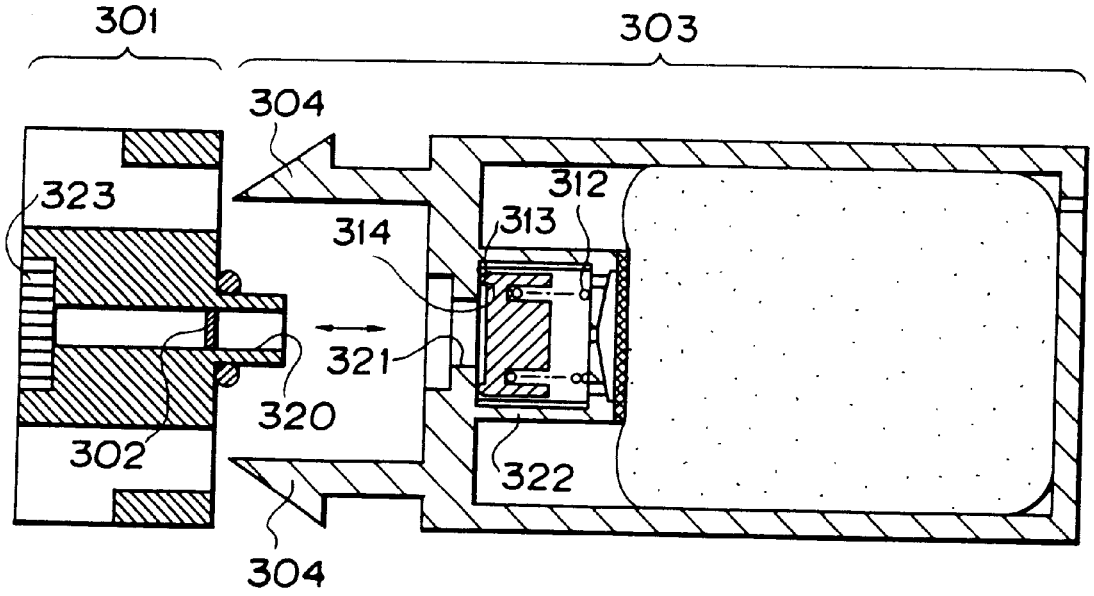
FIG. 6 is a sectional view of the ink jet recording unit, particularly showing an ink tank cartridge and an ink jet recording head in the disconnected state.

Next, an ink jet recording unit constructed according to a first embodiment of the present invention will be described below with reference to FIG. 2 and FIG. 5. The ink jet recording unit includes an ink jet recording head 301 and an ink tank cartridge 303 both of which can be separated from each other. The ink jet recording unit constructed in that way is employable for the ink jet recording apparatus as shown in FIG. 1. Usually, to separatively remove dust from an ink, a filter 302 is disposed at the intermediate position of a path 320 in the ink jet recording head 301, and an effective pore diameter of the filter 302 is set to 5 to 20 $\mu$m. In this embodiment, the ink tank cartridge 303 is connected to the ink jet recording head 301 by bringing a pair of arrow-shaped pawls 304 integrally projected from the ink tank cartridge 303 in engagement with the corresponding receiving portions 305 formed in the ink jet recording head 301. As shown in FIG. 6, the arrow-shaped pawls 304 are arranged in the symmetrical relationship so that they are simultaneously engaged with the receiving portions 305. Upon completion of the engagement of the arrow-shaped pawls 304 with the receiving portions 305, an ink feed pipe 315 projecting from the ink jet recording head 301 is engaged with a valve mechanism 311 in the ink tank cartridge 303, causing a valve body 306 to be retracted in the rightward direction as seen in FIG. 5 against the resilient force of a coil spring 312 so as to enable an ink to be fed the ink jet recording head 301 from the ink tank cartridge 303 via the path 320. At this time, an O-ring 307 disposed around the ink feed pipe 315 seals the joint portion between the ink feed pipe 315 and the valve mechanism 311. A cartridge filter 308 is disposed on the upstream side of the valve mechanism 311 in the ink tank cartridge 303.

An ink reservoir 309 is arranged upstream of the cartridge filter 308 in the ink tank cartridge 303. In this embodiment, the ink reservoir 309 is constructed such that an ink is impregnated in a porous material 310 received in the ink tank cartridge 303 in the compressed state. In general, to stably maintain performances of the ink jet recording apparatus, it is-.necessary that an ink pressure appearing in discharging orifices 323 of the ink jet recording head 301 is kept negative. To this end, the ink pressure in the ink tank cartridge 303 is usually kept negative. In this embodiment, the ink pressure is controlled by utilizing the capillary power of the porous material 310 so as to allow it to be kept negative. The valve body 306 is molded of an elastic material such as a rubber or the like so that it is slidably displaceable in the valve mechanism 311. As is apparent from FIG. 6, when the ink tank cartridge 303 is disconnected from the ink jet recording head 301, an annular sealing portion 313 of the valve body 306 is brought in close contact with a valve body receiving portion 314 around the periphery of an insert hole 321 in the ink tank cartridge 303 by the repulsive force of the coil spring 312 so as to prevent the ink from uselessly flowing out of the ink tank cartridge 303. Thus, there does not arises a malfunction that after the ink tank cartridge 303 is disconnected from the ink jet recording head 301, ink leakage occurs due to shock, vibration or the like during transportation, and also the ink is dried in the ink tank cartridge 303 during storage or viscosity of the ink is increased.

It is confirmed that the symmetrical arrangement of a pair of arrow-shaped-pawls 304 as mentioned above is simple in structure and effective for assuring that the O-ring 307 stably serves as a sealing member for sealably maintaining the ink passageway in the ink jet recording unit. It is recommendable that ethylene-propylene rubber (EPDM) is employed as a raw material for the O-ring 307. This is because the ethylene-propylene rubber exhibits high gas barrier properties, and moreover, it exhibits excellent properties required by the O-ring 307 in respect of ink-resistance, tear-resistance, non-adhesiveness and anti-creeping ability.

Since the ink passageway is designed in the above-described manner, i.e., a joint portion is disposed between the ink jet recording head 301 and the ink tank cartridge 303, it is assured that the interior of the ink jet recording unit is reliably kept in the negative pressure state without an occurrence of ink leakage through the joint portion while the ink tank cartridge 303 is connected to the ink jet recording head 301.

In this embodiment, force relationship among the connecting force between the ink jet recording head 301 and the ink tank cartridge 303, the repulsive force of the valve body 306 at the time of connection therebetween, and the disconnecting force of a disconnecting mechanism of the ink jet recording apparatus for disconnecting the ink tank cartridge 303 from the ink jet recording head 301 is represented by the following inequalities.

$$Fj-Fv<Fl$$

$$Fi>>Fv$$

where, Fj: connecting force between the ink jet recording head and the ink tank cartridge, Fl: disconnecting force of the disconnecting mechanism in the ink jet recording apparatus, Fv: repulsive force of the coil spring in the valve mechanism in the ink tank cartridge.

To assure that the ink tank cartridge 303 is smoothly connected and disconnected with excellent reliability, it is desirable that the following inequalities are established.

$$9.8\ N<Fj<19.6\ N$$

$$Fv>4.9\ N$$

With this construction, a user can make connection and disconnection between the ink jet recording head 301 and the ink tank cartridge 303 as desired. In the case that-the ink jet recording head 301 is repeatedly connected to and disconnected from the ink tank cartridge 303 for some reason, air is gradually introduced not only into the ink jet recording head 301 but also into the valve mechanism 311 in the ink tank cartridge 303. While the foregoing state is maintained, it is very difficult to continue the recording operation further, since ink can not stably be fed to the ink jet recording head 301 any more. In this embodiment, the valve mechanism 311 is designed so as to allow the ink path in the valve mechanism 311 to have a very small working volume. Thus, the valve mechanism 311 can easily be restored to the original state by performing a pumping operation therewith even though a preset value Pv representing a volume to be pumped per one stroke of a pump (not shown) of the ink jet recording apparatus. For example, to assure that a running cost of the ink jet recording apparatus is suppressed while reducing a quantity of ink consumption, it is preferable that a volume of ink to be pumped per one stroke of the pump is set to 0.1 cc or less. In this embodiment, a sum of a volume Cv of the valve mechanism 311 and a volume Hv as measured from the inlet port of a path 320 in the ink jet recording head 301 to the filter 302 is designed to be smaller than the volume of ink to be pumped per one stroke by the pump. It is preferable that the sum of the volumes is 0.05 cc or less. Thus, the following inequalities are established among the preset value Pv, the volume Cv and the volume Hv.

$$Pv>(Cv+Hv) \text{ or } Cv<(Pv-Hv)$$

The flowing state of ink during the pumping operation of the pump will be described below with reference to FIGS. 7A to 7D on the assumption that the pump and the ink jet recording unit are designed in the above-described manner.

Figure 7A:
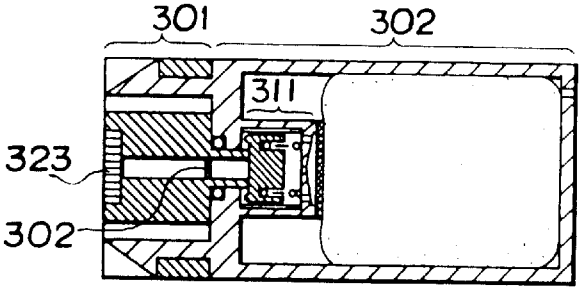
FIGS. 7A to 7D illustrate by way of sectional views a mode of operation of the ink jet recording unit constructed according to the first embodiment of the present invention.

FIG. 7A shows by way of sectional view the state of the ink jet recording unit before the pumping operation is started. At this time, the ink path in the ink jet recording head 301 and the ink tank cartridge 303 is substantially filled with air. While the foregoing state is maintained, any correct recording operation can not be achieved.

Figure 7B:
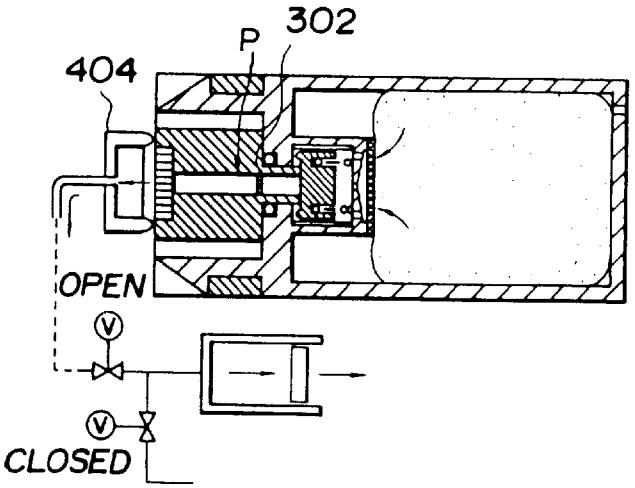
Figure 7C:
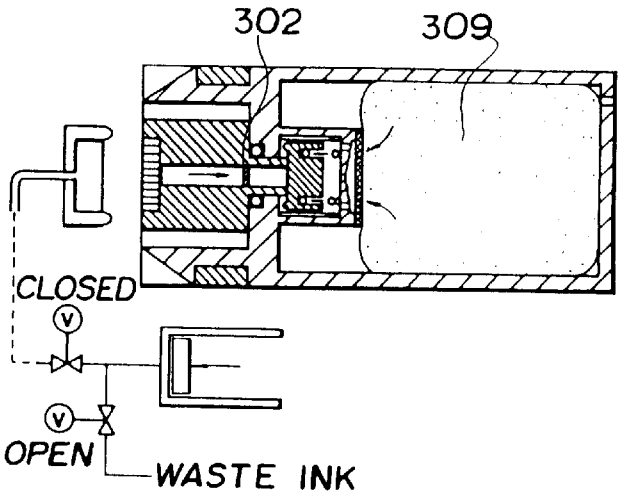

As shown in FIG. 7B, to perform a first pumping operation, the pump is operated to suck the ink reservoir via a suction cap 404 such that the ink in the ink reservoir is conducted to the position in excess of the filter 302 in the ink jet recording head 301. At this time, however, the ink does not reach the discharging orifices 323 of the ink jet recording head 301. FIG. 7C shows by way of sectional view the flowing state of ink during a next pumping operation.

Upon completion of the first pumping operation, the pump is restored to the initial state to perform the next pumping operation, and at this time, the suction cap 404 is once disconnected from the ink jet recording head 301. At this time, the ink filled till the intermediate position of the flow path in the ink jet recording head 301 is caused to return to the ink reservoir 309 held under the negative pressure. However, the ink can not return to the position located upstream of the filter 302 because of the surface tension present over the filter 302 in the ink jet recording head 301.

Figure 7D:
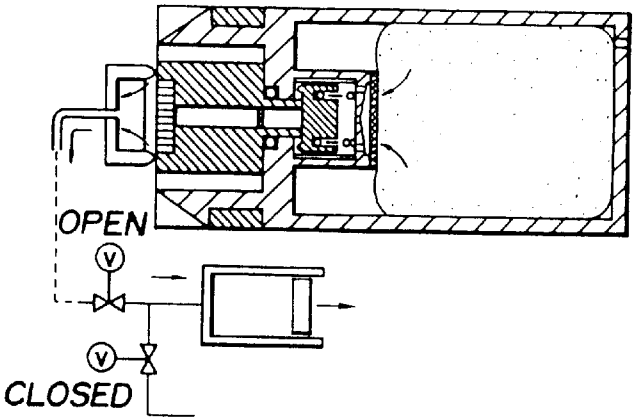

FIG. 7D shows by way of sectional view an operational state of the pump when a pumping operation is restarted with the pump. During the restarted pumping operation, it suffices that the short range extending from the filter 302 to the discharging orifices 323 of the ink jet recording head 301 is filled with the ink.

Figure 55:
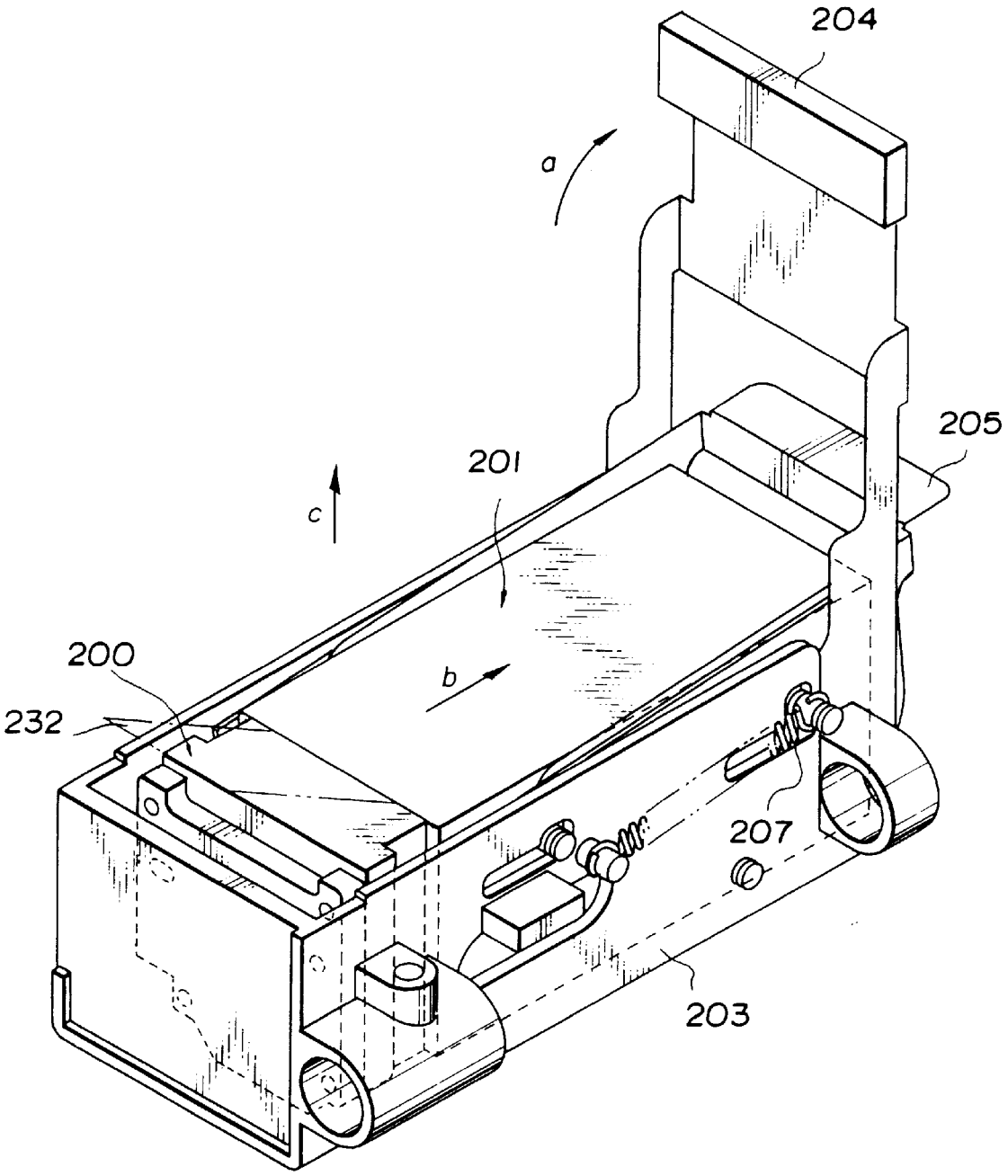
FIG. 55 is a perspective view of the ink jet recording unit shown in FIG. 52, particularly showing that the ink jet recording unit is exchanged with another one in a first type of fashion.

Since the connection of the ink tank cartridge 303 to the ink jet recording head 301 is achieved with the aid of a pair of arrow-shaped pawls 304 fitted into the corresponding receiving portions 305, the ink jet recording head 301 is connected to the ink tank cartridge 303 with very high stability. Thus, there do not arise malfunctions that recorded position are dislocated from the original positions, and moreover, a quality of recording operation is degraded regardless of how often the ink jet recording head 301 and the ink tank cartridge 303 are repeatedly connected to each other and disconnected from each other. It should be added that after the ink jet recording unit is removed from the ink jet recording apparatus, the former can stand as an independent unit. For example, in the case that monocolor printing is performed by utilizing the ink jet recording apparatus, it can simply be achieved merely by lifting a unit attaching/detaching lever 204 of the printer carriage HC as shown in FIG. 55 so as to exchange the ink jet recording unit with another one. Since the disconnecting force is uniformly applied to the arrow-shaped pawls 304 (serving as a connecting mechanism) by actuating the unit attaching/detaching lever as a disconnecting mechanism, there does not arise a malfunction that the connected portion between the ink jet recording head 301 and the ink tank cartridge 303 is damaged or injured due to the load applied concentratively to a part of each arrow-shaped pawl 304.

{Embodiment 2)

Figure 8:
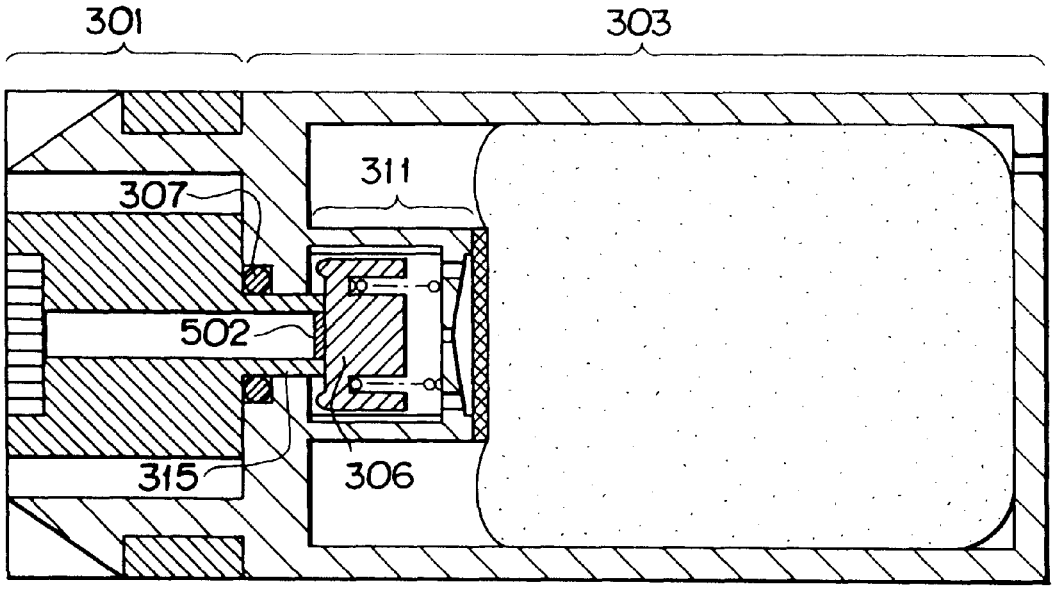
FIG. 8 is a sectional view of an ink jet recording unit constructed according to a second embodiment of the present invention.

An ink jet recording unit constructed according to a second embodiment of the present invention will be described below with reference to FIG. 8.

In this embodiment, a filter 502 is disposed at the foremost end of an ink feed pipe 315 on the upstream side of the latter in an ink jet recording head 301. With this construction, the working volume of a valve mechanism 311 in an ink tank cartridge 303 is determined by satisfying the following equation.

Since an equation Hv=0 is established, the aforementioned inequalities (1) is represented in the following manner.

$$Cv<Pv$$

Consequently, according to the second embodiment of the present invention, it is possible that Cv assumes a value larger than that of Cv in the preceding embodiment. Alternatively, since the preset value Pv can be reduced, an ink jet recording apparatus operable at a reduced running cost can be realized.

Next, the valve mechanism 311 employed for the ink tank cartridge constructed according to the proceeding embodiments of the present invention will be described below in respect of a structure and a mode of operation thereof with reference to FIGS. 9A to 9C.

Figure 9A:
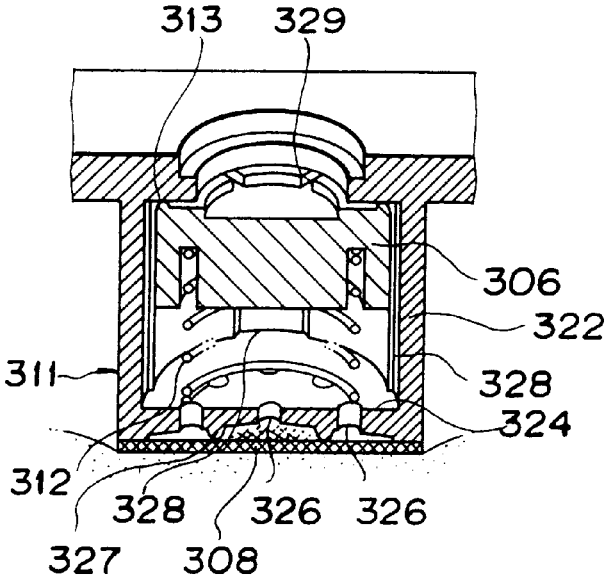
FIG. 9A is a sectional perspective view of a valve mechanism employable for the ink tank cartridge constructed according to the present invention.

FIG. 9A is an exploded perspective view which shows the structure of the valve mechanism 311 to which is not still connected an ink jet recording head. While the foregoing state is maintained, since a valve body 306 is brought in contact with an inner wall surface of the valve mechanism 311 by the repulsive force of a compression coil spring 312, ink does not leak to the outside from the valve mechanism 311. The valve mechanism 311 includes a cylindrical member 322 integrated with the top wall of the ink tank cartridge 303 while projecting from the latter, and a filter 308 is secured to the rear end of the cylindrical member 322. As also shown in detail in FIGS. 64A and 64B, a stopper 324 is disposed on the downstream side of the filter 308. The stopper 324 has an inverted-conical tapered surface 325 formed thereon on the confronting side with the filter 308, and a plurality of communication holes 326 are formed through the stopper 324. In addition, to prevent an occurrence of malfunction that the filter 308 is undesirably deformed, causing the communication holes 326 to be closed by the deformed filter 308, a plurality of ribs 327 are formed integral with the stopper 324. A plurality of axially extending grooves 328 are formed along the inner cylindrical wall of the cylindrical member 322, while a plurality of radially extending grooves 329 are formed inside of an annular sealing portion 313 on the top surface of the valve body 306.

Figure 9B:
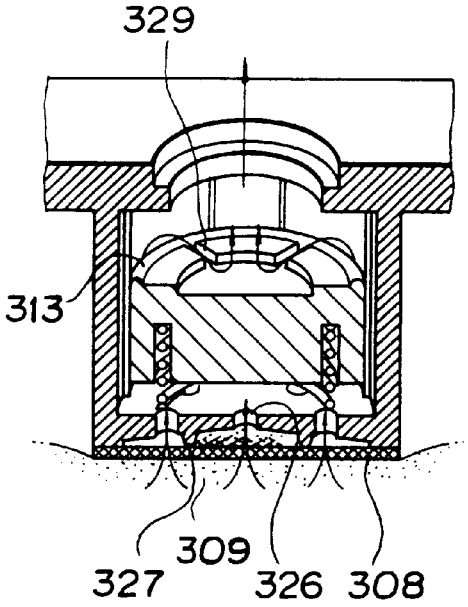
FIGS. 9B and 9C illustrate by way of sectional views a mode of operation of the valve mechanism shown in FIG. 9A.

FIG. 9B shows the operative state of the valve mechanism 311 wherein the valve body 306 is pressed from the outside in the interior of the valve mechanism 311 so as to move in the valve mechanism 311. While the foregoing state is maintained, ink stored in an ink reservoir 309 flows through the filter 308 and then flows outside of the valve mechanism via a space defined between the rear surface of the filter 308 and the stopper 324, a plurality of communication holes 326, a plurality of axially extending grooves 328 and a plurality of radially extending grooves 329.

Since the valve mechanism 311 is constructed in the above-described manner, the working volume of the ink path in the valve mechanism 311 can possibly be minimized with high reliability while the reduced movable range of the valve body 306 in the valve mechanism 311 is maintained. Here, the previously mentioned volume Cv of the valve mechanism 311 is defined in the following manner. Specifically, the volume Cv represents a volume which remains after a volume corresponding to invasion of the ink feed pipe 315 of the ink jet recording head 301 in the cylindrical member 322 and a volume occupied by the valve body 306, the coil spring 312 and the stopper 324 is subtracted from the interior volume of the cylindrical member 322 located downstream of the filter 308.

Figure 9C:
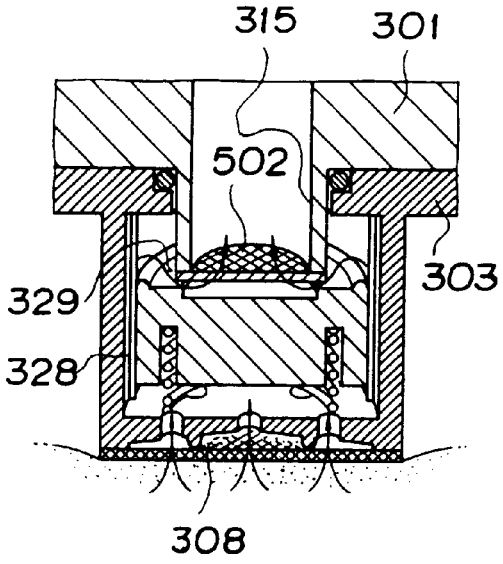

FIG. 9C shows the same operative state of the valve body as that shown in FIG. 9B except that the ink feed pipe 315 of the ink jet recording head 301 is brought in engagement with the valve mechanism 311. In this embodiment, the filter 502 is secured to the foremost end of the ink feed pipe 315 for the reason as mentioned above. However, since the configuration as shown in FIG. 9A is employed for the valve body 306 located opposite to the filter 502, it is obvious that the filter 502 does not obstruct the flowing of ink.

Figure 49A:
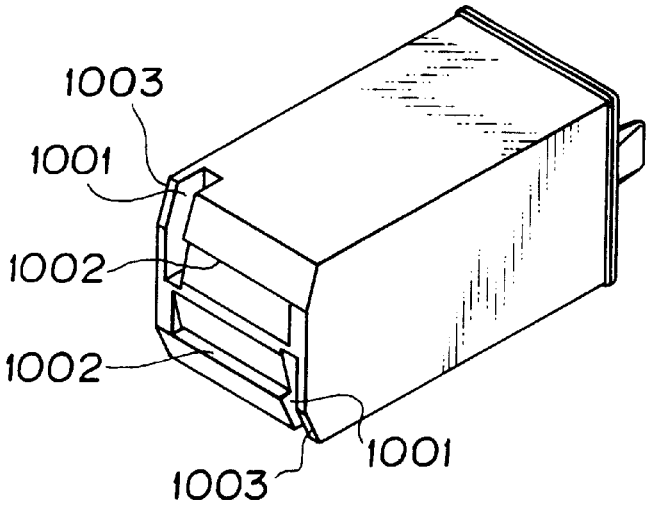
FIGS. 49A to 49C show by way of perspective views ink tank cartridges constructed according to another embodiment of the present invention, respectively, modified from the aforementioned embodiments.
Figure 49B:
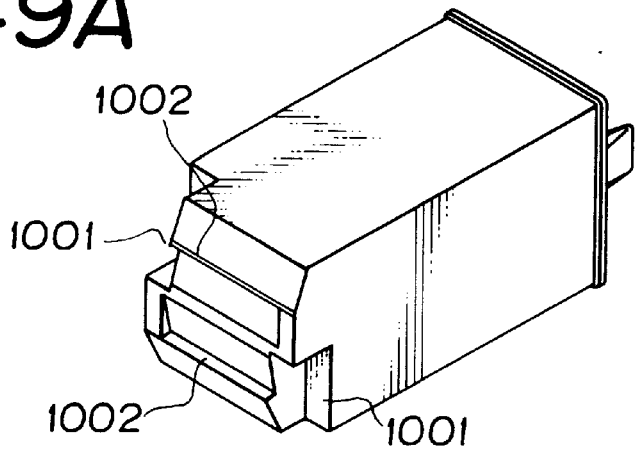
Figure 49C:
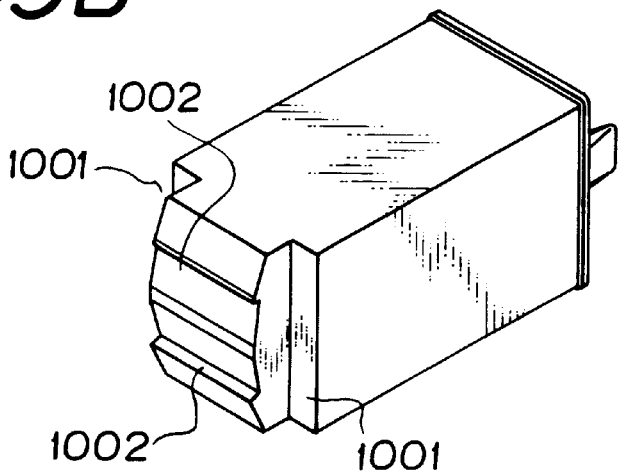
Figure 50A:
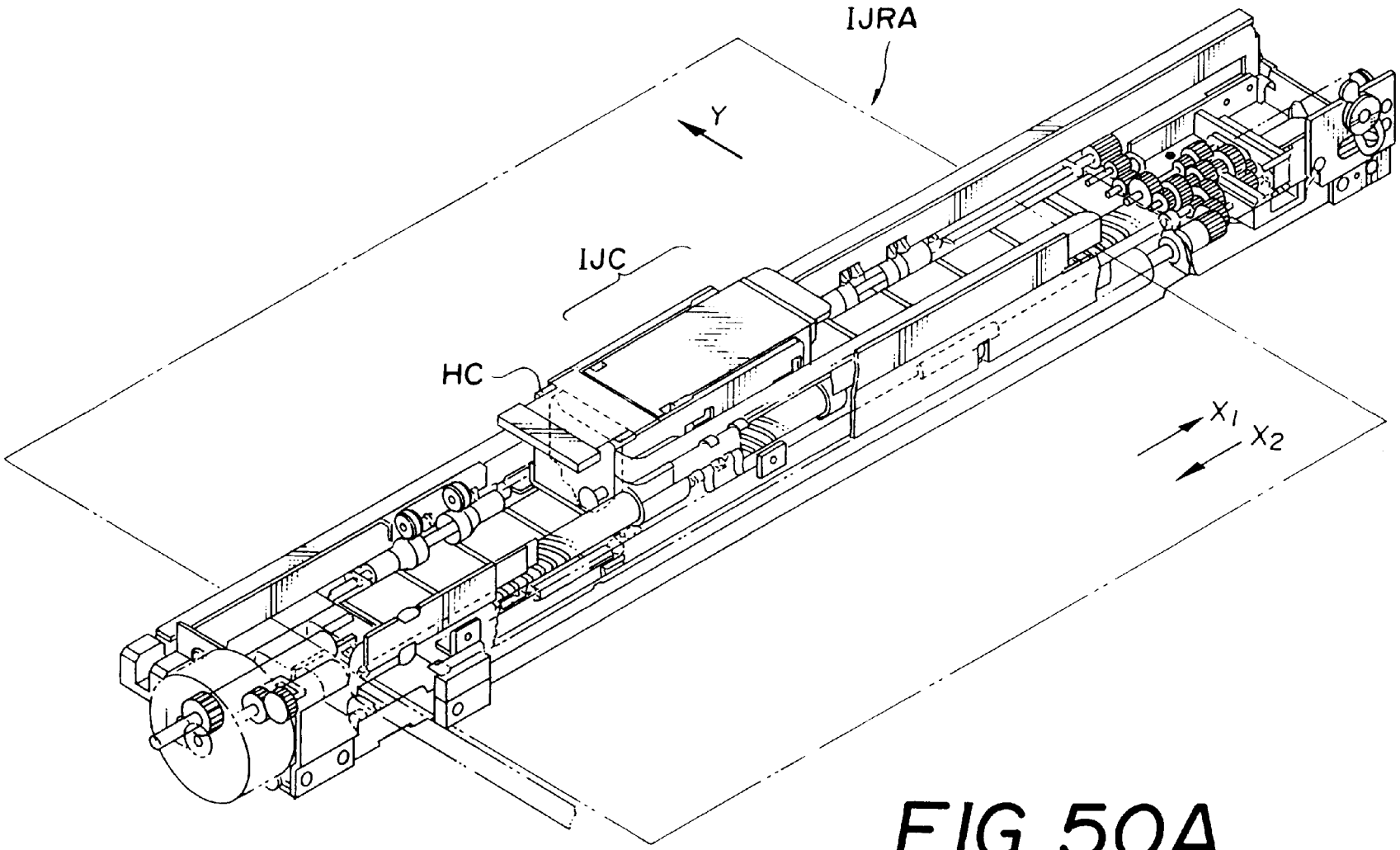
FIG. 50A is a perspective view of another ink jet recording apparatus to which the present invention is applied.
Figure 50B:
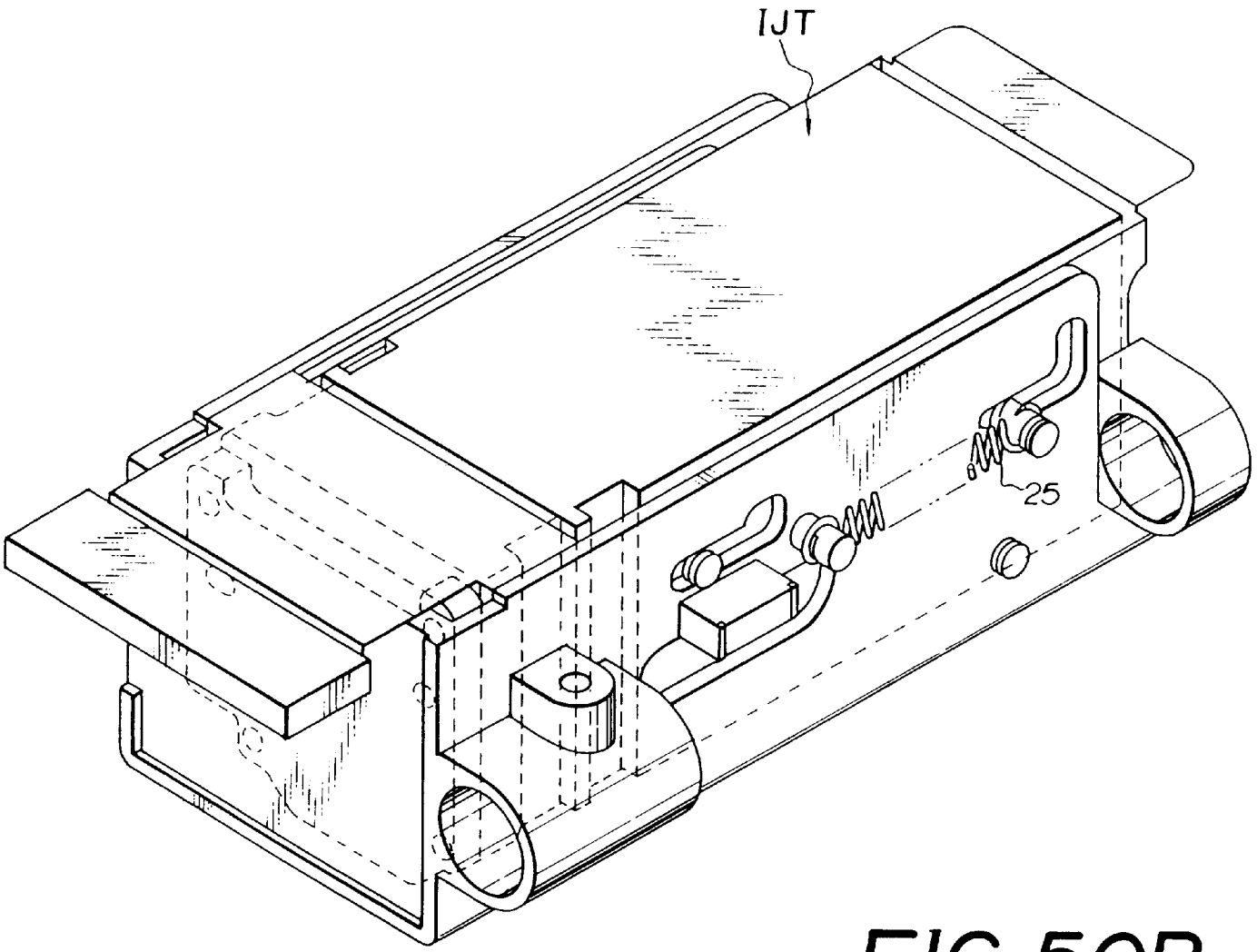
FIG. 50B is a perspective view of a printer carriage for the ink jet recording apparatus shown in FIG. 50A.

FIGS. 49A to 49C each schematically show by way of perspective view the structure of an ink tank cartridge for an ink jet recording unit to which the present invention is applicable.

The ink tank cartridges as shown in the figures are constructed so as to be mounted on a carriage of an ink jet recording apparatus in the inverted state, respectively. The ink tank cartridge to be connected to the ink jet recording head includes an opening portion (not shown) for feeding ink to the ink jet recording head and an atmosphere communication port (not shown) by way of which the interior of the ink tank cartridge is communicated with the environmental atmosphere. The ink tank cartridge includes a pawl portion 1002 serving as a slippage stopper when it is dismounted from the ink jet recording apparatus and a cutout portion 1001 adapted to be engaged with a projection on the ink jet recording apparatus when it is mounted on the latter, at two locations determined so as to correspond to the mounting of the ink tank cartridge in the inverted state.

FIG. 49A shows by way of perspective view that the cutout portions 1001 are formed inside of the opposite side walls of the ink tank cartridge in order to protect the projection on the ink jet recording apparatus from unexpected collision or the like when the ink tank cartridge is mounted on the ink jet recording apparatus.

FIGS. 49B and 49C show likewise by way of perspective views the case that cutout portions 1001 are not formed inside of the opposite side walls of the ink tank cartridge but they are formed along the front edges of the opposite side walls of the same. For this reason, the protective effect attainable with the ink tank cartridge as shown in FIG. 49A can not be expected but the ink tank cartridge can easily be produced.

As is apparent from the foregoing description, according to the preceding embodiments of the present invention, while the ink jet recording head and the ink tank cartridge are connected to each other, the interior of the ink jet recording unit can be maintained in the negative pressure state without an occurrence of malfunction that ink leaks from the connected portion therebetween. Since the ink jet recording head and the ink tank cartridge are stably connected to each other, there does not arise a malfunction that a-quality of recording is adversely affected when the ink jet recording head is arbitrarily connected to and disconnected from the ink tank cartridge, and moreover, the ink jet recording unit can easily be exchanged with another one. Consequently, the present invention has provided an ink jet recording unit including an ink jet recording head and an ink tank cartridge arbitrarily connectable to and disconnetable from each other wherein the ink tank cartridge can simply be connected to the ink jet recording unit to form an ink flow path and exchangeably disconnected from the ink jet recording unit with the aid of a simple and inexpensive mechanism, and vice vera.

(Embodiment 3)

Figure 10:
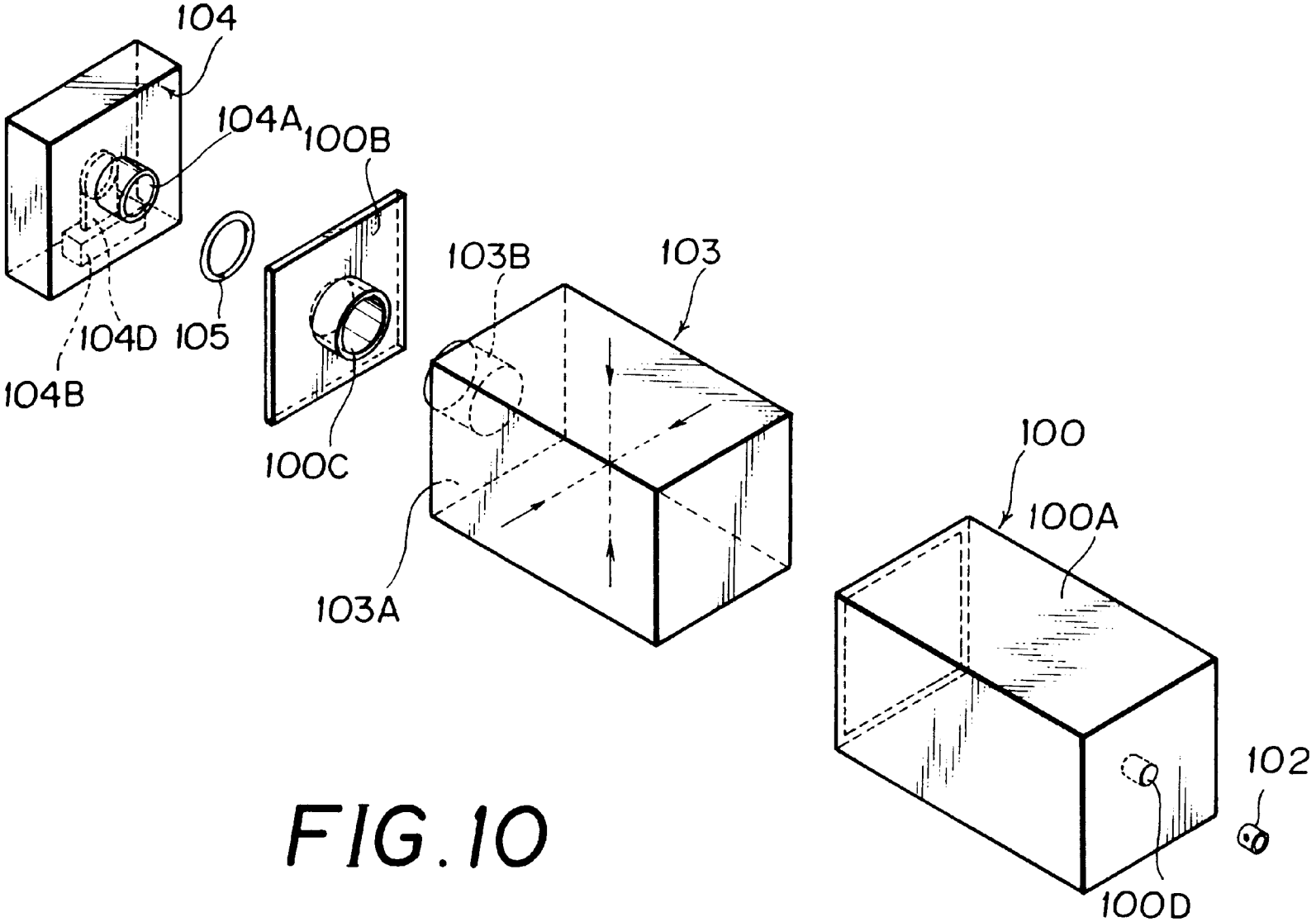
FIG. 10 is an exploded perspective view of an ink jet recording unit constructed according to a third embodiment of the present invention, particularly showing essential components constituting the ink jet recording unit.
Figure 12:
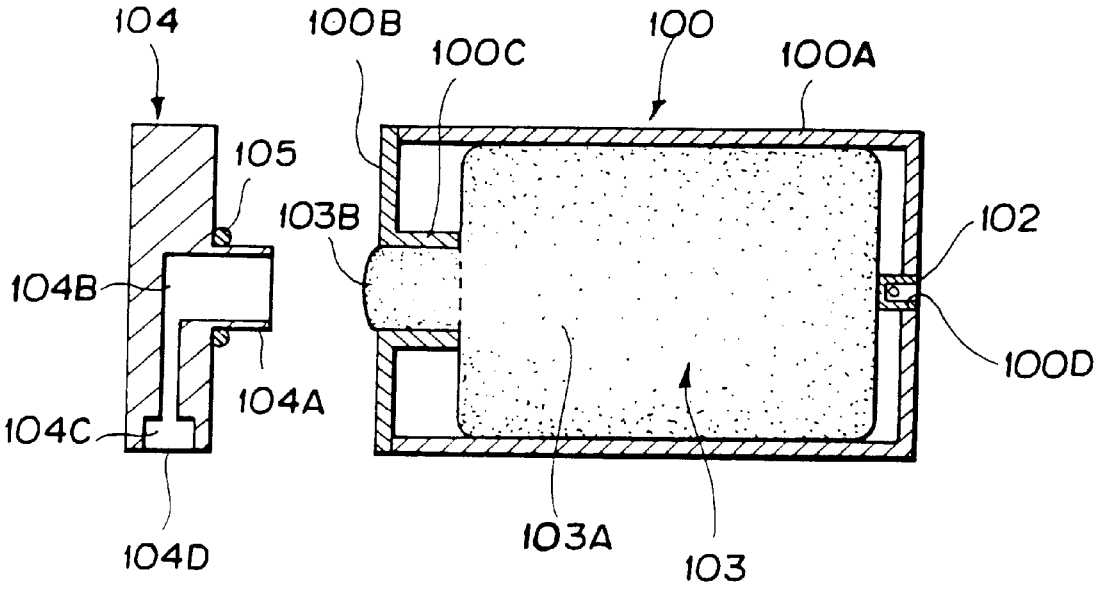
FIG. 12 is a sectional view of the ink jet recording unit shown in FIG. 10, particularly in the connected state.
Figure 11:
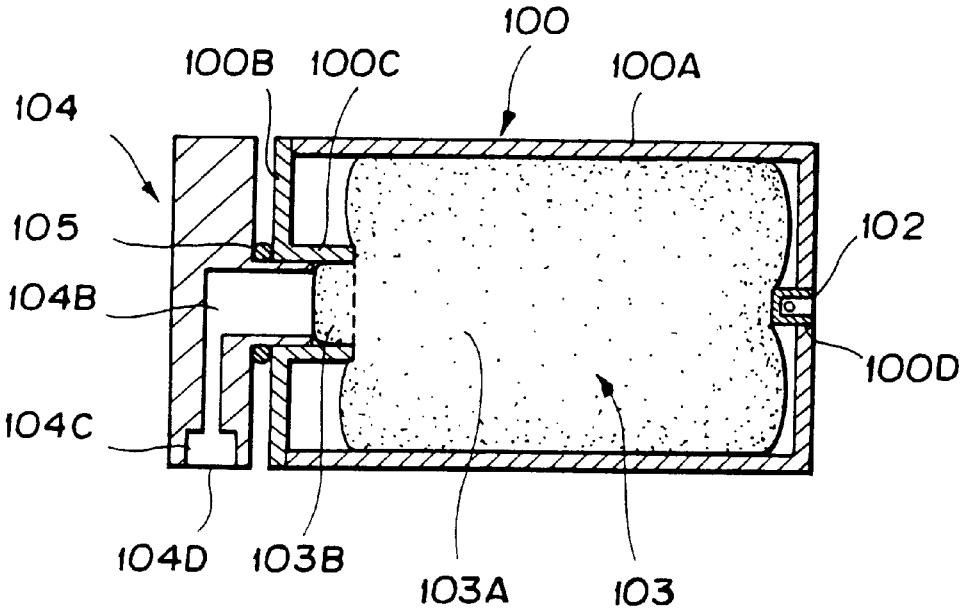
FIG. 11 is a sectional view of the ink jet recording unit shown in FIG. 10, particularly in the disconnected state.

Next, an ink jet recording unit constructed according to a third embodiment of the present invention will be described below with reference to FIGS. 10 to 12. FIG. 10 is an exploded perspective of the ink jet recording unit, particularly showing essential components constituting the ink jet recording unit in the disassembled state, FIG. 11 shows by way of sectional view the structure of the ink jet recording unit in the disconnected state, and FIG. 12 shows likewise by way of sectional view the structure of the ink jet recording unit in the connected state.

In the drawings, reference numeral 100 designates an ink container casing (serving as an ink tank cartridge). The ink container casing 100 is composed of a parallelepiped-shaped main body 100A having a bottom wall integrated therewith and a cover 100B adapted to close a front opening portion of the main body 100A therewith. A cylindrical member 100C serving as a first opening portion is projected inside of the cover 100B at the central part of the latter, and a projection projecting from an ink discharging unit (serving as an ink jet recording head to be described later) is fitted into the first opening portion, i.e., the cylindrical member 100C. In addition, a second opening portion 100D is formed on the main body 100A to make communication with an environmental atmosphere therethrough, and a plug 102 having a T-shaped communication path formed therein is press-fitted into the second opening portion 100D so as to prevent ink in the ink container casing 100 from be scattered directly away from the latter to the outside at the time of falling-down or the like. A sponge-like absorbing member 103 is received in the ink container casing 100 so that ink is retained in the absorbing member 103. A polyurethane based foamed material, a melamine resin based absorbing material and a polyethylene based absorbing material can be used as typical materials employable for the absorbing member 103.

The absorbing member 103 is composed of a parallelepiped-shaped main body (refereed to as a main body absorbing member hereinafter) 103A and a cylindrical connecting portion (refereed to a connecting portion absorbing member hereinafter) 103B projecting from the main body 103A so that a capillary power of the absorbing member 103 exhibit different properties with a part of the same represented by a dashed line shown in FIG. 11 as a boundary therebetween. Before the absorbing member 103 is received in the ink container casing 100, it may exhibit either a compressed state or a non-compressed state. However, when the main body absorbing member 103A is received in the ink container casing 100, it is compressed in the arrow-marked direction as shown in FIG. 10 (coincident with the direction of ink outflow perpendicular to the axial direction of the cylindrical member 100C) to generate a capillary power Kb. On the other hand, when the connecting portion absorbing member 103B is received in the cylindrical member 100C, it generates a capillary power Ka either in the compressed state or in the non-compressed state.

For example, in the case that an absorbing material having a large number of voids or pores each having a substantially constant size uniformly distributed therein is employed as a material for the absorbing member 103, when the main body 103A is received in the ink container casing 103, a volume of the main body absorbing member 103A is compressively reduced to 70% based on the volume of the same prior to the receipt in the ink container casing 100A. On the other hand, when the connecting portion, absorbing member 103B is received in the cylindrical member 100C, a volume of the connecting portion absorbing member 10B is reduced to 95% based on the volume of the same prior to the receipt in the cylindrical member 100C.

In addition, reference numeral 104 designates an ink discharging section (an ink jet recording head). A cylindrical projection 104A adapted to be fitted into the cylindrical member 100C of the ink container casing 100 is projected from the side wall of the ink discharging section 104. An ink chamber 104B communicated with the projection 104A is formed in the ink discharging section 104 so that it is communicated with a plurality of ink paths 104C each having an ink discharging orifice 104D formed at the foremost end thereof.

An electrothermal converting element (not shown) is disposed in each ink path 104C to serve as ink discharging means. Various types of ink discharging sections 104 are practically available, and any type of discharging section 104 is employable Reference numeral 105 designates an O-ring molded of rubber or the like. The O-ring 105 serves as a sealing means when the ink discharging section 104 is connected to the ink container casing 100.

When ink is consumed, i.e., when the ink container casing 100 and the ink discharging section 104 are connected to each other as shown in FIG. 12, intensity of the capillary power of the connecting portion 103B is increased because the connecting portion member 103B is compressed by the projection 104A. Once the ink container casing 100 and the ink discharging section 104 are connected to each other, the O-ring 105 interposed therebetween serves to maintain them in the sealed state, i.e., in the liquidtight state. At this time, the relationship between the capillary power Ka of the connecting portion 103 and the capillary power Kb of the main body 103A is set so as to satisfies the following inequality.

$$Ka \text{ (at the time of connection)} \geqq Kb$$

The volume of the connecting portion absorbing member 103B can be reduced to 50% based on the volume of the same prior to the receipt of the connecting portion 103B in the cylindrical member 100C by adjusting length of the projection 104A and a fitting stroke of the same into the cylindrical portion 103B. In practice, a part of the main body 103A located adjacent to the connecting portion absorbing member 103B is subjected to compression when the ink container casing 100 and the ink discharging section 104 are connected to each other but the foregoing part is limited within a small range without any possibility that the function of the ink jet recording unit is adversely affected thereby. On the contrary, an advantageous effect attainable with the ink jet recording unit is that concentrative collection of the ink in the vicinity of the first opening portion is promoted.

As drops of ink are discharged from the discharging orifices 104D by activating discharging means (not shown), new ink flows from the ink container casing 100 via the ink chamber 104B so that it is fed to the ink. paths 104C, causing the discharging orifices 104D to be substantially filled with the new ink.

During discharging the ink, the atmospheric air flowing through the second opening portion 100D is substituted for a part of the ink retained on the second opening portion 100D side of the main body 103A ahead of a part of the ink retained on the connecting portion 103B side of the same, whereby the ink is smoothly displaced to the zone where higher intensity of the capillary power is present. In view of the foregoing fact, there does not arise a malfunction that the feeding of ink is interrupted in the connecting portion 103B in the course of ink consumption.

When the ink in the absorbing member 103 is consumed to a final drop or when the ink discharging section 104 is disconnected from the ink container casing 100 so as to allow the projection 104A of the ink discharging section 104 to be disconnected from the cylindrical member 100*c* of the ink container casing 100, the projection 104A is released from the press-fitted state, the capillary power of the connecting portion absorbing member 103B is quickly reduced (whereby an inequality represented by Ka (at the time of connection)≧Ka (at the time disconnection) is established). In addition, at this time, the working capillary power is set in such a manner that the relationship between the capillary power Ka of the connecting portion 103B and the capillary power Kb of the main body 103A adjacent to the connecting portion is represented by the following inequality.

Ka (immediately after disconnection)≦Kb

For this reason, an extra quantity of ink remaining in the vicinity of the joint portion between the ink container casing 100 and the ink discharging section 104 is smoothly taken in the connecting portion 103B. In the case that the connecting portion 103B has still an allowance for retaining some quantity of ink therein even after an extra quantity of ink is absorbed in the connecting portion 103B, ink is sucked from a part of the main body 103 located adjacent to the foregoing joint portion so that the sucked ink is retained in the connecting portion 103B. Thus, there do not arise malfunctions that an atmospheric air is taken in the connecting portion 103B, a recording operation is incorrectly achieved due to air bubbles taken in the ink at the time of re-connection of the ink discharging section 104 to the ink container casing 100, and moreover, the feeding of ink is interrupted in the course of ink consumption.

Since the ink jet recording unit is constructed in the above-described manner, a quantity of projecting of the projection 104A on the ink jet recording head 104 can be reduced. This makes it possible to reduce a quantity of relative displacement jet recording head at the time of connection of the ink 104 to the ink container casing 100, whereby a printer having the ink jet recording unit mounted thereon can practically be realized with smaller dimensions.

(Embodiment 4)

Figure 13:
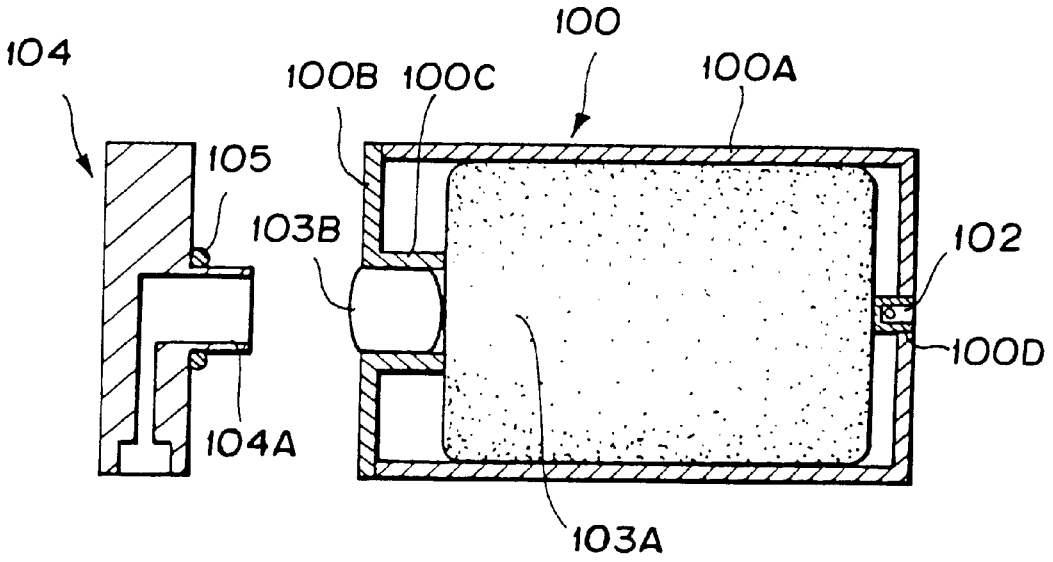
FIG. 13 is a sectional view of an ink jet recording unit constructed according to a fourth embodiment of the present invention, particularly in the disconnected state.

An ink jet recording unit constructed according to a fourth embodiment of the present invention will be described below with reference to FIG. 13.

In this embodiment, an absorbing member 103B' in the connecting section and an absorbing member 103A' in the main body section located adjacent to the connecting section are separated from each other. The relationship between capillary power Ka of the absorbing member 103B' in the connecting section and capillary power Kb in the Absorbing member 103A' in the main body section is represented by the following inequalities in the same manner as in the preceding embodiment.

Ka (at the time of connection)≧Kb

Ka (at the time of connection)≧Ka (immediately after disconnection)

Ka (immediately after disconnection)≦Kb

In addition, the dimensional relation among the absorbing member 103A', the absorbing member 103B' and an ink storage container 100 is determined in such a manner as to establish the foregoing inequality relationship at all time.

Since the absorbing member 103B' in the connecting section and the absorbing member 103A' in the main body are separatively arranged in the above-described manner, they are easily molded of a synthetic resin compared with the case that they are molded integrally with each other, and moreover, a compression ratio to be set to each of them can easily be adjusted. When they are received in the ink container casing 100, the receiving of each of them can easily be effected compared with the case that they are molded integrally with each other. For example, the receiving can be achieved in such a manner that the absorbing member 103A' is first inserted into the parallelpiped main body 100A integrated with the bottom wall, the cover 100B is then welded to the main body 100A, and subsequently, the absorbing member 103B' is inserted into the cylindrical member 100C. Alternatively, both the absorbing members 103A' and 103B' may separatively be molded using different synthetic resins.

(Embodiment 5)

Figure 14:
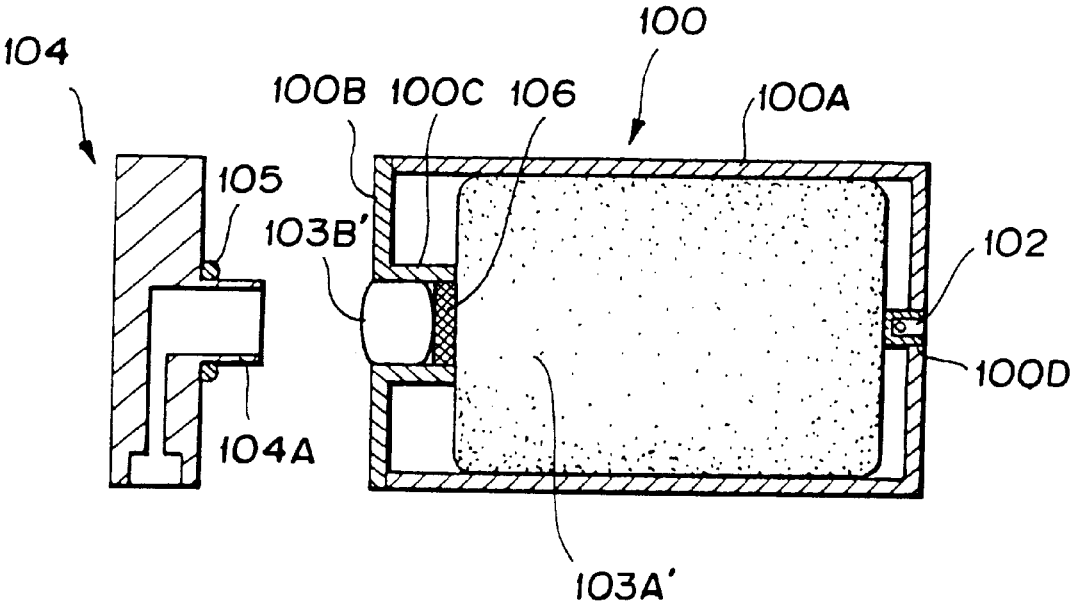
FIG. 14 is a sectional view of an ink jet recording unit constructed according to a fifth embodiment of the present invention, particularly in the disconnected state.

An ink jet recording unit constructed according to a fifth embodiment will be described below with reference to FIG. 14. In this embodiment, an absorbing member 103B' in the connecting section and an absorbing member 103A' in the main body section located adjacent to the connecting section are separated from each other. The relationship between capillary power Ka of the absorbing member 103B' in the connecting section and capillary power Kb in the absorbing member 103A' in the main body section is represented by the same inequalities as those in the preceding embodiment.

In this embodiment, a filter member 106 is disposed between the absorbing member 103A' in the main body section and the absorbing member 103B' in the connection section in such a manner as to separate them from each other with the filter member 106 interposed therebetween. Since the filter member 106 is disposed in that way, there does not arise a malfunction that impurities in the absorbing member 103A' in the main body section invade in the ink discharging unit 104, causing the discharging orifices 104D to be clogged with the impurities, resulting in ink being incorrectly discharged therethrough.

In addition, in this embodiment, in order to concentratively collect ink in the vicinity of the cylindrical portion 100C, it is desirable that the absorbing member 103A' is partially additionally compressed by the end surface of the cylindrical portion 100C such that the compression percentage of the absorbing member 103A' become 60–65% locally which is slightly smaller than the compression percentage 70% of the remaining portion of the absorbing member 103A'. In the case that both the absorbing members 103A' and 103B' are formed of different materials each having different properties, it is recommendable that the absorbing member 103A' comes in close contact with the end surface of the cylindrical portion 100C in such a manner that capillary power at a part located in the vicinity of the first opening portion of the absorbing member 103A' is set to be slightly higher than that at other part.

In this embodiment, the capillary power Kb of the absorbing member 103A' is set such that it is maintained substantially constant across the whole length of the absorbing member 103A'.

Alternatively, the capillary power Kb may gradually be increased toward the first opening portion from the second opening portion. To this end, it is recommendable that the configuration of the absorbing member 103A' before the latter is received in the container casing 100A assumes conical shape so that compression ratio of the absorbing member 103A' in the vicinity of the first opening portion is additionally increased, whereby the displacement of ink to the first opening portion can be achieved more smoothly.

(Embodiment 6)

An ink jet recording unit constructed according to a sixth embodiment of the present invention will be described below with reference to FIGS. 2 and 15.

Figure 2:
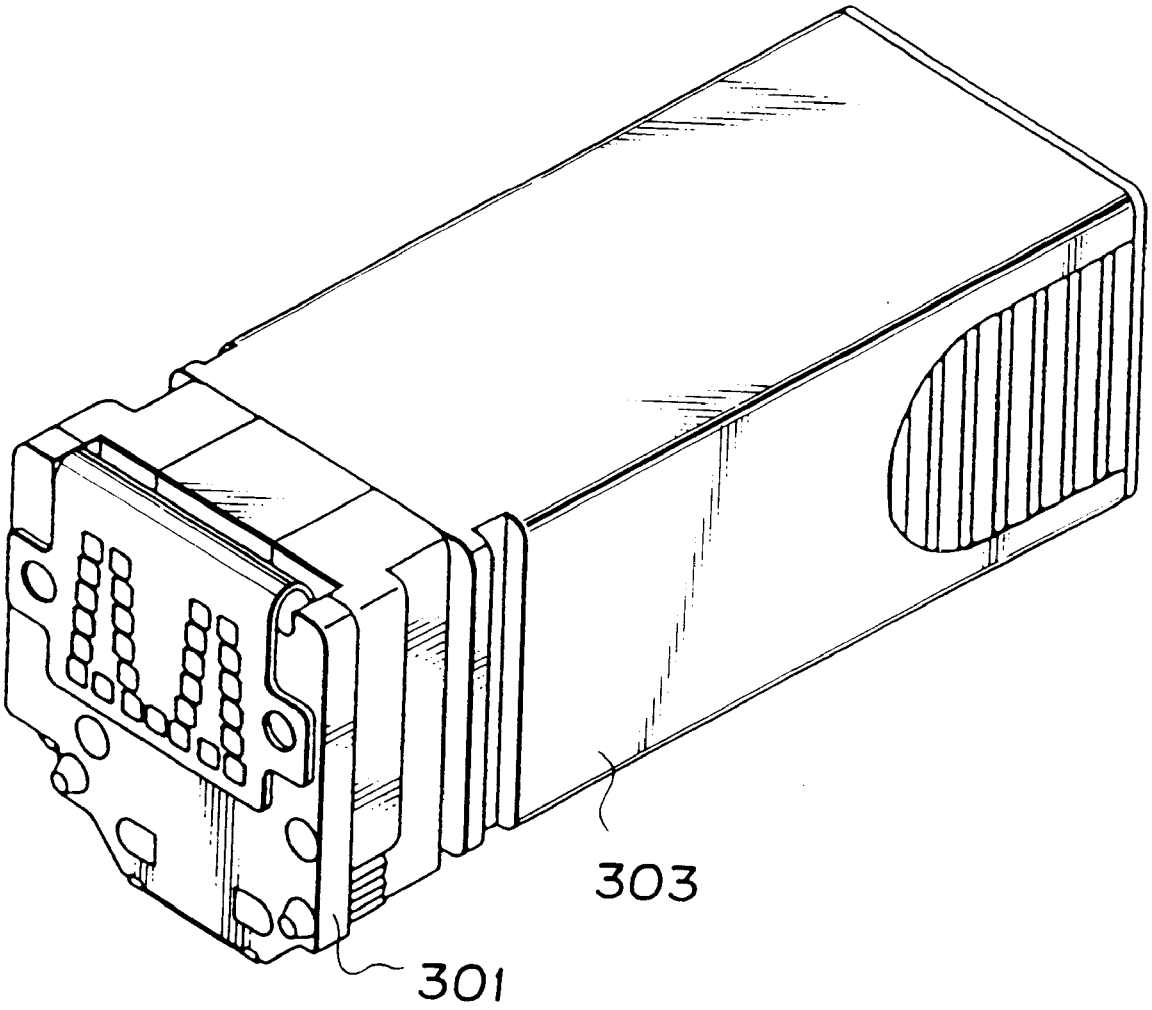
FIG. 2 is a perspective view of an ink jet recording unit which includes an ink jet recording head and an ink tank cartridge both of which can be separated from each other.
Figure 3A:
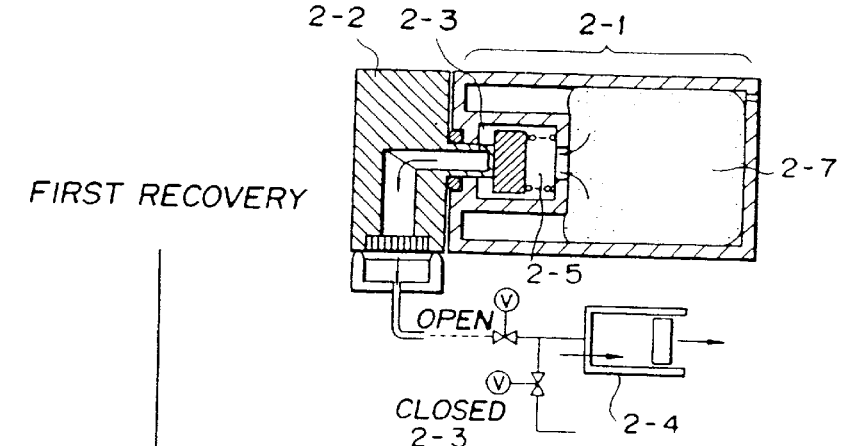
FIG. 3A PRIOR ART
FIGS. 3A–3C illustrates by way of respective sectional views problems inherent to a conventional ink cartridge.
Figure 3B:
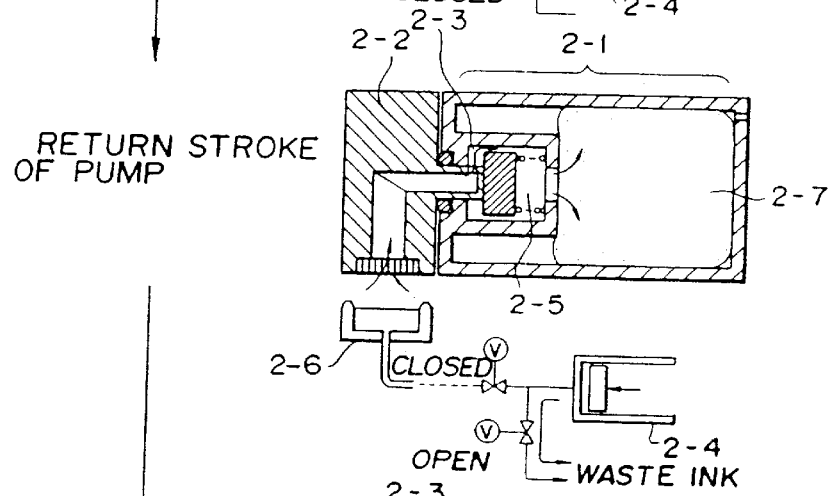
FIG. 3B PRIOR ART
Figure 3C:
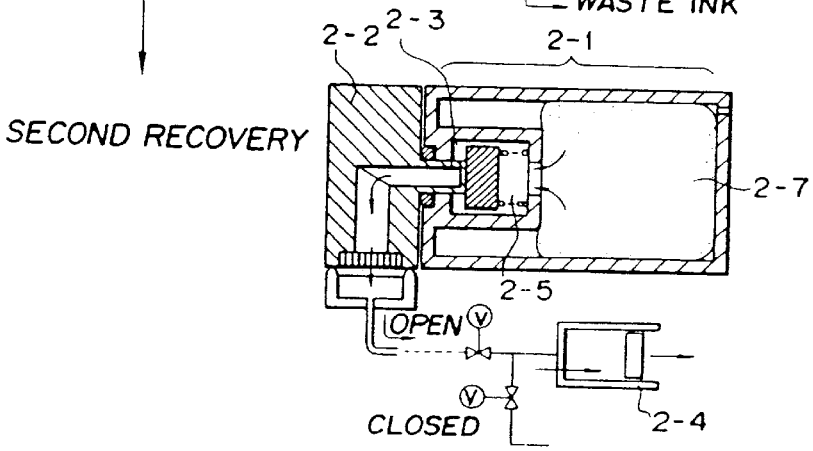
FIG. 3C PRIOR ART
Figures 4A, 4B, 4C:
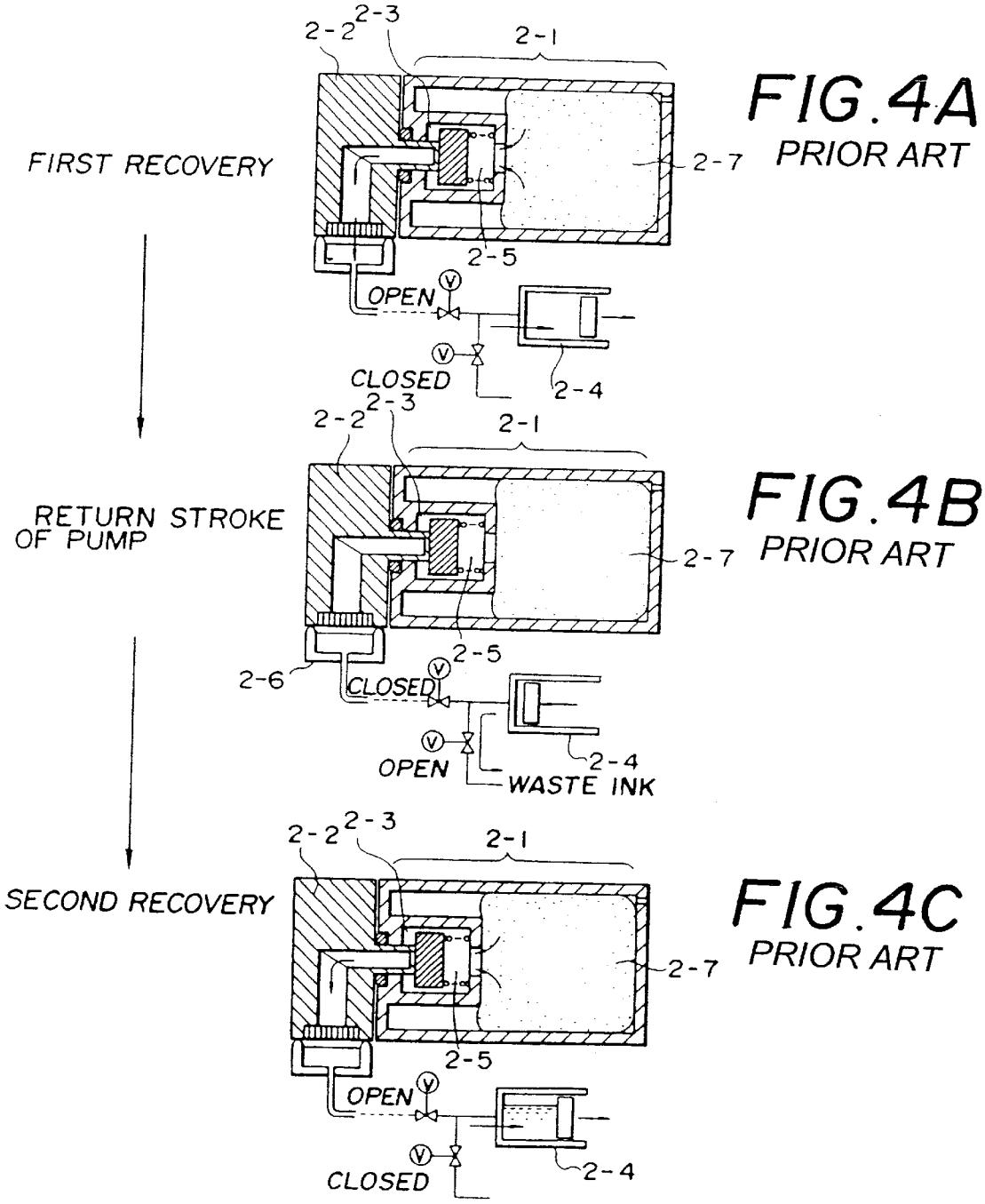
FIG.4A PRIOR ART
FIG.4B PRIOR ART
FIG.4C PRIOR ART
FIGS. 4A–4C also illustrate by way of respective sectional views problems inherent to the conventional ink cartridge.

FIG. 2 is a perspective view of the ink jet recording unit. In the drawing, reference numeral 301 designates an ink jet recording head, and reference numeral 303 designates an ink tank cartridge in which ink is stored so that it is fed to the ink jet recording head 301. The ink jet recording head 301 includes a plurality of electrothermal converting element (not shown) corresponding to each discharging orifice, and each electrothermal converting element serves to generate thermal energy usable as an energy for causing film boiling with ink so as to allow an ink droplet to be discharged from the corresponding discharging orifice.

Figure 15:
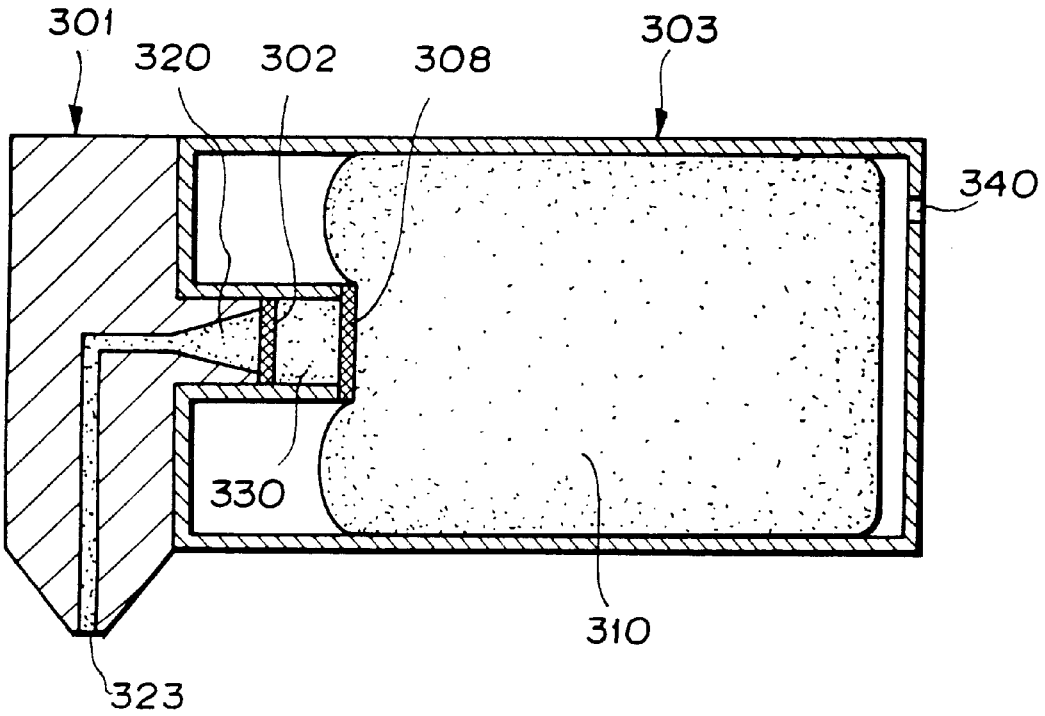
FIG. 15 is a sectional view of an ink jet recording unit constructed according to a sixth embodiment of the present invention.

FIG. 15 is a schematic sectional view of the ink jet recording unit shown in FIG. 2. In the case of the shown embodiment, a first filter 302 is disposed in an ink intake port 320 communicated with a plurality of ink discharging orifices 323 via a common ink chamber. A porous member 310 having ink impregnated therein is received in the ink tank cartridge 303. An ink feed port 330 and an atmosphere communication port 340 are formed through the ink tank cartridge 303. A second filter 308 is secured to the ink feed port 330 while coming in close contact with the porous member 310. When the ink jet recording head 301 and the ink tank cartridge 303 are connected to each other as shown in FIG. 15, the ink intake port 320 is communicated with the ink feed port 330. Both the ink jet recording head 301 and the ink tank cartridge 303 constructed in the above-described manner can be connected to each other and disconnected from each other on a carriage mounted on an ink jet recording apparatus to be described later.

Next, a mode of operation of the ink jet recording unit constructed in the aforementioned manner will be described below.

As the electrothermal converting elements (not shown) in the ink jet recording head 301 are controllably activated, ink is discharged from the ink discharging orifices 323 so as to effect recording on a recording medium. When ink is increasingly consumed in association with repeated recording operations, the ink impregnated in the porous member 310 is gradually displaced toward the ink jet recording head 301 by the function of a capillary phenomenon so as to feed the ink to the ink jet recording head 301, and air enters the ink tank cartridge 303 through the atmosphere communication port 340. While the ink impregnated in the porous member 310 is continuously fed to the ink jet recording head 301, dust or similar foreign material in the porous member 310 is seized by the second filter 308. Thus, any dust does not reach the first filter 302 on the ink jet recording head 301. Although a plurality of ink tank cartridges are repeatedly exchanged one after another in such a manner as to allow one of them to be connected to a single common ink jet recording head 301, there does not arise a malfunction that the first filter 302 is clogged with the dust impregnated in the porous member 310 received in the ink tank cartridge 303. Thus, ink can stably be fed to the ink jet recording head 301 at all times. Since the second filter 308 is secured to the porous member 308 while coming in close contact with it, ink can stably fed to the ink jet recording head 301 regardless of how often a single ink tank cartridge 303 is repeatedly connected to and disconnected from the ink jet recording head 301.

A mesh size a of the first filter 302 and a mesh size b of the second filter 308 are determined to establish an inequality of a>b therebetween. In other words, a screen of the first filter 302 is woven more coarsely than that of the second filter 308. This causes a boundary retaining power on the first filter 302 side to become weaker than that on the second filter 308 side. Consequently, when the ink jet recording head 301 is connected to the ink tank cartridge 303, air is compressed between the first filter 302 and the second filter 308, and subsequently, the compressed air is squeezed in the ink jet recording head 301 side via the first filter 302. Thereafter, the air squeezed in the ink jet recording head 301 side is sucked to the outside from the ink discharging orifices 323 by the function of an ink suction recovering activity to be achieved when the ink jet recording head 301 is connected to the ink tank cartridge 303. Thus, there does not arise a malfunction that ink is incorrectly discharged from the ink discharging orifices 323. As shown in FIG. 15, it is acceptable that the first filter 302 is designed to be smaller than the second filter 308 so that an area of the first filter 302 becomes smaller than that of the second filter 308. If air bubbles enter the ink tank cartridge 303 for some reason, they are not completely exhausted in spite of the aforementioned ink suction recover activity, causing the air bubbles to be displaced to the ink jet recording head 301 side. Thus, there may arise a problem that ink is incorrectly injected from the ink discharging orifices 323. Another possible problem is such that the air bubbles remaining in the ink feed path undesirably grow as they are, causing ink feeding to be obstructed due to the growth of the air bubbles, resulting in incorrect ink injection being likewise effected.

(Embodiment 7)

Figure 16:
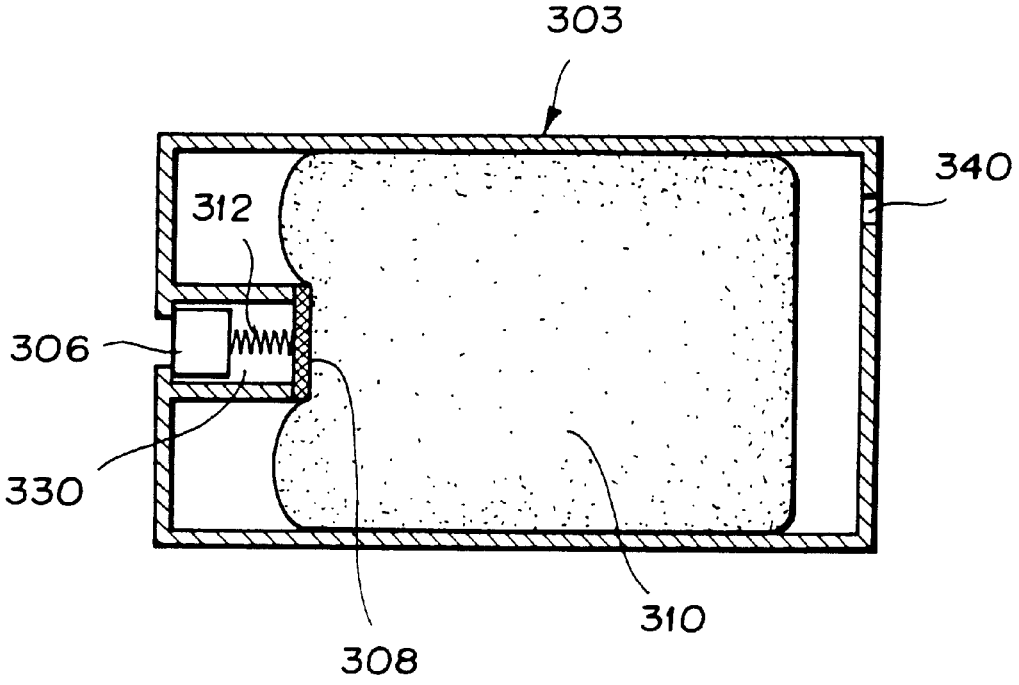
FIG. 16 is a sectional view of an ink tank cartridge for an ink jet recording unit constructed according to a seventh embodiment of the present invention.

An ink tank cartridge constructed according to a seventh embodiment of the present invention will be described below with reference to FIG. 16. Since an ink jet recording head (not shown) is substantially coincident with that in the sixth embodiment in structure, illustration of the ink jet recording head is eliminated in FIG. 16. For this reason, merely an ink tank cartridge 303 is shown in the drawing.

In the case of the shown embodiment, a valve body 306 normally biased by a coil spring 312 is disposed in the ink tank cartridge 303 so as to close an ink feed port 330 with the valve body 306 by the resilient force of the coil spring 312. As is apparent from FIG. 16, when the ink jet recording head is disconnected from the ink tank cartridge 303, the ink feed port 330 is closed with the valve body 306. On the contrary, when the ink jet recording head is connected to the ink tank cartridge 303, the valve body 306 is displaced in the rightward direction as seen in the drawing against the resilient force of the coil spring 312 until the ink feed port 330 is opened. With this construction, when the ink jet recording head is disconnected from the ink tank cartridge 303, there does not arise a malfunction that ink leaks from the ink feed port 330. Other structure rather than the aforementioned one is same to with that in the sixth embodiment described above with reference to FIG. 15.

(Embodiment 8)

Figure 17:
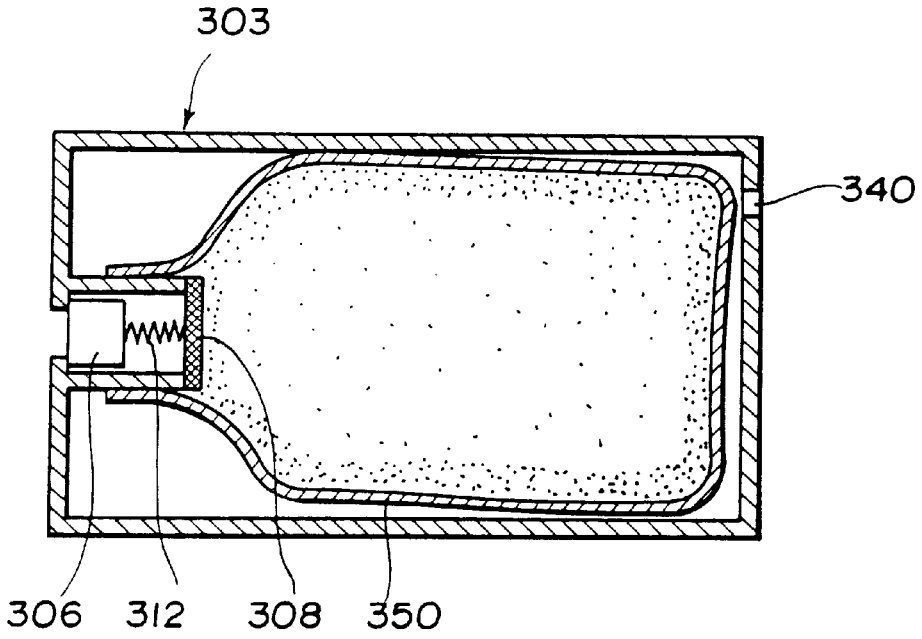
FIG. 17 is a sectional view of an ink tank cartridge for an ink jet recording unit constructed according to an eighth embodiment of the present invention.

An ink tank cartridge constructed according to an eighth embodiment of the present invention will be described below with reference to FIG. 17. Also in this embodiment, since an ink jet recording head is substantially coincident with that in the sixth embodiment in structure, illustration of the ink jet recording head is eliminated in the drawing. For this reason, merely an ink tank cartridge 303 is shown in FIG. 17.

In this embodiment, a flexible bag 350, which replaces porous member 310, having ink stored therein is received in the ink tank cartridge 303 which is entirely coincident with the ink tank cartridge 303 in structure in the seventh embodiment described above with reference to FIG. 16. Other structure rather than the aforementioned one is same to that in the seventh embodiment.

(Embodiment 9)

Figure 18:
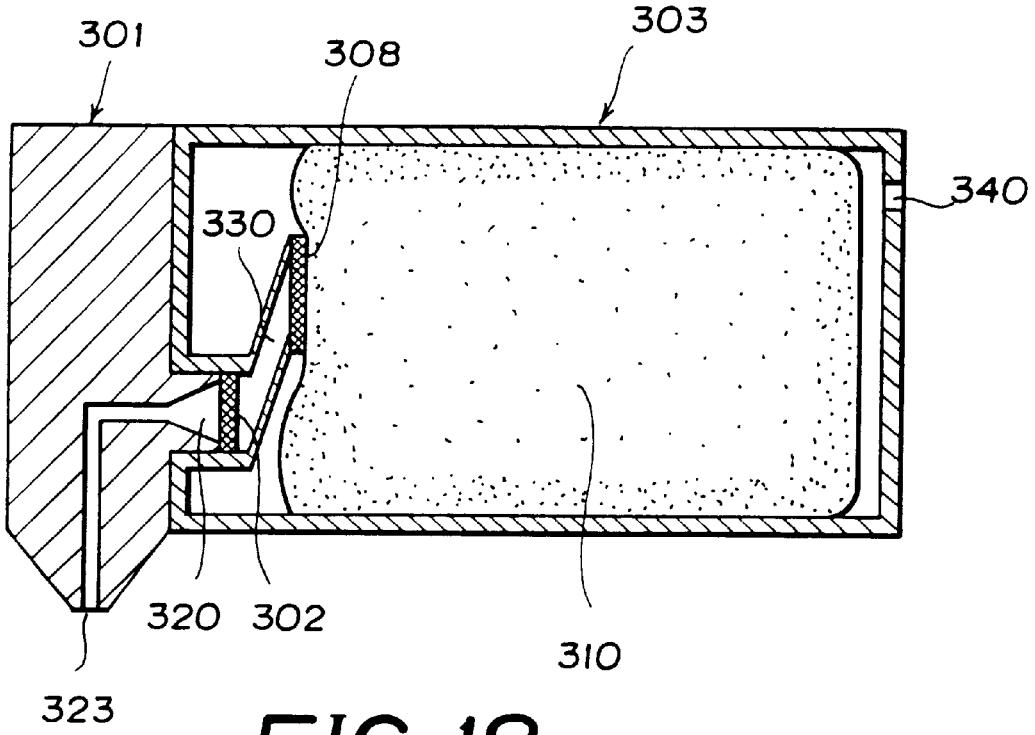
FIG. 18 is a sectional view of an ink jet recording unit constructed according to a ninth embodiment of the present invention.

An ink jet recording unit constructed according to an eighth embodiment of the present invention will be described below with reference to FIG. 18. In the case of this embodiment, a first circular filter 302 is positionally offset from a second filter 308 as viewed in the vertical direction in FIG. 18. Thus, the centers of both the first and second filters 302 and 308 are not located in the concentric relationship relative to each other. Other structure rather than the aforementioned one is same to that in the sixth embodiment.

Next, an ink jet recording apparatus equipped with an ink jet recording unit of the present invention will be described below with reference to FIG. 1, and FIGS. 19 to 21.

An outline of structure of the ink jet recording apparatus IJRA (serving as a printer section) has been described above with reference to FIG. 1.

Structure of an information processing unit (e.g.a personal computer) having the ink jet recording apparatus associated with the ink jet recording unit of the present invention installed therein and electrical circuits thereof will be described below with respect to a typical example thereof.

Figure 19:
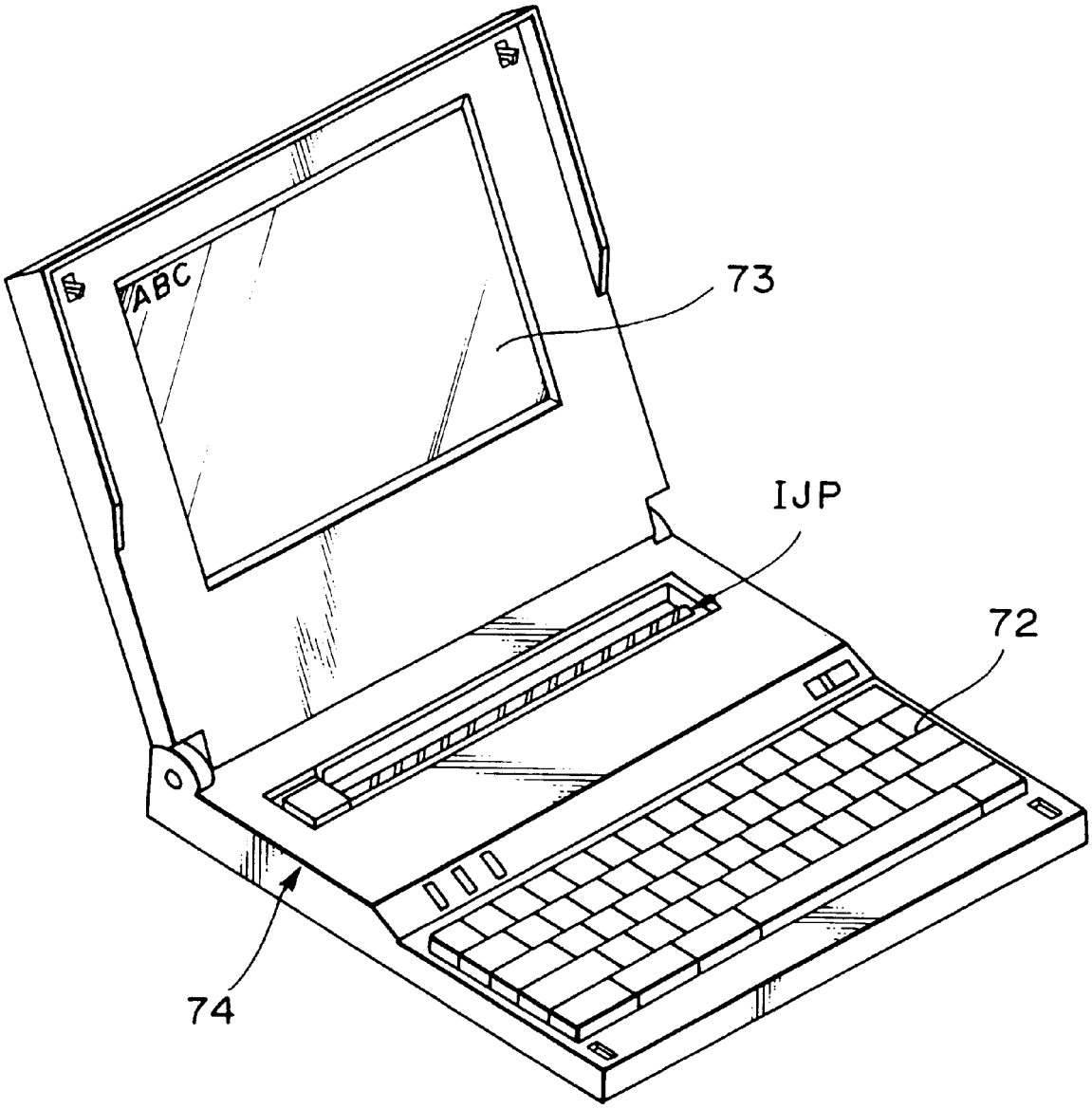
FIG. 19 is a perspective view of an information processing unit in which the ink jet recording apparatus of FIG. 1 is installed.

FIG. 19 shows by way of perspective view an outline of appearance of an information processing unit 74 having the ink jet recording apparatus (to serve as a printer section) installed therein. In the drawing, reference character IJP designates a printer section, reference numeral 72 designates a key board including not only keys for inputting characters, numerals or the like thereinto but also keys for outputting various kinds of commands therefrom, and reference numeral 73 designates a display section including a display board.

Figure 20:
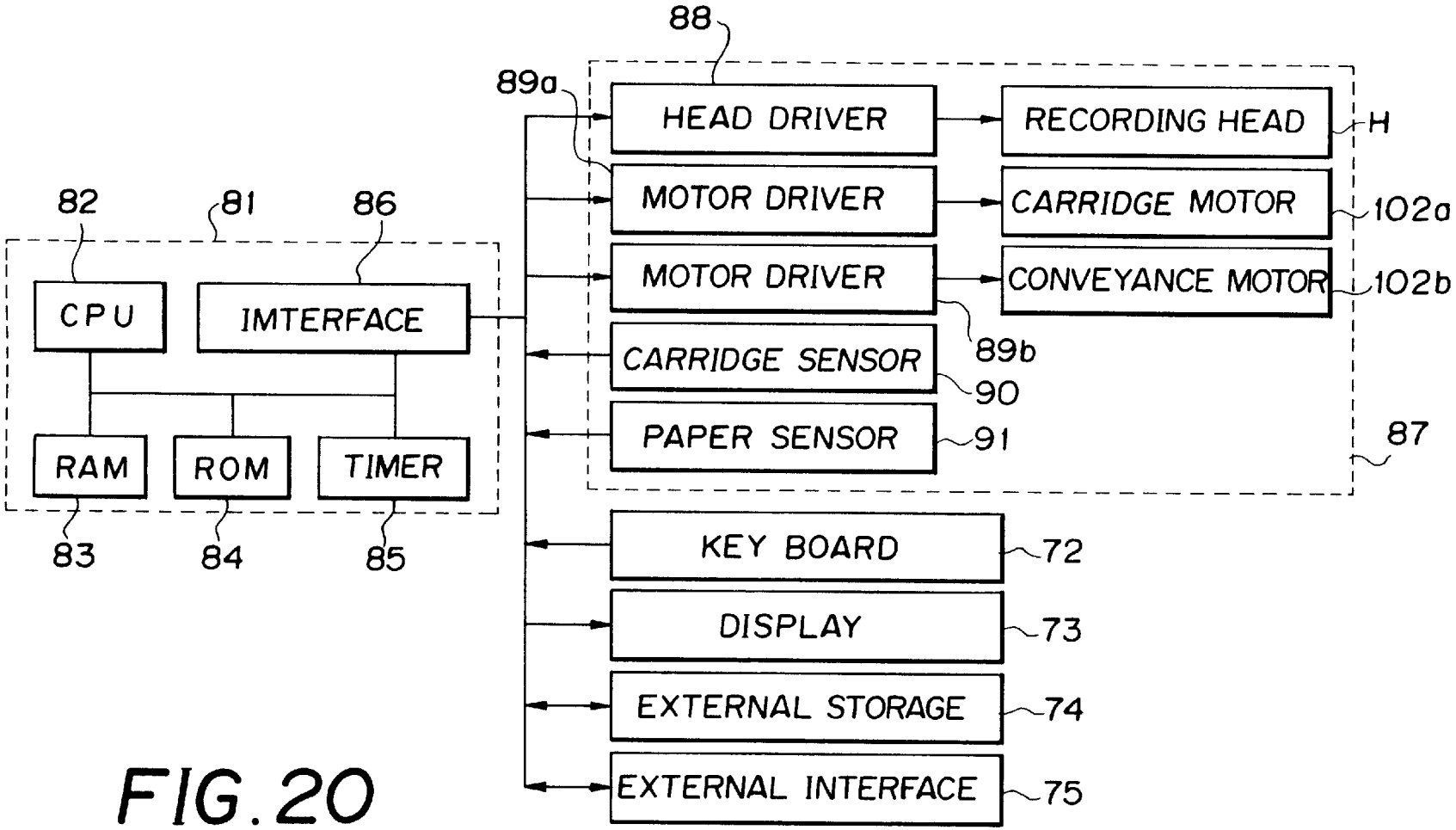
FIG. 20 is a block diagram which illustrates the structure of a circuit network for the information processing unit shown in FIG. 19.

FIG. 20 is a block diagram which shows the structure of electrical circuits arranged in the information processing unit 74.

In the drawing, reference numeral 81 designates a controller for executing main control, reference numeral 82 designates a central processing unit designed in the form of a microcomputer, reference numeral 83 designates a random access memory including a working area for developing text data and image data, reference numeral 84 designates a read only memory having a working program and fixed data such as font data or the like stored therein, reference numeral 85 designates a timer for governing an execute cycle for the central processing unit 82 and a timing relationship required when a recording operation is performed by the printer section IJP, and reference numeral 86 designates an interface portion by way of which signals transmitted from the central processing unit 82 are outputted into peripheral equipment.

In addition, reference numeral 87 designates a controller for the printer section IJP, reference numeral 88 designates a head driver for delivering recording signals and electricity to an ink jet recording head H mounted on an ink jet recording unit, reference numerals 89*a* and 89*b* designate motor drivers for delivering signals and electricity required for driving a carriage motor 102*a* and a conveyance motor 102*b*, reference numeral 90 designates a carriage sensor for detecting the position of a carriage HC to determine whether the carriage HC is located at a home position or not, and reference numeral 91 designates a paper sensor for detecting the presence-or the absence of a recording medium P so as not to allow any recording to be effected in the region other than a recording medium P (paper) when the recording medium P is not inserted into the printer section IJP or a recording operation is completed to reach the terminal end of the recording medium P.

Additionally, reference numeral 74 designates an external storage unit such as a floppy disc drive, a hard disc drive, a random access memory card or the like, and a reference numeral 75 designates an external interface portion for making communication with another information processing unit or controlling peripheral equipments while making connection directly to buses disposed inside of each peripheral equipment.

Figure 21:
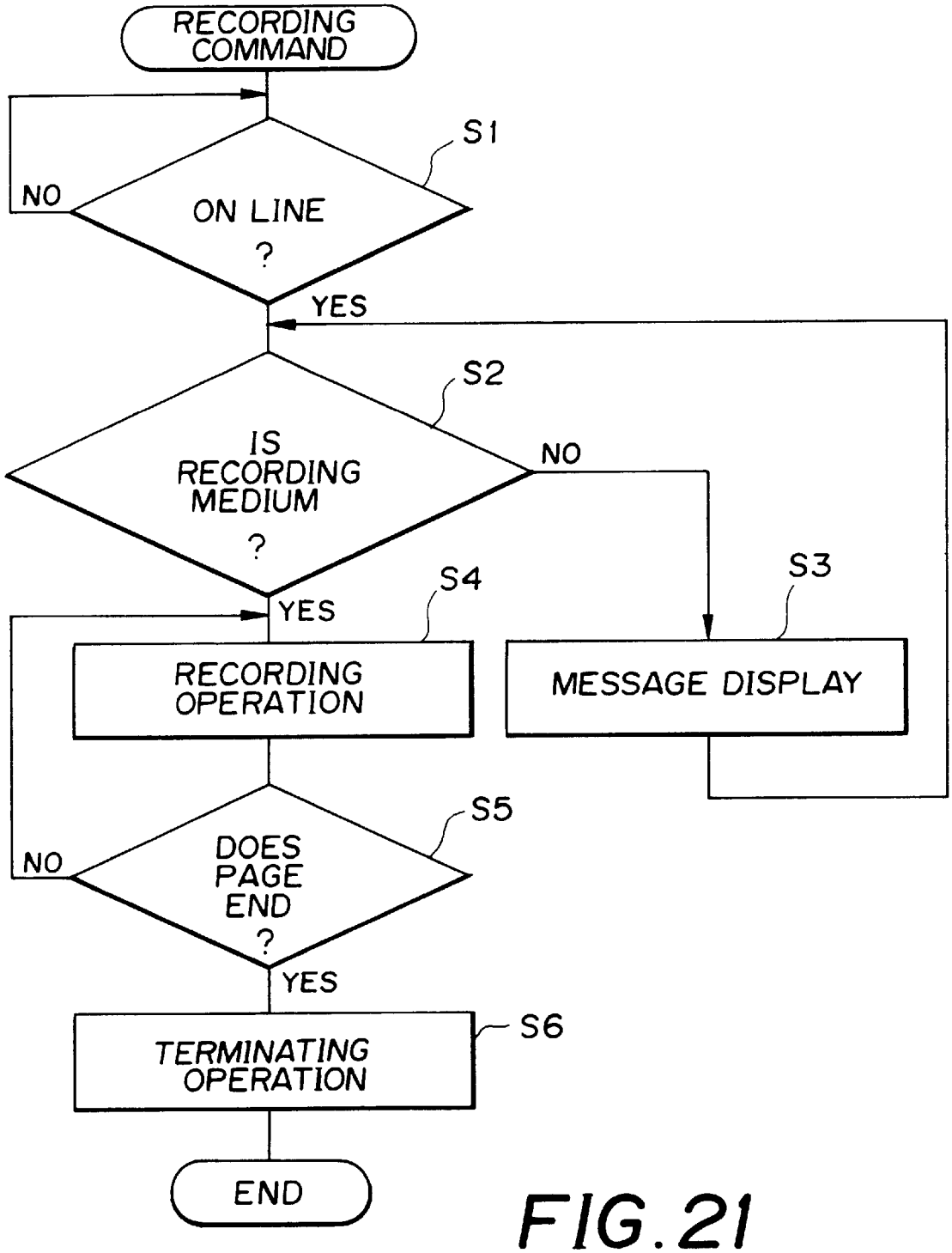
FIG. 21 is a flowchart which illustrates a control sequence for a recording operation to be performed by the information processing unit shown in FIG. 19.

Next, a control sequence for a recording operation to be performed by the printer section IJP will be described below based on a flowchart shown in FIG. 21.

First, in response to an instruction outputted from a display actuating portion in the printer section IJP by actuating a recording command key on the key board 72 for starting a recording operation or in response to an instruction transmitted from the outside via the external interface portion 75 for staring a recording operation, a series of operations as noted below are sequentially performed.

The program starts from Step S1 in which the controller 81 determines whether the display actuating section is turned on or not. Mainly, in response to an instruction transmitted from the outside for starting a recording operation via a communication system, the controller 81 executes the processing so as not to allow a recording operation to be started while the printer section IJP is not ready to perform the printing operation. When the controller 81 determines that the display actuating section is turned on, the program goes to Step S2.

In Step S2, in response to a signal outputted from the paper sensor 91, the controller 81 determines whether a recording medium P is inserted into the printer section IJP or not. The determination to be made by the controller 81 in Step S2 is intended to prevent an occurrence of malfunction that the printer section IJP such as an ink jet recording unit or the like is contaminated with scattered ink when the printing operation is started without any recording medium inserted into the printing section IJP or ink serving as a recording agent is uselessly consumed.

Alternatively, the controller 87 may determine in Step S2 not only whether the printing medium P is present or absent but also whether each pinch roller and each conveying roller are held in the released state or not. This determination to be made in Step S2 is intended to prevent an occurrence of malfunction that the recording medium P is incorrectly conveyed when each pinch roller is held in the released state even though the recording medium P is inserted into the printer section IJP. The controller 87 can determined with the aid of, e.g., a mechanical switch disposed on a release lever whether each pinch roller is held in the released state or not. In the case that the controller 87 determines that the recording medium P is not correctly inserted into the printer section IJP, the program goes to Step S3.

In Step S3, the controller 87 issues a message or an instruction to an operator that he should pay more attention to the printing section IJP so as to allow the recording medium P to be correctly inserted into the printing section IJP. A message or an instruction may be given to him by turning on the display actuating section so as to activate a lighting device to generate a light beam with a lamp or activate a buzzer to generate sound therewith. When the controller 87 determines in Step S3 that the recording medium P is correctly inserted into the printer section IJP, the program goes to Step S4.

In Step S4, a recording operation is started with the printer section IJP. In response to an instruction outputted from the central processing unit 82, the head driver 88 is activated to drive the printer section IJP. At the same time, the motor drivers 89*a* and 89*b* drive the carriage motor 102*a* and the conveying motor 102*b* so as to perform a printing operation with the printer section IJP by displacing the carriage HC in the main scanning direction, displacing the recording medium P in the auxiliary scanning direction and cleaning the recording head H.

Subsequently, the program goes to Step S5 in which in response to a signal outputted from the central processing unit 82, the controller 87 instructs that the recording operation is completed. When the controller 87 determines that the number of recorded lines as measured in the space of a single page in the auxiliary direction reaches a predetermined value or when the paper sensor 91 detects that the recording operation is completed in the recording range on the recording medium P, the controller 87 determines that the recording operation is completed with the recording medium P.

After the recording operation is completed in Step S6, the controller 87 activates the carriage HC so as to return it to the home position. This is intended to cap the recording head H with a suitable capping member so as to protect the ink discharging surface of the recording head H from damage or injury before the supply source is turned off on completion of the recording operation.

Thereafter, the recording medium P is discharged from the printer section IJP by driving the conveyance motor 102*b* until it is confirmed that the conveyance motor 102*b* is driven by a predetermined number of revolutions or until the paper sensor 91 detects that the recording medium P is discharged from the printer section IJP. On completion of the recording operation, the controller 81 instructs the central processing unit 82 so as to allow the latter to activate the display actuating section or output an instruction to the peripheral equipments via the external interface portion 75, whereby the recording operation is completed.

In this embodiment, an ink jet recording head and an ink tank cartridge can be connected to each other and disconnected from each other. Since the printer section IJP is constructed such that a connecting operation or a disconnecting operation can be achieved while an assembly of the recording head and the ink tank cartridge is mounted on the carriage HC or dismounted from the same, advantageous effects as noted below can be obtained.

Specifically, since the ink tank cartridge is mounted on the carriage HC, there does not arise a necessity for extending or arrange a tube for the purpose of feeding ink to the ink jet recording head, resulting in the recording section IJP being constructed with small dimensions. When there arises an occasion that no ink is available for a printing operation, it is not required that the whole assembly of the ink jet recording head and the ink tank cartridge is exchanged with a new one but merely the ink tank cartridge is to be exchanged with a new one with the result that the printer section IJP can be operated at a reduced running cost. In the case that the exchanging of one of the ink jet recording head and the ink tank cartridge with a new one is required, it suffices that one of the ink jet recording head and the ink tank cartridge is exchanged with a new one, resulting in an economical efficiency of the printer section IJP being improved.

In the case that the ink jet recording head and the ink tank cartridge are disconnected from each other by actuating a lever or the like on the carriage HC, a disconnecting operation can adequately be adjusted for the printer section IJP, and moreover, there does not arise a malfunction that ink is scattered away from the ink intake port or the ink feed port. When the ink jet recording head and the ink tank cartridge are separated from each other on the carriage HC, since there is no need of holding the ink jet recording head directly with an operator's hand, there does not arise another malfunction that a quality of each printed matter is adversely affected with the scattered ink or the printed matter is contaminated with the scattered ink.

In the case that the ink jet recording head and the ink tank cartridge are unavoidably disconnected from each other on the carriage HC, since the position where a certain intensity of force is applied to the ink tank cartridge is specifically determined on the ink tank cartridge, it is required that merely a part of the ink tank cartridge corresponding to the foregoing position is designed to have a large thickness enough to stand against the applied force and the other part of the ink tank cartridge is designed to have small thickness. Thus, the ink tank cartridge can be constructed with a reduced weight but with an increased interior volume thereof. In the case that it is necessary that the present ink color is exchanged with another one, since an assembly of the ink jet recording head and the ink tank cartridge integrated with each other can be exchanged with another one as it is, an exchanging operation can easily be achieved at a high efficiency.

(Embodiment 10)

Figure 22:
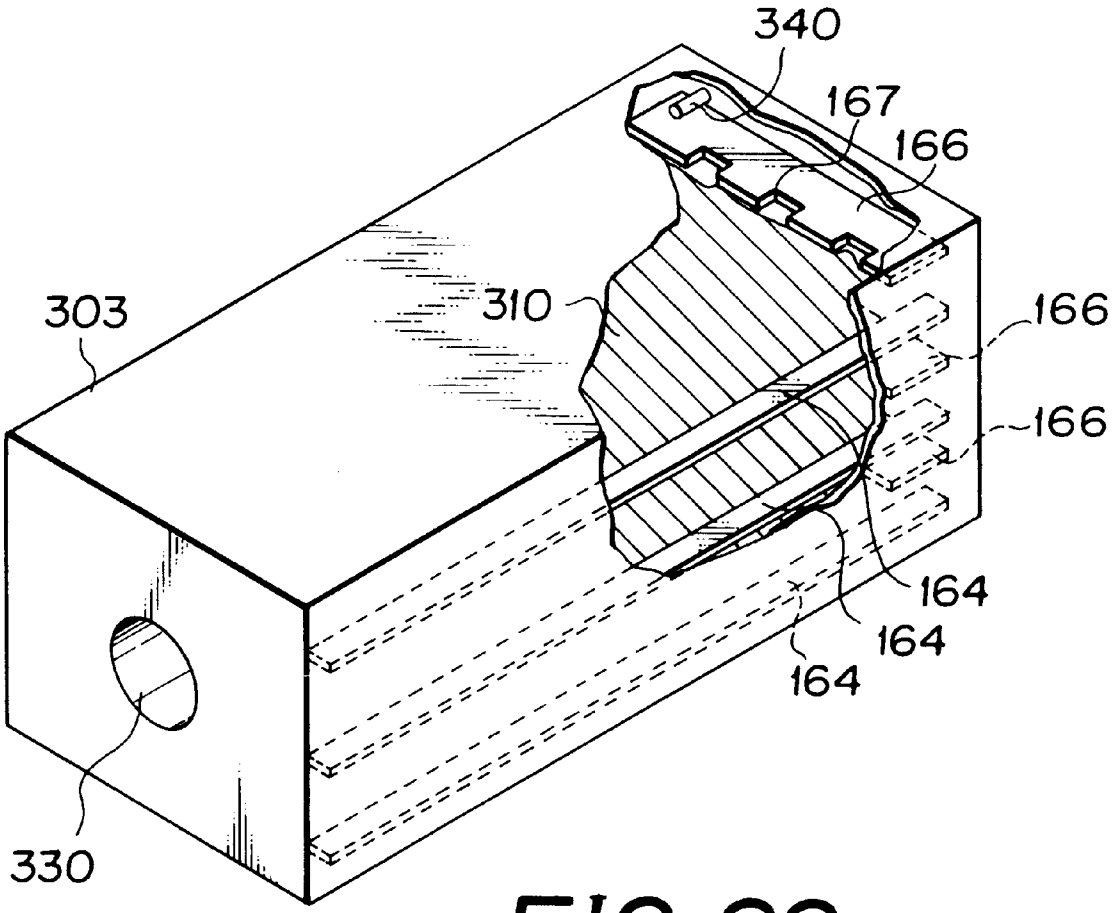
FIG. 22 is a partially exploded perspective view of an ink tank cartridge constructed according to a tenth embodiment of the present invention.

An ink tank cartridge for an ink jet recording unit constructed according to a tenth embodiment of the present invention will be described below with reference to FIG. 22 that is a partially exploded perspective view thereof.

An ink jet recording head (not shown) including an energy generating portion operable for producing droplets of recording ink can be connected to and disconnected from an ink tank cartridge 303 in which ink is stored, and a porous member 310 molded of a foamed polyurethane or the like is press-fitted into the ink tank cartridge 303. The porous member 310 represented by hatched lines in the drawing is brought in close contact with a plurality of side ribs 164 arranged along the opposite side walls of the ink tank cartridge 303. In FIG. 22, reference numeral 340 designates an atmospheric air intake port. The air intake port 340 is communicated with air path (not shown) which extends in the ink tank cartridge 303 in a complicated manner. In practice, the air path is constructed such that ink does not flow outside of the ink tank cartridge 303 through the air intake port 340 even when the ink contained in the porous member 310 leaks from the latter due to some abnormality caused with the ink tank cartridge 303. Reference numeral 166 designates a plurality of rear ribs. The rear ribs 166 are arranged at the rear end part of the ink tank cartridge 303. Similarly, the porous member 310 is brought in close contact with the rear ribs 166. To assure that the air taken through the air intake port 340 is fully distributed over the whole surface of the porous member 310 at the rear end part of the latter, a plurality of cutouts 167 are formed along each rear rib 166. The space formed by the rear ribs 166 serves as a buffer chamber for storing outflow ink therein when the ink contained in the porous member 310 flows outside of the porous member 310 due to some abnormality. In this embodiment, the side ribs 164 and the rear ribs 166 are alternately arranged in the ink tank cartridge 303. The side ribs 164 extend from the position for allowing the air introduced through the air intake port 340 to be sufficiently taken in the ink tank cartridge 303 till the plane positionally coincident with an ink outflow port 330 through which the ink contained in the porous member 310 is fed to the ink jet recording head. With this construction, the air introduced through the air intake port 340 flows not only in the space defined between the rear inner wall surface of the ink tank cartridge 303 and the porous material 310 in the presence of the rear ribs 166 but also in the space defined between the side inner wall surfaces of the ink tank cartridge 303 and the porous material 310 in the presence of the side ribs 164, whereby the air is completely distributed over the porous material 310 on the air intake port 340 side as well as on the opposite side wall sides. The width and the height of each side ribs 164 as well as the pitch for arranging the side ribs 164 one above another are determined in such a manner as to allow the inflow air to be sufficiently distributed over the side surface of the porous member 310. It is recommendable that each rib exhibits one of sectional shapes as shown in FIG. 28A to 28I. Since the ink tank cartridge 303 is constructed in the above-described manner, the ink in the porous member 310 can easily be exchanged with the inflow air, causing a quantity of ink remaining in the ink tank cartridge 303 to be substantially reduced. In other words, the ink contained in the porous member 310 can be used at a high efficiency.

The results derived from measurement conducted on a quantity of ink remaining in the ink tank cartridge which varied depending on a length of each side rib 164 are shown in Table 1. Each measurement was conducted for each of rates representing a volume assumed by all the ribs in the ink tank cartridge in terms of percentages on the assumption that the ink tank cartridge had a whole length of 40 mm and a length of each side rib was represented by x. As is apparent from table 1, when the length of each side rib was set to 70% or more based on the total length of the ink tank cartridge, a good result of 1 gram or less representing a quantity of ink remaining the ink tank cartridge was obtained.

TABLE 1

| rib length × 40 | quantity of ink initially filled in ink tank cartridge | quantity of ink remaining in ink tank cartridge after usage | negative pressure at full page printing |
|---|---|---|---|
| 50% | 5 g | 1.52 g | 130 to 150 mm aq |
| 60% | 5 g | 1.34 g | 125 to 140 mm aq |
| 70% | 5 g | 0.91 g | 115 to 130 mm aq |
| 80% | 5 g | 0.82 g | 105 to 125 mm ag |
| 90% | 5 g | 0.81 g | 100 to 120 mm aq |
| 100% | 5 g | 0.78 g | 100 to 120 mm aq |

Note: Each ink tank cartridge having a rib length (x/40) lying within the range of 70% to 100% and exhibiting a remaining ink quantity of 1 gram or less was recognized as an acceptable ink tank cartridge.

inner dimensions of ink tank cartridges each employed for measurements: 40×20×20 (mm)

ink absorbing member: foamed polyurethane resin having 85 to 105 voids formed therein per inch sectional shape of side rib: width of 1 mm height of 2 mm as measured from each of the opposite inner side walls of each ink tank cartridge (Embodiment 11)

Figure 23:
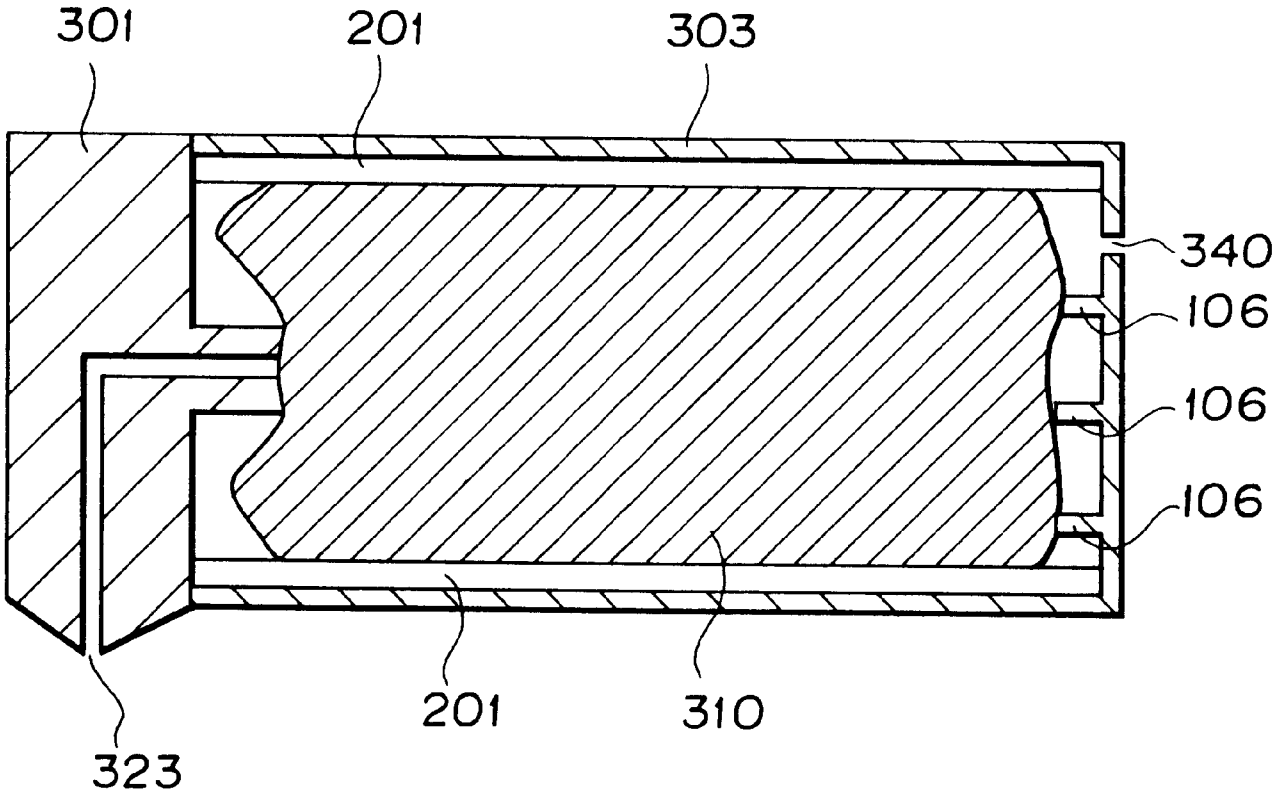
FIG. 23 is a sectional view of an ink jet recording unit constructed according to an eleventh embodiment of the present invention.

An ink jet recording unit constructed according to an eleventh embodiment of the present invention will be described below with reference to FIG. 23 that is a sectional view thereof.

As air is introduced into an ink tank cartridge 303 through an atmospheric-air intake port 340, it is uniformly distributed over the whole rear surface of a porous member 310. The ink tank cartridge 303 includes upper and lower ribs 201 so as to allow the inflow air to be subsequently distributed over the upper and lower surfaces of the porous member 310 with the aid of both the upper and lower ribs 210. In this embodiment, both the upper and lower ribs 210 extend from the position where a sufficient quantity of air is taken in the ink tank cartridge 303 across the porous member 303 to reach an ink jet recording head 301. With this construction, an ink can practically be used at a high efficiency.

(Embodiment 12)

Figure 24:
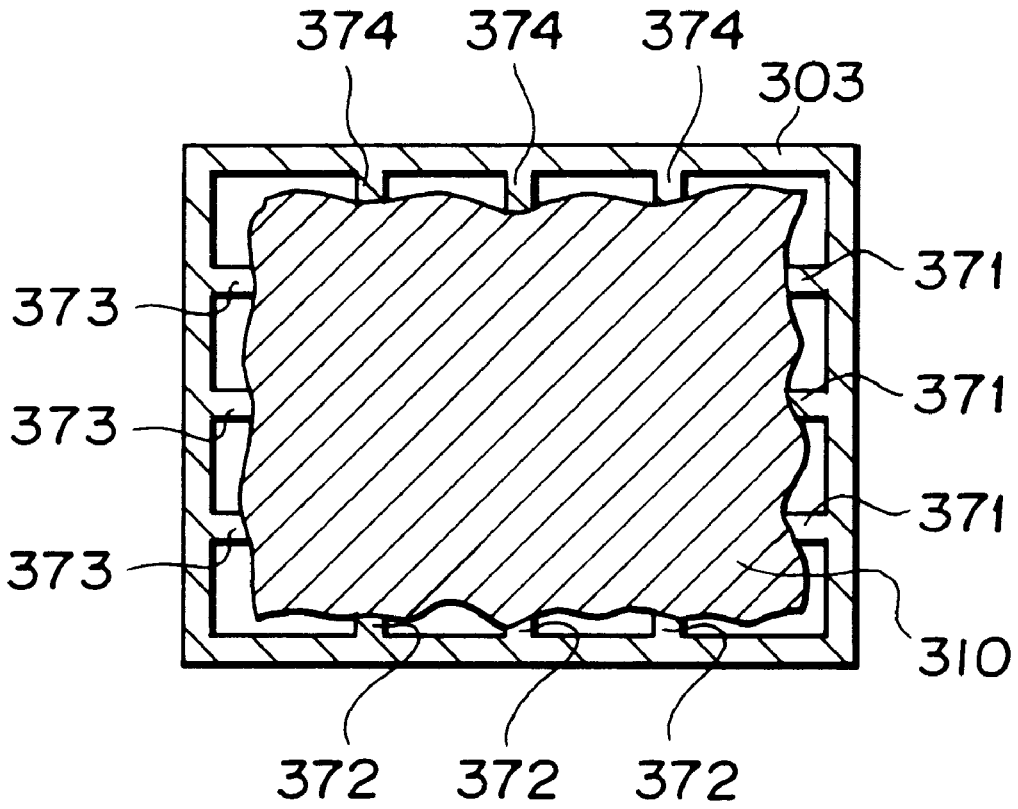
FIG. 24 is a cross-sectional view of an ink tank cartridge for an ink jet recording unit constructed according to a twelfth embodiment of the present invention.

An ink tank cartridge for an ink jet recording unit constructed according to an twelfth embodiment of the preset invention will be described below with reference to FIG. 24.

An atmospheric air intake port (not shown) and an ink outlet port (not shown) are formed through the opposite surfaces of the parallelepiped-shaped ink tank cartridge 303. FIG. 24 is a cross-sectional view of the ink tank cartridge 303 taken along a plane in parallel with the front end surface having the ink outlet port formed thereon. In this embodiment, the ink tank cartridge 303 includes a plurality of longitudinally extending ribs 371, 372, 373 and 374 on the right-hand side wall, the lower wall, the left-hand side wall and the upper wall thereof, respectively. With this construction, as the atmospheric air introduced through the air intake port flows in the space formed by the rear ribs (not shown) between the rear wall of the ink tank cartridge 303 and a porous member 310 and then reaches the front end surface of the ink tank cartridge 303 having the ink outlet port formed thereon through the space defined between the porous member 310 and the ribs 371, 372, 373 and 374 each extending across the porous member 310 in the longitudinal direction. In this embodiment, any particular problem does not arise when the volume of the porous member 310 is slightly reduced because the porous member 310 is held within the ribs 371, 372, 373 and 374 as if it is surrounded by them. In view of the foregoing fact, it is recommendable that the porous member 310 is employed for the ink tank cartridge 303 having a comparatively large volume. The air can easily be substituted for the ink contained in the porous member 310 as the contacting area defined by both the inner wall of the ink tank cartridge 303 and the porous member 310 is reduced more and more resulting in reducing the remaining ink in the porous member 310. Since a plurality of ribs are arranged around the inner wall of the ink tank cartridge 310 in the above-described manner, the air can uniformly be distributed over all the surfaces exclusive of the surface having the ink outlet port formed thereon, resulting in the ink contained in the porous member 303 being utilized at a highly improved efficiency. The width and the height of each of the ribs 371, 372, 373 and 374 may variably be determined in consideration of various working conditions given to the ink tank cartridge 303. For example, in the case as shown in FIG. 24, the ribs 372 formed on the lower wall of the ink tank cartridge 303 are dimensioned to have the height lower than that of the other ribs. This is intended to easily recover by absorbing the leaked ink in the small space between the lower wall of the ink tank cartridge 303 and the porous member 310 when some ink flows outside of the porous member 310 due to some abnormality and it is then stored in the foregoing small space. Alternatively, the respective ribs 371, 372, 373 and 374 may be designed such that the height of each rib is varied, and moreover, each rib is tapered toward the ink outlet port side from the air intake port side with some height difference therebetween in order to change compressibility of the porous member 310 across the length of the ink tank cartridge 303 so as to allow the ink to be concentratively collected in a certain region in the porous member 310.

(Embodiment 13)

Figure 25:
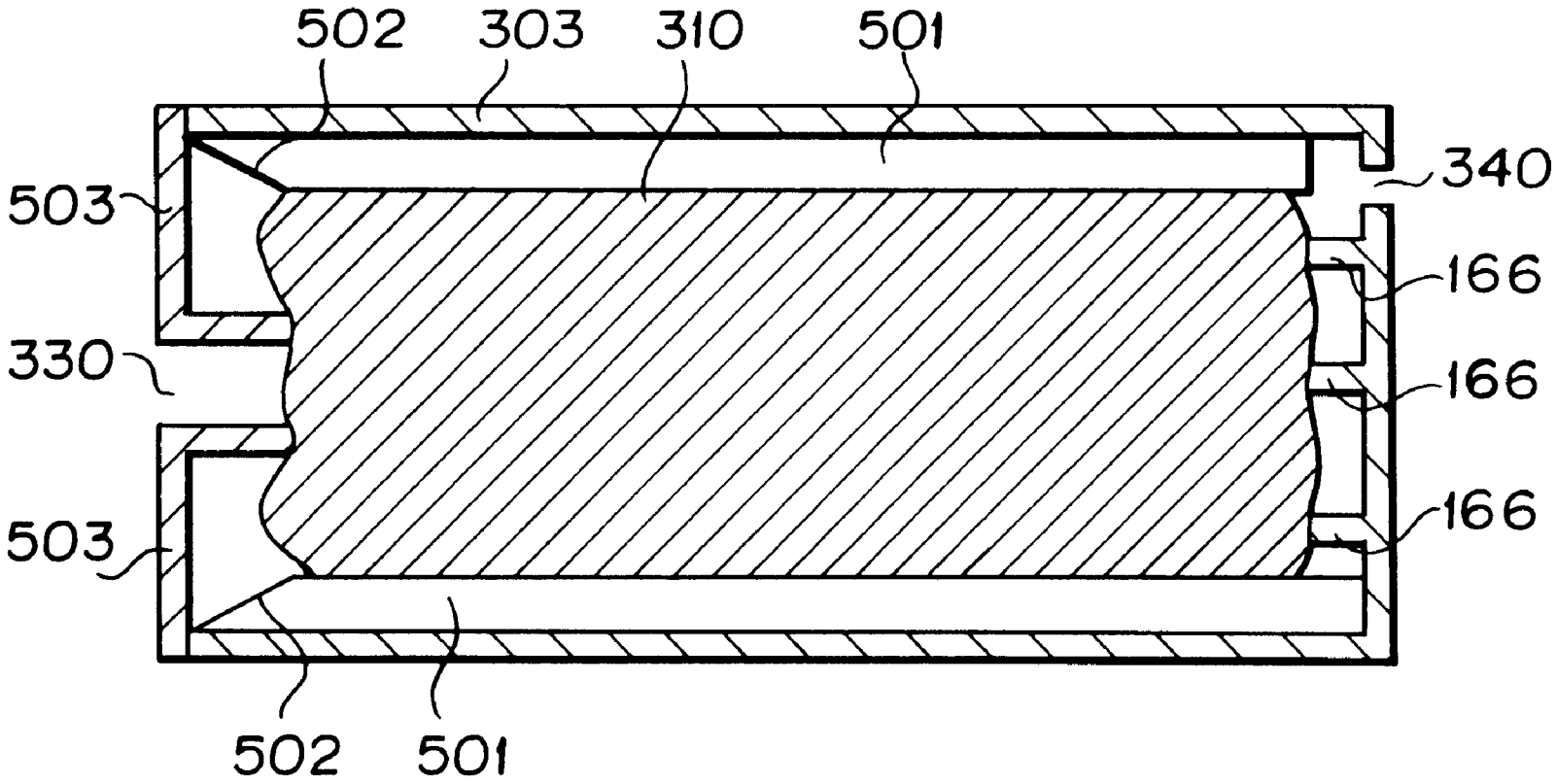
FIG. 25 is a sectional view of an ink tank cartridge for an ink jet recording unit constructed according to a thirteenth embodiment of the present invention.

An ink tank cartridge for an ink jet recording unit constructed according to a thirteenth embodiment of the present invention will be described below with reference to FIG. 25 that is a sectional view thereof.

In the drawing, reference numeral 501 designates a rib. The rib 501 may be formed either along the upper wall of the ink tank cartridge 303 or along the lower wall of the same in the longitudinal direction. A characterizing feature of this embodiment consists in that one end of the rib 501, i.e., the left-hand end of the rib 501 in the shown case is tapered as represented by reference numeral 502. Since the rib 51 has a tapered portion 502 in that way, when a porous member 310 is inserted into the ink tank cartridge 303 and then sealably closed with a cover 503 on the ink outlet port side in the course of production of the ink tank cartridge, the inserting operation can smoothly be achieved in the presence of the tapered portion 502 without an occurrence of malfunction that the porous member 310 is damaged or injured by a sharp edge of the rib 501. It is not always necessary that all of the tapered portion 502 projects to the ink outlet port side, i.e., the cover 503. Alternatively, the tapered portion 502 may extend within the range defined by the length of the porous member 310, provided that the air introduced through the atmospheric air intake port can be distributed over the whole surface of the porous material 310 without any problem in respect of an ink utilization efficiency.

(Embodiment 14)

Figure 26:
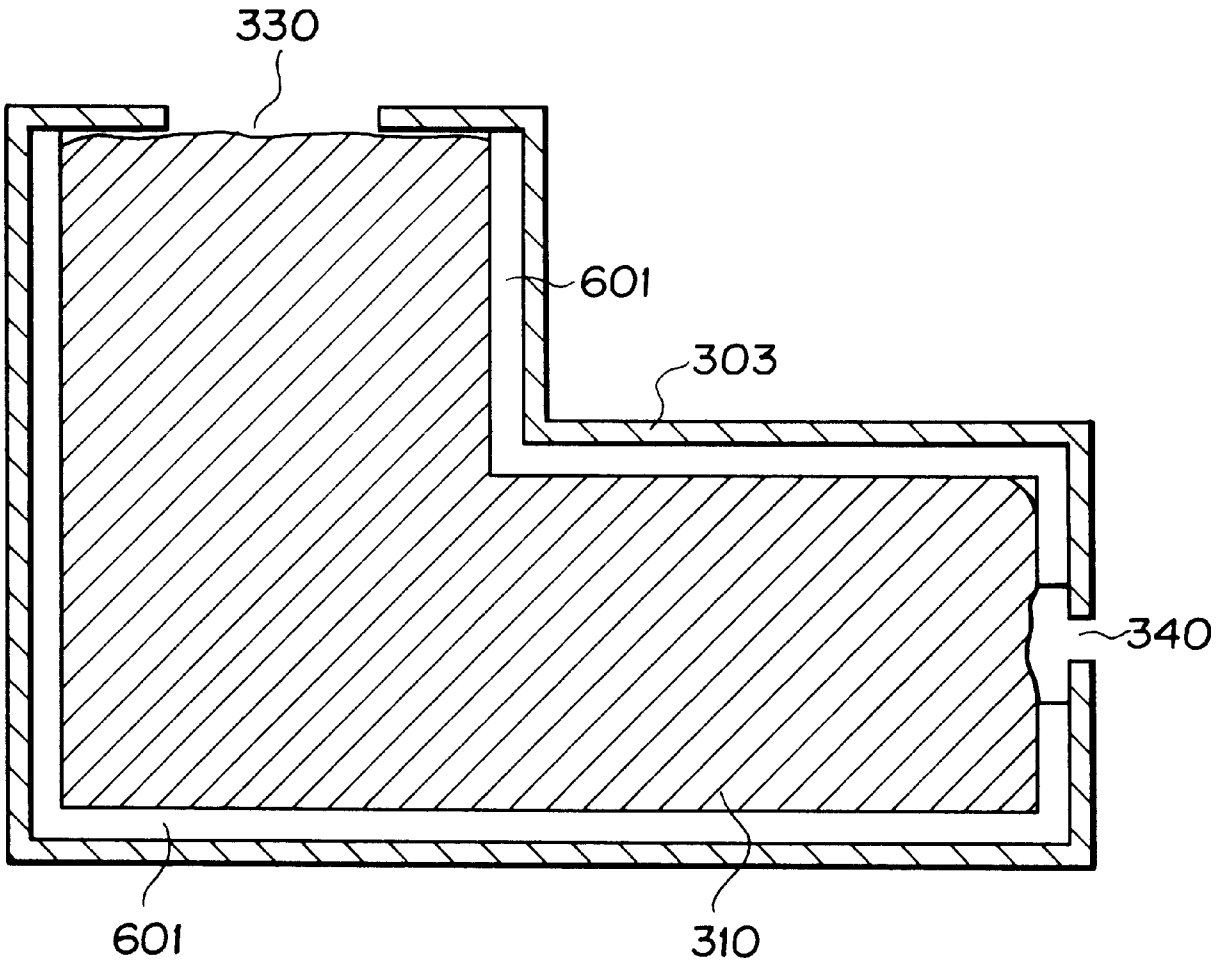
FIG. 26 is a sectional view of an ink tank cartridge for an ink jet recording unit constructed according to a fourteenth embodiment of the present invention.

An ink tank cartridge for an ink jet recording unit constructed according to a fourteenth embodiment of the present invention will be described below with reference to FIG. 26 that is a sectional view thereof.

The ink tank cartridge 303 includes an atmospheric air intake port 340 and an ink outlet port 330 both of which are not located in alignment with each other as seen in the longitudinal direction. In this embodiment, in view of the foregoing fact, a plurality of ribs 601 are arranged between the ink tank cartridge 303 and a porous member 310 not only along the opposite side walls of the ink tank cartridge 303 but also along the upper and lower surface of the same so that the air introduced through the air intake port 340 is uniformly distributed over the whole surface of the porous member 310 without any possibility that an ink utilization rate of the ink tank cartridge is degraded.

(Embodiment 15)

An ink tank cartridge for an ink jet recording unit constructed according to a fifteenth embodiment of the present invention will be described below with reference to FIG. 27A and FIG. 27B.

Figure 27A:
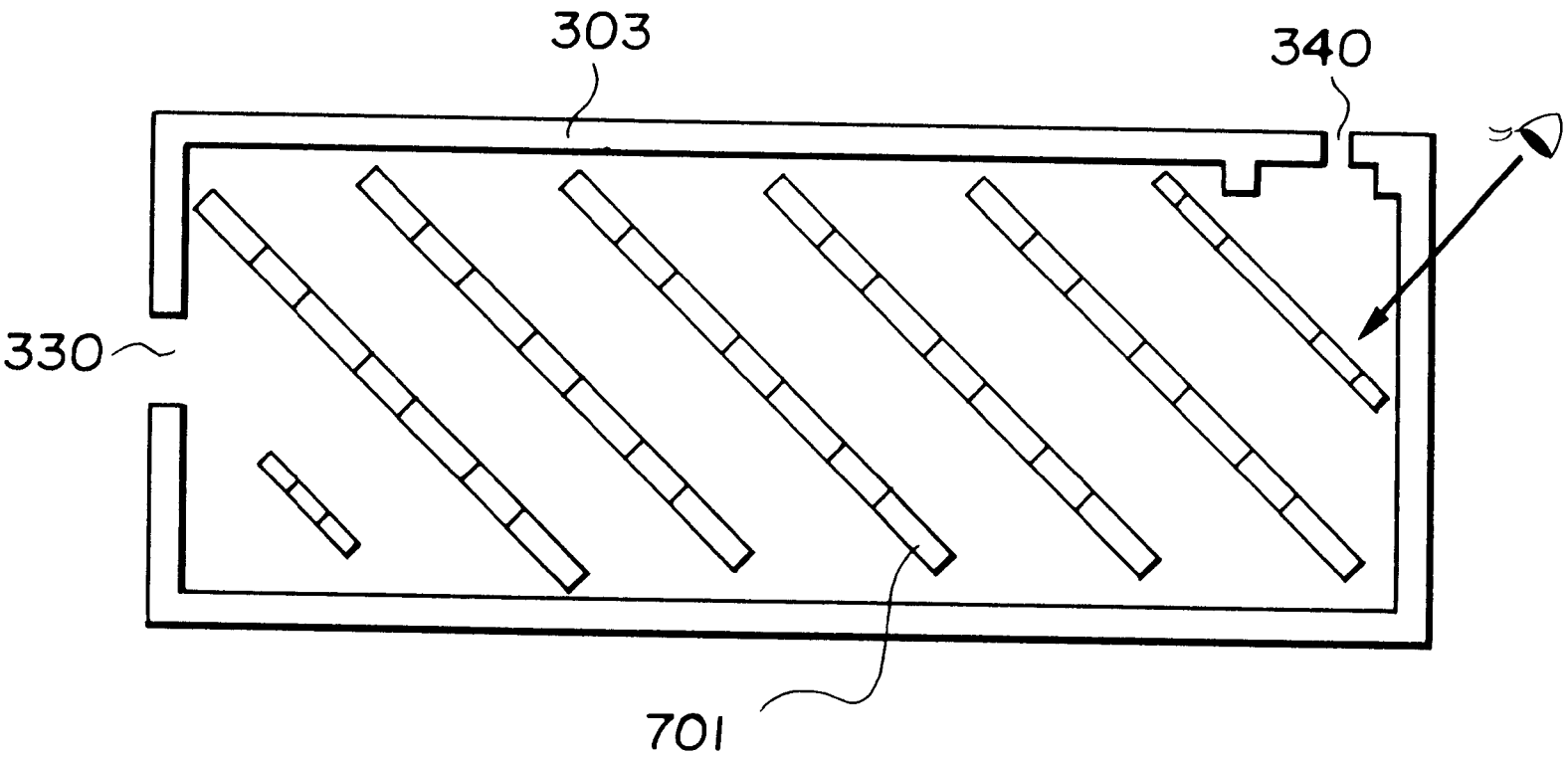
FIG. 27A is a sectional view of an ink tank cartridge for an ink jet recording unit constructed according to a fifteenth embodiment of the present invention.
Figure 27B:
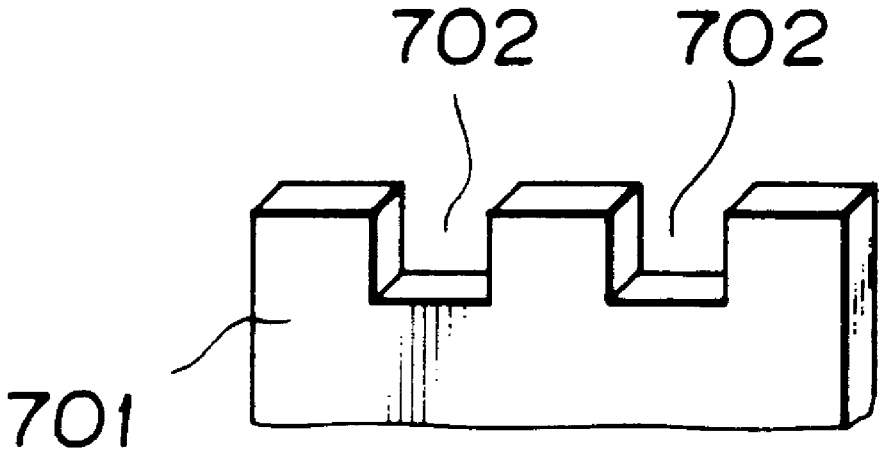
FIG. 27B is a fragmentary perspective view of the ink tank cartridge shown in FIG. 27A.
Figure 28A:
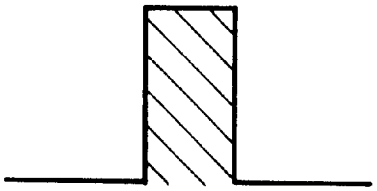
FIGS. 28A to 28I show by way of fragmentary sectional views the contour of each of various kinds of ribs for the ink tank cartridge shown in FIG. 27A.
Figure 28B:
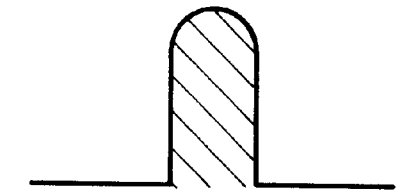
Figure 28C:
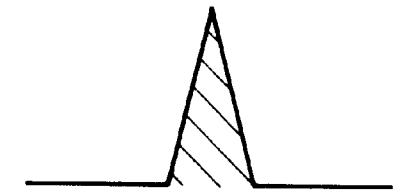
Figure 28D:
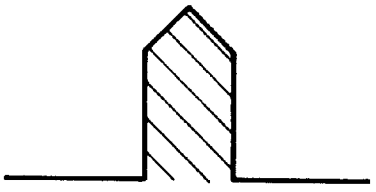
Figure 28E:
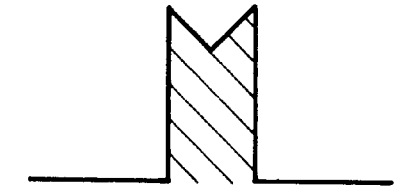
Figure 28F:
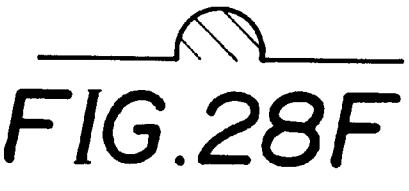
Figure 28G:
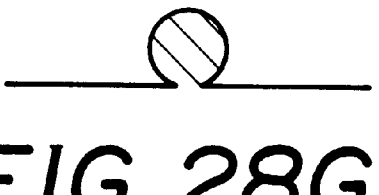
Figure 28H:
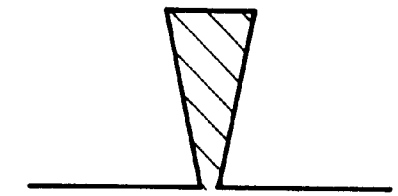
Figure 28I:
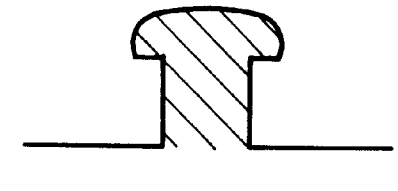

FIG. 27A is a sectional view of the ink tank cartridge, particularly showing the arrangement of a plurality of slantwise extending ribs 701. In practice, to assure that the air introduced into the ink tank cartridge 303 through an atmospheric air intake port 340 is sufficiently distributed over the whole surface of a porous member (not shown) containing ink, it is not always necessary that each rib continuously extends within the range between the air intake port 340 and an ink outlet port 330. For this reason, in this embodiment, the slantwise extending ribs 701 are arranged in the equally spaced relationship while extending in parallel with each other. In addition, as shown in FIG. 27B, a plurality of cutouts 702 are formed along the upper edge of each rib 701. In the shown case, each rib 701 linearly extends. Alternatively, it is obvious that it may extend in the curved state. Therefore, this embodiment is advantageously employable for carrying out the present invention, particularly, in the case that molding performances (associated with the direction of molding) required when the ink tank cartridge and the ribs are simultaneously molded in the integral structure is restricted.

With the ink tank cartridge constructed in the above-described manner, since recording ink contained in the porous member received in the ink tank cartridge can ultimately be utilized, an advantageous effect obtainable with the ink tank cartridge is such that reliability on practical use of the ink can be elevated while maintaining a running cost of the ink tank cartridge at a low level.

(Embodiment 16)

An ink jet recording unit constructed according to a sixteenth embodiment of the present invention will be described below with reference to FIG. 29.

Figure 29:
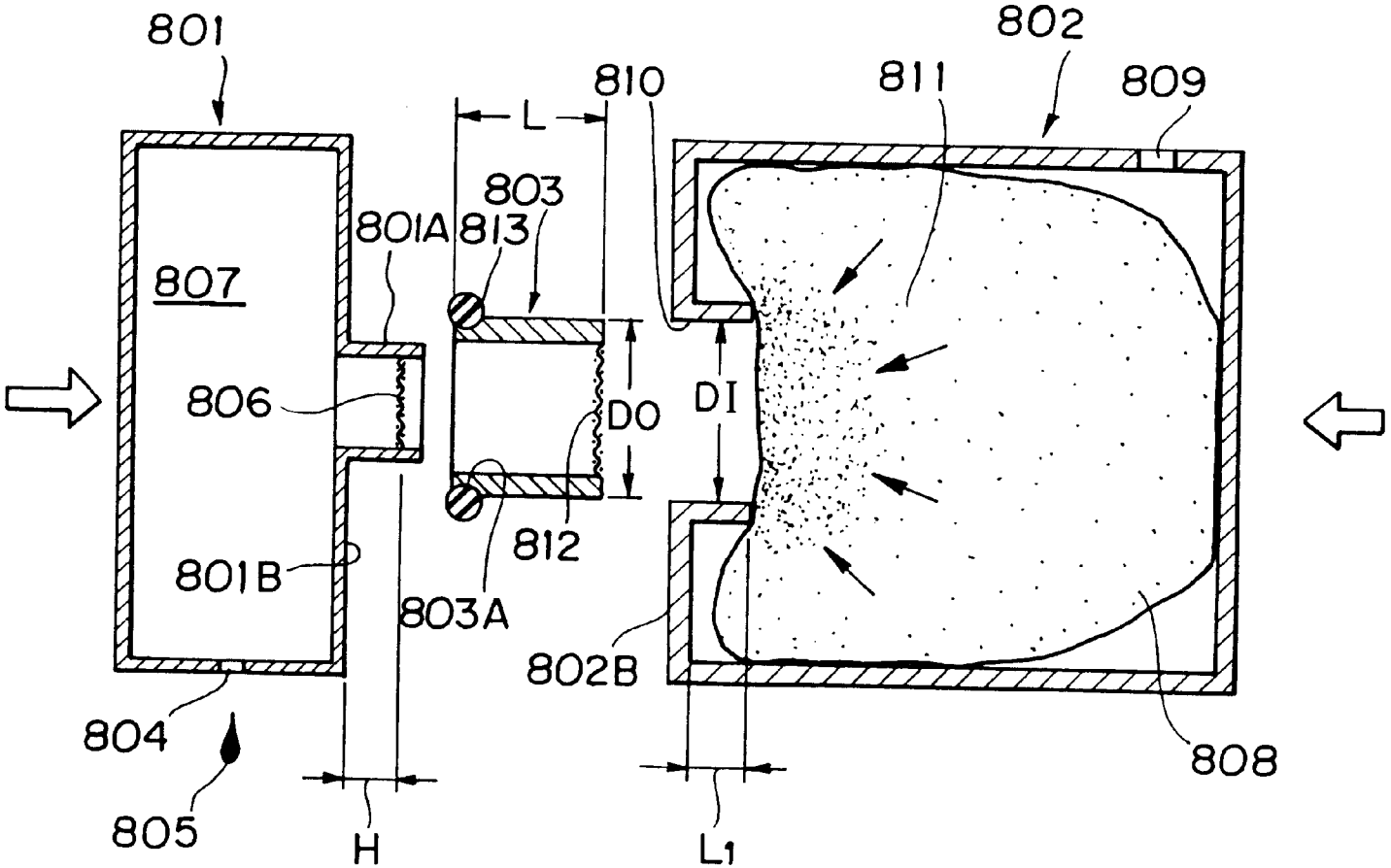
FIG. 29 is an exploded sectional view of an ink jet recording unit constructed according to a sixteenth embodiment of the present invention.

FIG. 29 is a sectional view of the ink jet recording unit, particularly showing essential components constituting the ink jet recording unit in the disconnected state. In this figure, reference numeral 801 designates an ink jet recording head section, reference numeral 802 designates an ink tank cartridge in which ink to be fed to the ink jet recording section 801 is stored, and reference numeral 803 designates a connecting member for liquidtightly connecting the ink jet recording head section 801 and the ink tank cartridge 802 to each other. A characterizing feature of this embodiment consists in a mechanism for connecting the ink jet recording head section 801 and the ink tank cartridge 802 to each other. For this reason, the detailed structure of the ink jet recording head section 801 itself is not shown for the purpose of simplification. Since the inner structure of the ink jet recording head section 801 is well known for any expert in the art, merely an ink discharging orifice 804 is shown. In this figure, reference numeral 805 designates a droplet of ink which is discharged from the ink discharging orifice 804, and reference numeral 806 designates a filter which is disposed on an ink feed port 801A of the ink jet recording head section 801 so as to prevent dust or similar foreign materials from entering a liquid chamber 807 of the ink jet recording head section 801 when the ink tank cartridge 802 is disconnected from the ink jet recording head section 801.

Next, the structure of the ink tank cartridge 802 will be described below. The ink tank cartridge 802 is exchangeable and includes a porous ink absorbing member 808 which is received in the ink tank cartridge 802. In the figure, reference numeral 809 designates an atmospheric air communication port which serves for preventing the interior of the ink tank cartridge 802 from exhibiting an excessively negative pressure as the ink is increasingly consumed, and reference numeral 810 designates a connecting portion for connecting the ink tank cartridge 802 to the ink jet recording head portion 801. The connecting portion 810 is designed in a cylindrical configuration having an inner diameter DI while projecting toward the interior of the ink tank cartridge 802. The inward projection of the connecting portion 810 is intended to bring the connecting portion 810 in close contact with a part of the ink absorbing member 808 so as to allow a larger quantity of ink to be retained in the foregoing part much more than that in the other part of the ink absorbing member 808. Incidentally, it is not desirable that a length $L_1$ of the connecting portion 810 is excessively large, since an effective quantity of available ink stored in the ink absorbing member 808 is undesirably reduced.

In addition, the connecting member 803 serves for connecting the ink tank cartridge 802 to the ink jet recording head 801. In this embodiment, the connecting member 803 is also designed in a cylindrical configuration having an outer diameter Do which is dimensioned to enable the connecting member 803 to be press-fitted into the connecting portion of the ink tank cartridge 802, and a filter 812 is secured to the foremost end of the connecting member 803. Reference numeral 813 designates an O-ring type elastic sealing member which is disposed in the vicinity of the end portion of the connecting member 803 on the ink jet recording head side. In practice, the sealing member 813 is fitted around an annular retaining groove 803A which is formed around the outer periphery of the-connecting member 803.

When the ink jet recording-head section 801 is connected to the ink tank cartridge 802, the connecting member 803 is fitted into the connecting portion 810 of the ink tank cartridge 802 so that an ink feed port 801A of the ink jet recording head 801 is inserted into the connecting member 803 along the inner peripheral surface there of until an opposing surface 801B of the ink jet recording head section 801 and an opposing surface 802B of the ink tank cartridge 802 are brought in close contact with the sealing member 13 interposed therebetween. While the foregoing state is maintained, an assembly of the ink jet recording head section 801 and the ink tank cartridge 802 is kept in the firmly connected state with the aid of engaging means (not shown). The engaging means may be constructed such that engagement pawls disposed on either the ink jet recording head section 801 or the ink tank cartridge 802 are engaged with the corresponding engagement portions disposed on them. Alternatively, the engagement therebetween may be achieved by combining an engagement groove(s) with the corresponding engagement pin(s). Since the engagement means of the foregoing type is well known for the ordinary skilled in the art, illustration of the engagement means is neglected in the figure for the purpose of simplification.

While the foregoing engaged state is maintained, it is desirable that a part of the ink absorbing member 808 in the ink tank cartridge 802 is compressed slightly in excess of the shown state by forcibly bringing the connecting member 803 in close contact with the ink absorbing member 808. For this reason, it is recommendable that the length L of the connecting member 803 is determined in consideration of the aforementioned fact.

The ink tank cartridge 808 having the ink absorbing member 808 received therein can be produced at a comparatively inexpensive cost, and moreover, a high quality of recording can be expected with the ink tank cartridge 802 because the latter generates excellent ink retaining power and the negative pressure in the ink tank cartridge 802 is kept stable. With the ink tank cartridge 802 constructed in that way, a quantity of ink contained in the ink absorbing member 808 is reduced to about ⅔ of the predetermined quantity because of factors associated with the volume of the ink absorbing member 808 itself, generation of air bubbles in the ink absorbing member 808 and so forth. In addition, since a comparatively large quantity of ink uselessly remains after completion of the predetermined number of recording operations, a volume of ink available for practical printing operations is reduced to about 30% compared with the predetermined volume of available ink. In the case that pigment based ink is employed for the ink tank cartridge 802, there is a tendency to arise malfunctions that the ink absorbing member 808 is clogged with pigment particles, and moreover, the pigment particles dispersed in a solvent are coagulated together due to components eluded from the ink absorbing member 808. In the circumstances as mentioned above, there arises an occasion that other type of ink tank cartridge is required depending on the type of a recording operation to be performed.

To satisfactorily meet the foregoing requirement, it is desirable that an ink tank cartridge is constructed in such a manner that any ink absorbing member is not normally received therein but it can be connected to and disconnected from the ink jet recording head section 801 as desired. On the other hand, with respect to the ink jet recording head section-801, it is desirable that it can be connected to and disconnected from the ink tank cartridge 802 of the type as shown in FIG. 29, and moreover, it can be connected to and disconnected from an ink tank cartridge of the type having no ink absorbing member received therein.

Figure 30:
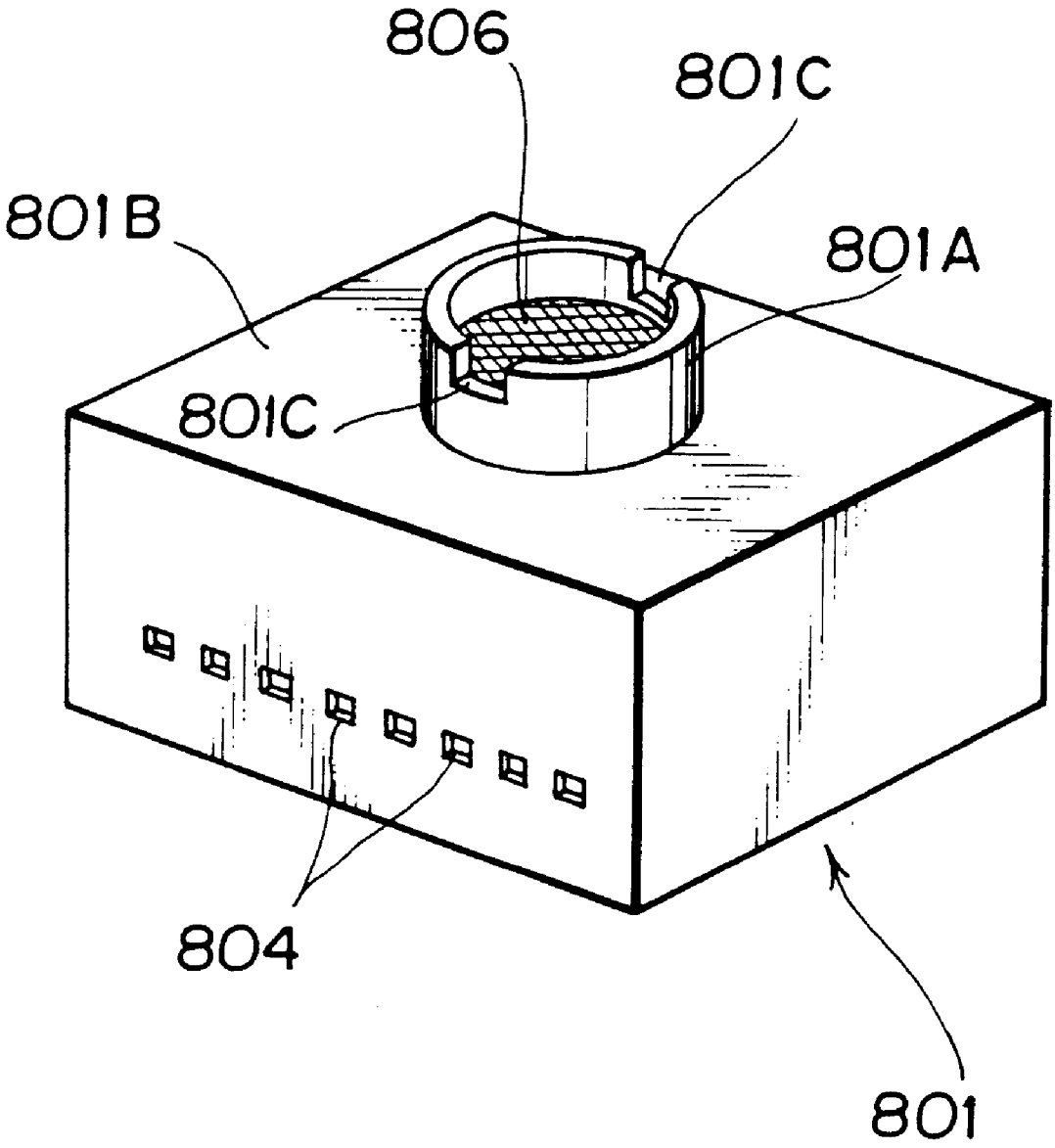
FIG. 30 is a perspective view which shows by way of example an ink jet recording head for an ink tank cartridge to which the present invention is applied.

FIG. 30 shows by way of perspective view a type of ink jet recording head section 801 including a connecting portion 801A. In the figure, reference numeral 801C designates a cutout portion which is formed at the end of the cylindrical connecting portion 801A. In also the embodiment shown in FIG. 29, while the ink jet recording head section 801 is connected to the opponent ink tank cartridge, a liquid chamber 807 in the ink jet recording head portion 801 is communicated with the interior of the ink tank cartridge 802 via the cutout portions 801C so as to feed ink to the ink jet recording head section 801.

Figure 31:
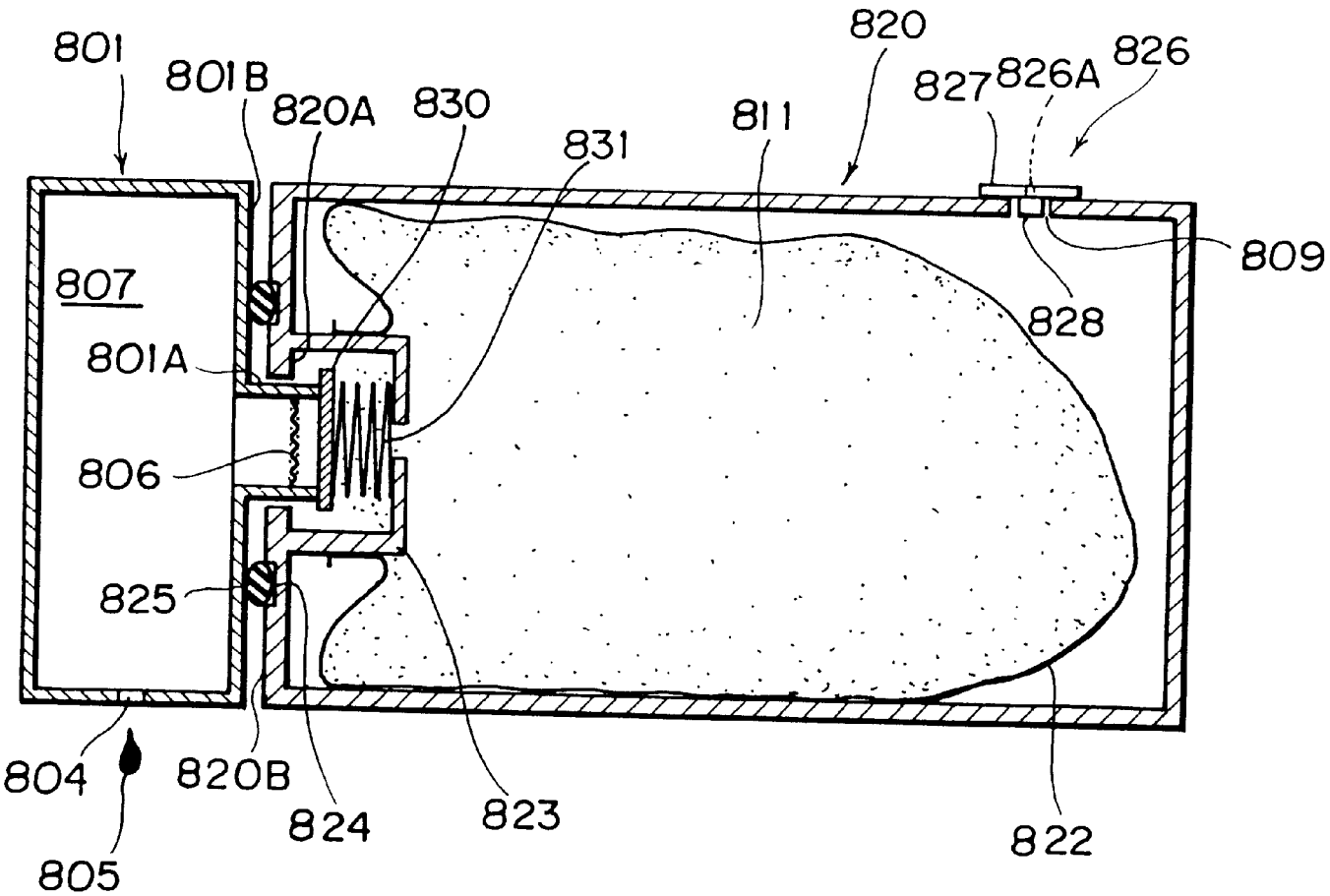
FIG. 31 is a sectional view of an ink jet recording head for another type of ink tank cartridge to which the present invention is applied, particularly showing that the ink jet recording head is connected directly to the ink tank cartridge.

FIG. 31 shows by way of sectional view an ink jet recording unit constructed according to a modified embodiment of the present invention. In this embodiment, an exchangeable type ink tank cartridge 820 of the above-proposed type having no ink absorbing member received therein is connected to an ink jet recording head section 801. In contrast with the ink jet recording unit shown in FIG. 29, no connecting member is disposed therebetween, and an elastic sealing member 825 is disposed on the opposing surface 820B of the ink tank cartridge 820. Thus, it will readily be understandable that in the case of the ink tank cartridge 802 of the type shown in FIG. 29, the connecting member 803 is used to cooperate with the ink jet recording head section 801, while in the case of the ink tank cartridge 820 of the type shown in FIG. 31, the ink jet recording head section 801 can be connected directly to the ink tank cartridge 820 without any necessity for disposing the connecting member as shown in FIG. 29.

Now, an outline of the structure of the above-proposed ink tank cartridge 820 shown in FIG. 31 will be described below.

An ink bag 822 molded of a film of high molecular material is received in the ink tank cartridge 820. The ink bag 822 is fused to a flange portion 823 of the ink tank cartridge 820, and ink 811 is filled in the ink bag 822. An annular groove 824 is formed on the opposing surface 820A of the ink tank cartridge 820 so that an elastic sealing member 825 such as an O-ring or the like is fitted into the annular groove 824. In addition, to properly adjust a negative pressure arising in the ink tank 820, a negative pressure adjusting valve 826 is disposed in an atmospheric air communication port 809. The negative pressure adjusting valve 826 is composed of a large circular valve seat 827 having a ventilation hole 826A formed therethrough and a circular seat 828 coated with an oil such as a silicone oil or the like hardly dried but having excellent viscosity in such a manner as to close the ventilation hole therewith from inside. Similar to the seat 828, the outer peripheral part of the large seat 827 is coated with the same oil as mentioned above so that it comes in close contact with the outer wall surface of the ink tank cartridge 820.

When a certain quantity of the ink 811 in the ink bag 822 is consumed, causing a certain intensity of negative pressure to appear on the ink bag 822, air is introduced into the ink tank cartridge 820 through the ventilation hole 826A and then reaches the ink bag 822 while the seat 828 is parted away from the seat 827 against the adhering force of the oil, whereby the negative pressure in the ink tank cartridge 820 is attenuated with the intake air. When the room temperature is elevated while no recording operation is performed or the air present in the space surrounding the ink bag 822 is expanded for some reason to increase the air pressure, there is a possibility that ink leaks from an ink discharging orifice 804. In such case as mentioned above, the seat 827 is parted away from the outer wall surface of the ink tank cartridge 820 against the adhering force of the oil so that the air having the increased pressure is exhausted to the outside. With the ink tank cartridge 820 constructed in the above-described manner, there is a possibility that an excessively high magnitude of shock is applied to the ink tank cartridge 820, causing the ink 811 to leak, when the ink jet recording head section 801 is disconnected from the ink tank cartridge 820. To cope with the foregoing problem of ink leakage, a valve 830 is disposed in the ink tank cartridge 820. Incidentally, it is recommendable that the valve body 830 is molded of a rubber such as a chlorided butyl rubber, EPDM or the like. The valve body 830 is normally biased toward a connection port 820A by the resilient power of a coil spring 831 until it comes in close contact with the connection port 820A so as to prevent ink from leaking from the ink bag 822. While the ink tank cartridge 820 is connected to the ink jet recording head section 801 as shown in FIG. 31, an ink feed port 801A of the ink jet recording head section 801 is brought in contact with the valve body 830 which in turn is inwardly thrusted, causing a certain annular gap to be formed around the valve body 830, whereby an ink chamber 807 of the ink jet recording head section 801 is communicated with the ink bag 822 via the cutout portions 801C formed on the connecting portion 801A (see FIG. 30). Incidentally, it suffices that a length of projecting of the connecting portion 801A is determined to be long enough to allow the valve body 820 to be retracted against the resilient force of the coil spring 831 until an annular gap is formed around the value body 830 to serve as an ink path. Rather, it is desirable that the valve body 830 can not deeply be thrusted into the interior of the ink tank cartridge 820 due to the arrangement of the coil spring 831.

With the ink tank cartridge 820 constructed in that way, a large quantity of ink 811 can be stored in the ink bag 822 compared with the predetermined inner volume of the ink tank cartridge 820, and moreover, only a small quantity of ink 811 remains in the ink tank cartridge 820 on completion of recording operations, resulting in a volume utilization efficiency of 60 to 70% being obtainable with the ink tank cartridge 820. However, in spite of the advantageous effects of the ink tank cartridge 820 as mentioned above, it is obvious that the ink tank cartridge 820 has a drawback that it is unavoidably produced at an expensive cost compared with an ink tank cartridge of the type including an absorbing member, since it is difficult that the ink bag 822 is fusibly secured to the flange portion 823, resulting in it being produced with many molding steps, the negative pressure adjusting valve 826 is required for the purpose of properly controlling the negative pressure in the ink tank cartridge 820, the valve body 830 is required for the purpose of preventing an occurrence of ink leakage, and moreover, the ink bag 822 is molded in a complicated configuration having a smaller working inner volume smaller than that of an ordinary one.

Obviously, the smaller the ink tank cartridge, the more remarkable the drawback of the same. However, since it is certain that the ink tank cartridge of the foregoing type has the aforementioned advantageous effects, it is desirable that one of two types of ink tank cartridges is selectively used depending on the application field thereof. To effectively utilize the function of the ink tank cartridge 820 of the type shown in FIG. 31 as far as possible, it is recommendable that a length of projecting of the connecting portion 801A of the ink jet recording head section 801 is possibly shortened. To this end, in the case that the ink jet recording head section 801 is connected to an ink tank cartridge of the type shown in FIG. 29, it is acceptable that a joint attachment such as the connecting member according to the present invention is disposed therebetween in order to variably determine a length of projecting of the connecting portion 801A.

In the circumstances as mentioned above, connecting members for connecting an ink tank cartridge 802 of the type shown in FIG. 29 to the opponent ink jet recording head section are shown in FIGS. 32A to 32D, FIG. 33A and FIG. 33B, respectively, as modified embodiments of the present invention.

Figure 32A:
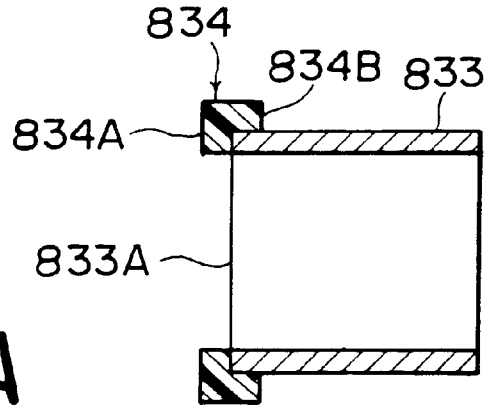
FIGS. 32A to 32D show by way of sectional views the structure of each of various kinds of connecting members to which the present invention is applied.

FIG. 32A shows by way of sectional view a cylindrical connecting member 833 including an elastic sealing member 834 having a square sectional shape. When an ink jet recording head section 801 is connected to an ink tank cartridge 802 in the same manner as in the embodiment shown in FIG. 29, a front surface 834A of the sealing member 834 comes in close contact with an opposing surface 801B of the ink jet recording head section 801, while a rear surface 834B of the same comes in close contact with an opposing surface 802B of the ink tank cartridge 802, whereby the ink jet recording head section 801 and the ink tank cartridge 802 are liquidtightly connected to each other with the sealing member 834 interposed therebetween.

Figure 32B:
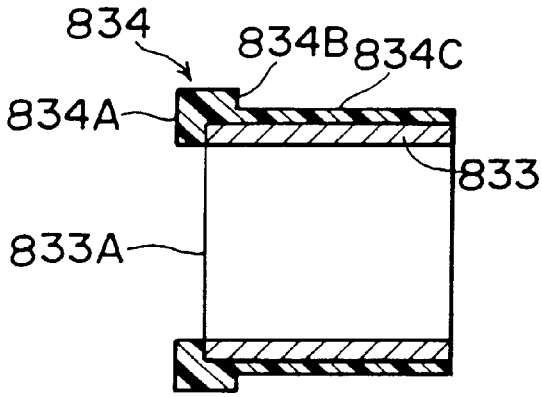

FIG. 32B shows by way of sectional view a connecting member 833 which is modified from the connecting member 833 shown in FIG. 32A such that a part of the sealing member 834 extends from the rear surface 834B in the axial direction. An outer peripheral surface portion 834C of the sealing member 834 is press-fitted into a cylindrical connecting portion 810 of the ink tank cartridge 802 shown in FIG. 29 so that the connecting member 833 is fitted into the ink tank cartridge 802 with improved sealability.

Figure 32C:
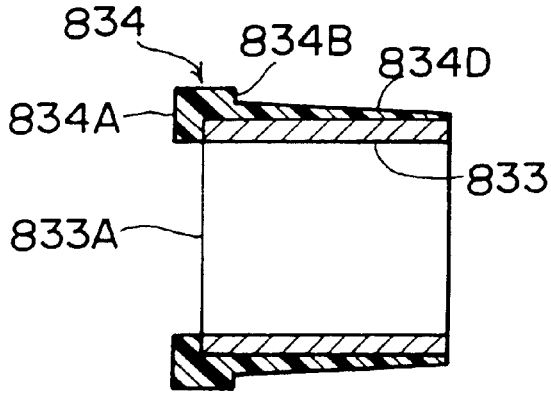

FIG. 32C shows by way of sectional view a connecting member 833 which is modified from the sealing member 833 shown in FIG. 32B such that an outer peripheral surface portion 834D of the sealing member 834 is tapered in the rightward direction so as to enable the connecting member 833 to be easily fitted into the ink tank cartridge 802.

Figure 32D:
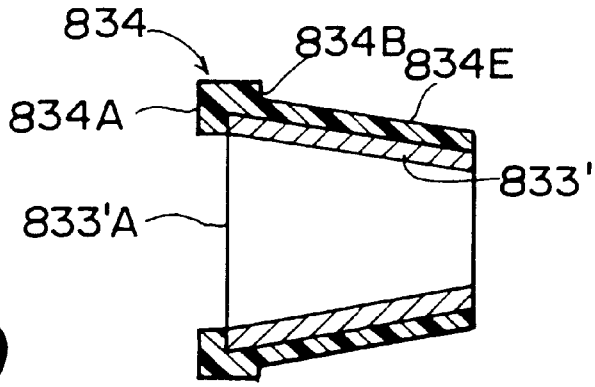

In addition, FIG. 32D shows by way of sectional view a connecting member 833' which is modified from each of the connecting members 833 shown in FIG. 32A to FIG. 32C such that it is tapered in the rightward direction, and moreover, it is sheathed with an elastic sealing member 834 across the whole axial length from the front end 833'A of the connecting member 833' to the rear end of the same. In FIG. 34D, reference numeral 834E designates an outer peripheral surface portion of the sealing member 834 which is molded corresponding to the outer peripheral surface of the connecting member 833' so as to serve in the same manner as the sealing member 834 shown in FIG. 32C.

Figure 33A:
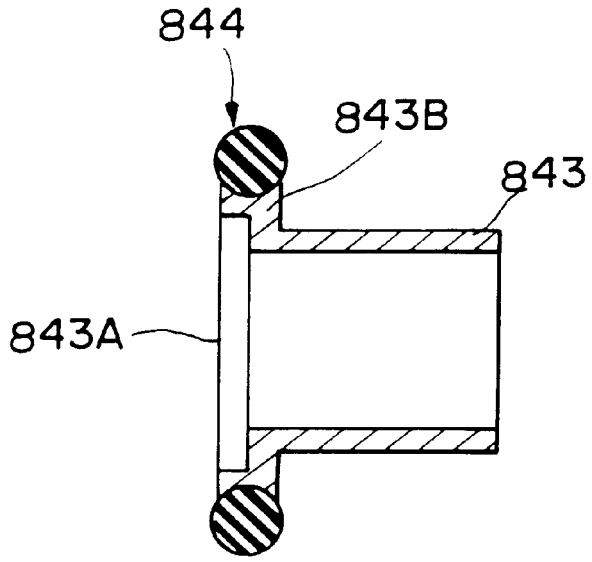
FIGS. 33A and 33B show by way of sectional views the structure of another kinds of connecting members to which the present invention is applied.
Figure 33B:
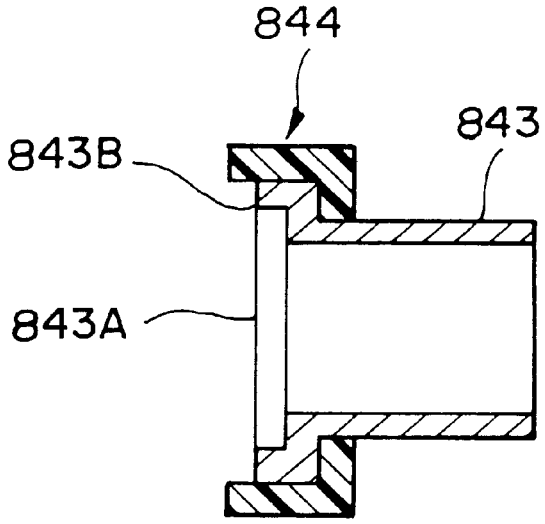

FIGS. 33A and 33B each shows by way of sectional views a connecting member which is preferably employable in the case that an elastic sealing member is firmly disposed on the ink jet recording head section side as will be described later. In this case, when the ink jet recording head having the elastic sealing member is connected to an ink tank cartridge 802 of the type shown in FIG. 29, via one of the connecting members aforementioned the elastic sealing member (not shown) disposed around an ink feed port of the ink jet recording head section 801 interferes with the connecting member. To cope with the foregoing malfunction, a part of the connecting member on the connecting side relative to the ink jet recording head section 801 is designed to have an enlarged diameter. Specifically, in the figures, reference numeral 843 designates a connecting member having a stepped part formed thereon, reference numeral 843A designates a front end of the connecting member 843, and reference numeral 843B designates a flange portion having an enlarged inner diameter to form a stepped part of the connecting member 843.

In the case shown in FIG. 33A, an annular retaining groove 843C is formed around the outer periphery of the flange portion 843B so that an O-ring type elastic sealing member 844 having a diameter larger than the flange portion 843B is fitted around the annular retaining groove 843C. On the other hand, in the case shown in FIG. 33B, an annular elastic sealing member 844 having a L-shaped sectional contour is fitted around the flange portion 843B. The connecting member 843 including the flange portion 843B as shown in FIG. 33B is employable for an ink jet recording unit shown in FIG. 34.

Figure 34:
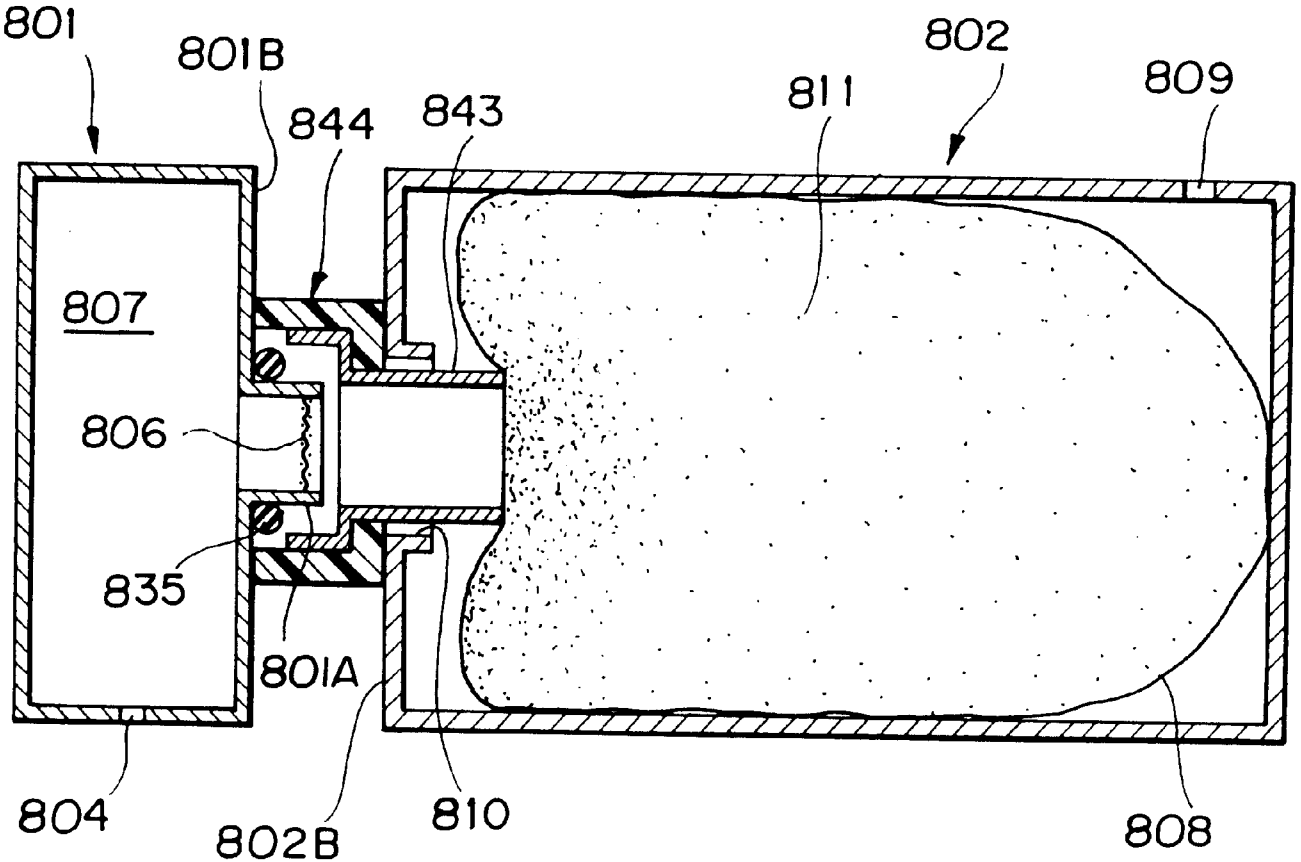
FIG. 34 is a sectional view of an ink tank cartridge constructed according to another embodiment of the present invention modified from the aforementioned embodiments.

In FIG. 34, reference numeral 835 designates an elastic sealing member which is fitted around an ink feed port 801A of an ink jet recording head section 801. In the shown case, the ink jet recording head section 801 can be connected directly to an ink tank cartridge 820 of the type shown in FIG. 31. In contrast with the case shown in FIG. 31 wherein the elastic sealing member 825 is held on the ink tank cartridge 820 side, in the case shown in FIG. 34, the elastic sealing member 835 is held on the ink jet recording head section 801 side for the same purpose.

Next, description will be made below with respect to the case that the ink jet recording head section 801 shown in FIG. 34 is connected to the ink tank cartridge 802 shown in FIG. 29 with the aid of the connecting member 843. While the ink jet recording head section 801 is connected to the ink tank cartridge 802 with the aid of engaging means (not shown), the space therebetween is liquidtightly maintained by the elastic sealing member 844 disposed in the foregoing joint range. Since the foremost end of the connecting member 843 is thrusted in the interior of the ink tank cartridge 802 to come in contact with an ink absorbing member 808, a part of the ink absorbing member 808 is compressed so that ink 811 in the ink absorbing member 808 is fed to the ink jet recording head section 801 via a connecting portion 810. In the shown case, the elastic sealing member 835 disposed on the ink jet recording head section 801 side does not function but the elastic sealing member 844 exhibits a liquidtight sealing function in the opposite directions when the ink jet recording head section 801 is connected to the ink tank cartridge 802 in the same manner as in the embodiment shown in FIG. 31.

Figure 35A:
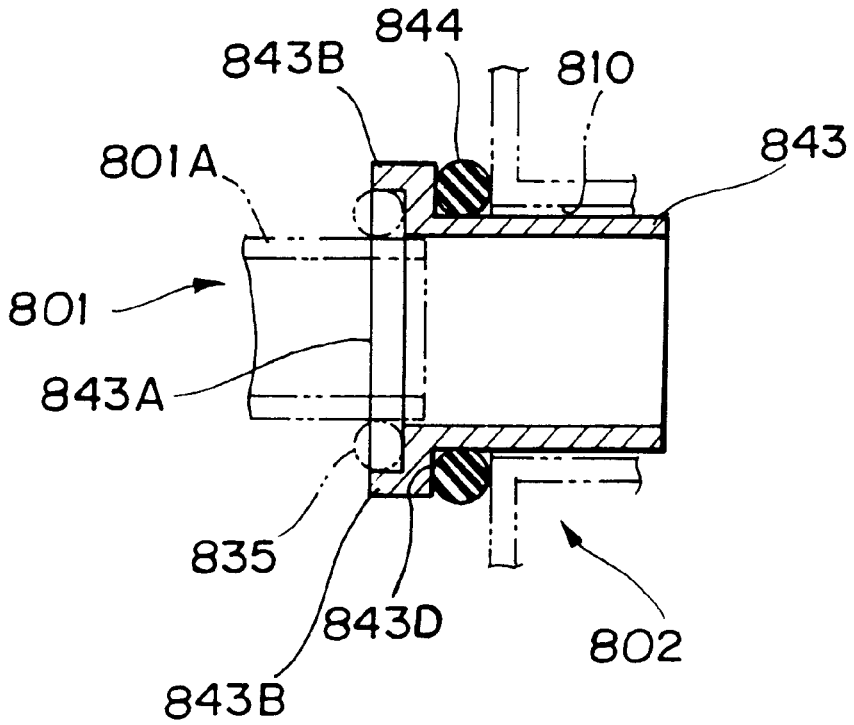
FIGS. 35A and 35B show by way of sectional views the structure of each of connecting members constructed according to another embodiment of the present invention modified from the aforementioned embodiments.
Figure 35B:
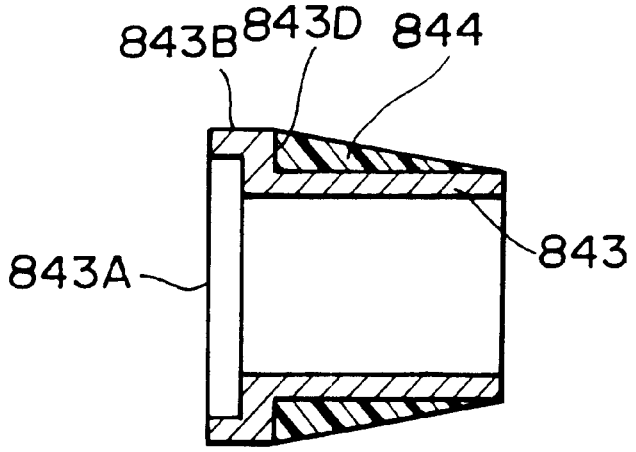

In addition, FIGS. 35A and 35B show by way of sectional views a connecting member constructed according to another modified embodiment of the present invention. The connecting member 843 includes a flange portion 843B in the same manner as that shown in FIGS. 33A and 33B. In the case shown in FIG. 35A, an O-ring type elastic sealing member 844 is fitted around the flange portion 843B of the connecting member 843 as well as a cylindrical stepped portion 843D of the same. On the other hand, in the case shown in FIG. 35B, a conically extending elastic sealing member 844 is fitted around the stepped portion 843D of the connecting member 843 within the range extending from the rear surface of the flange portion 843B to the foremost end of the same so that the connecting member 843 is liquidtightly press-fitted into the ink tank cartridge 802.

With the connecting member including an elastic sealing member in the above-described manner, e.g., in the case shown in FIG. 35A, the space between the connecting member 843 and the ink tank cartridge 802 is sealed with an elastic sealing member 844, while the space between the connecting member 843 and the ink jet recording head section 801 is sealed with the elastic sealing member 835 fitted around the ink feed port 801A of the latter.

Figure 36:
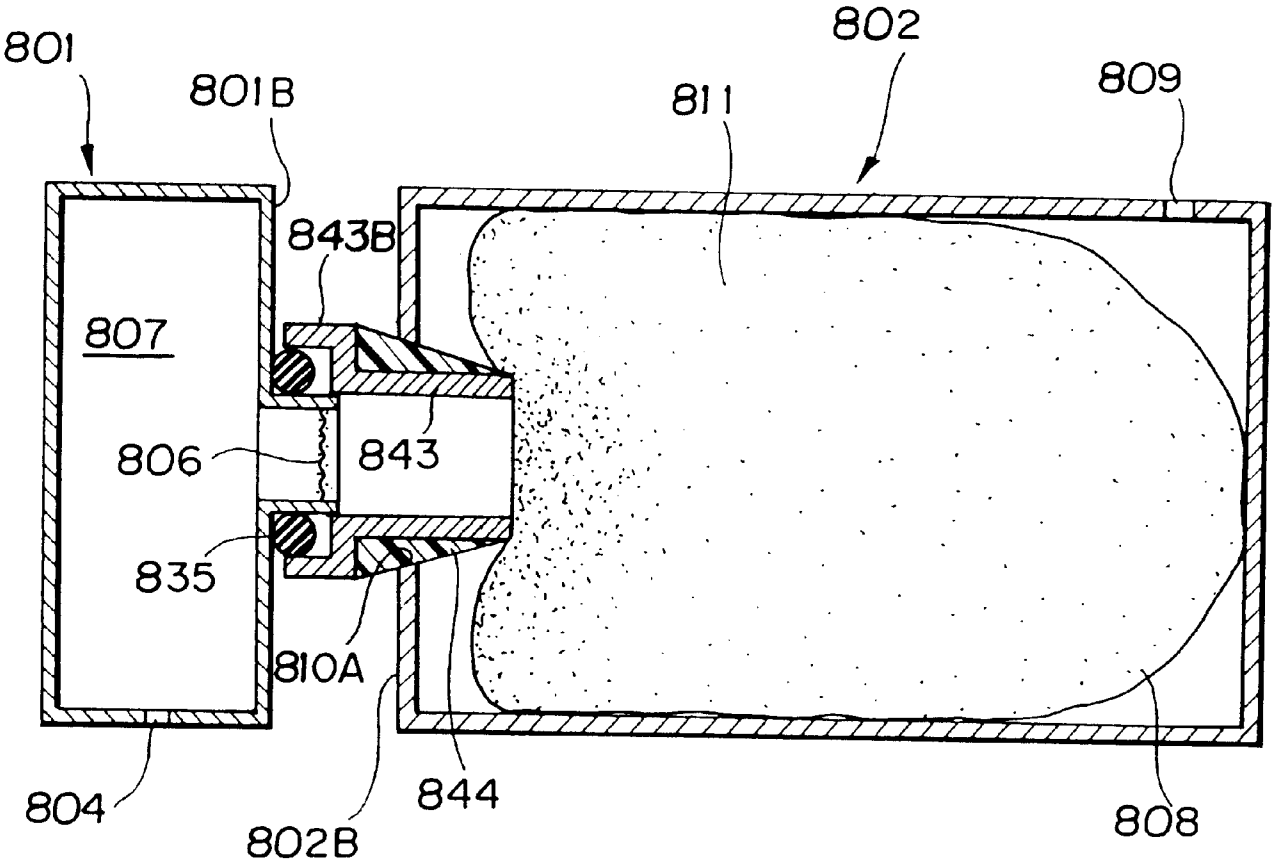
FIG. 36 is a sectional view of an ink jet recording head and an ink tank cartridge which are connected to each other via the connecting member shown in FIG. 35B.

FIG. 36 shows by way of sectional view the case that an ink jet recording head section 801 of the type shown in FIG. 34 is connected to an ink tank cartridge 802 with the aid of the connecting member 843 including the elastic sealing member as shown in FIG. 35B. In the shown case, to assure that an ink absorbing member 808 has a sufficiently large ink retaining capacity so as to allow a large quantity of ink to be contained therein, only an opening portion 810A serves as a joint portion for connecting the ink jet recording head section 801 to the ink tank cartridge 802 but any cylindrical connecting portion as shown in FIGS. 29 and 34 is not disposed therebetween. For this reason, in this case, it is required that the connecting member 843 is press-fitted into the opening portion 810A of the ink tank cartridge 802 to compress a part of the ink absorbing member 808 therewith, whereby ink 811 contained in the ink absorbing member 808 can be fed to the ink jet recording head portion 801 via the connecting member 843. Also in this case, the space between the ink jet recording head section 801 and the ink tank cartridge 802 can liquidtightly be sealed not only with the elastic sealing member 835 disposed on the ink jet recording head section 801 side but also with the conical elastic sealing member 844 disposed on the connecting member 843.

The present invention has been described above with respect to the case that the present invention is applied to a connecting member employable for an exchangeable assembly of the ink jet recording head section 801 and the ink tank cartridge 802 but the present invention should not be limited only to this case. Alternatively, the present invention may equally be applied to the case that the ink jet recording head section 801 is integrally connected to the ink tank cartridge 802 with the aid of the connecting member. In other words, it is not always necessary that the ink jet recording head section 801 can be disconnected from the ink tank cartridge 802.

As is apparent from the above description, according to each of the aforementioned embodiments, since an ink jet recording head section can be connected to an ink tank cartridge via a tubular connecting member including an elastic sealing member so as to sealably close the space therebetween with the sealing member, the arrangement of the connecting member makes it possible that a common ink jet recording head section can arbitrarily be connected to a different type of ink tank cartridge. Thus, one of a plurality of ink tank cartridges each containing a different kind or color of ink can be connected to the common ink jet recording head section as desired depending on a utilization field of the ink jet recording unit. Consequently, the utilization field of the ink jet recording unit to which the present invention is applied can substantially be widened.

Next, prior to description of another embodiment of the present invention, to facilitate understanding of the present invention, a typical ink jet recording unit will be described again below with reference to FIG. 37 to FIG. 39.

Figure 37:
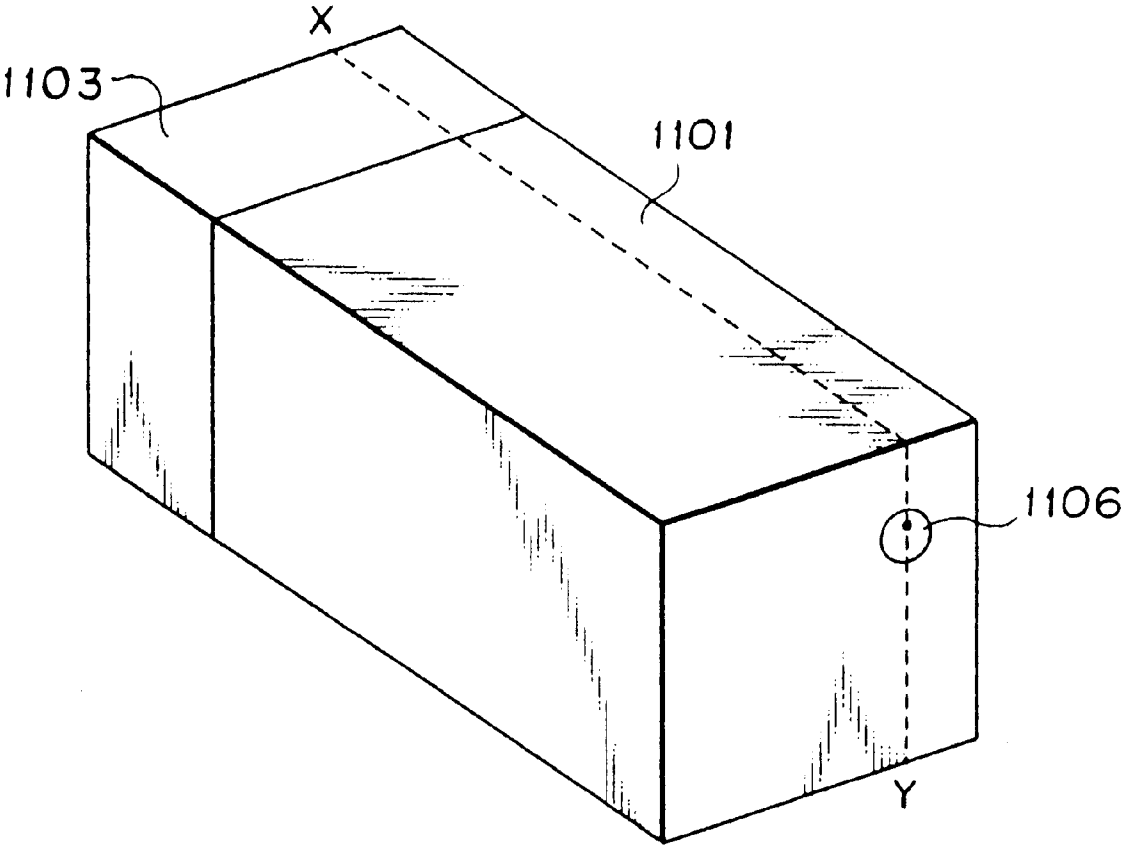
FIG. 37 PRIOR ART
FIG. 37 is a schematic perspective view of a conventional ink jet recording unit.
Figure 38:
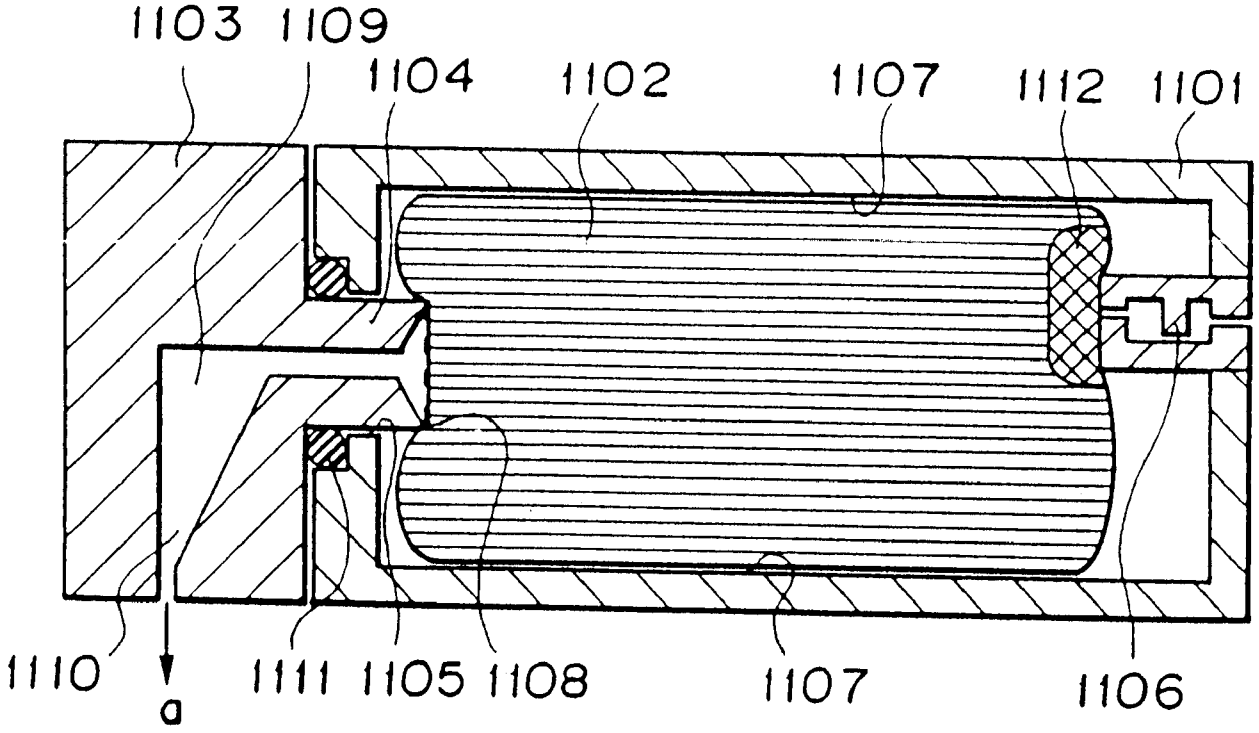
FIG. 38 PRIOR ART
FIG. 38 is a sectional view of the conventional ink jet recording unit shown in FIG. 37.

FIG. 37 is a perspective view of the ink jet recording unit including an ink jet recording head 1103 and an ink tank cartridge 1101 both of which are integrated with each other, and FIG. 38 is a sectional view of the ink jet recording unit taken along line X-Y in FIG. 37.

Referring to FIG. 38, an ink absorbing member 1102 made of a sponge-like material is housed in the ink tank cartridge 1101, and an ink outflow port 1105 adapted to receive a projection 1104 of the ink jet recording head 1103 therein and an atmospheric air intake port 1106 by way of which atmospheric air is taken so as to allow it to be substituted for the ink contained in the ink absorbing member 1102 as the ink is increasingly consumed are formed through the ink tank cartridge 1101.

The space between the Ink tank cartridge 1101 and the ink jet recording head 1103 is sealably closed with a rubber member 1111.

The ink absorbing member 1102 is compressed with side walls 1107 each extending at a right angle relative to the surface having the ink outflow port 1105 formed thereon, whereby an ink retaining power of the ink absorbing member 1102 is restrictively retained by the side walls 1107.

A part of the ink absorbing member 1102 is compressed by the projection 1104 of the ink jet recording head 1103, and a meniscus power appearing at the foregoing part is set to be larger than that in the other part of the ink absorbing member 1102 compressed by the side walls 1107. Thus, as the ink contained in the ink absorbing member 1102 is consumed, it is continuously displaced to the ink outflow port 1105 by capillary action without an occurrence of malfunction that feeding of the ink is interrupted in the course of each recording operation.

A filter 1108 is secured to a part of the ink absorbing member 1102 adapted to come in contact with the foremost end of the projection 1104 projecting from the ink jet recording head 1103, in order to prevent dust or similar foreign materials in the ink from flowing into the ink jet recording head 1103.

As the ink is taken from the ink absorbing member 1102 through the filter 1108, it flows through an ink flow path 1109 to reach an ink discharging orifice 1110 so that it is discharged from the orifice 1110 to a recording medium such as a paper or the like in the a arrow-marked direction by actuating ink discharging means (not shown).

Figure 39:
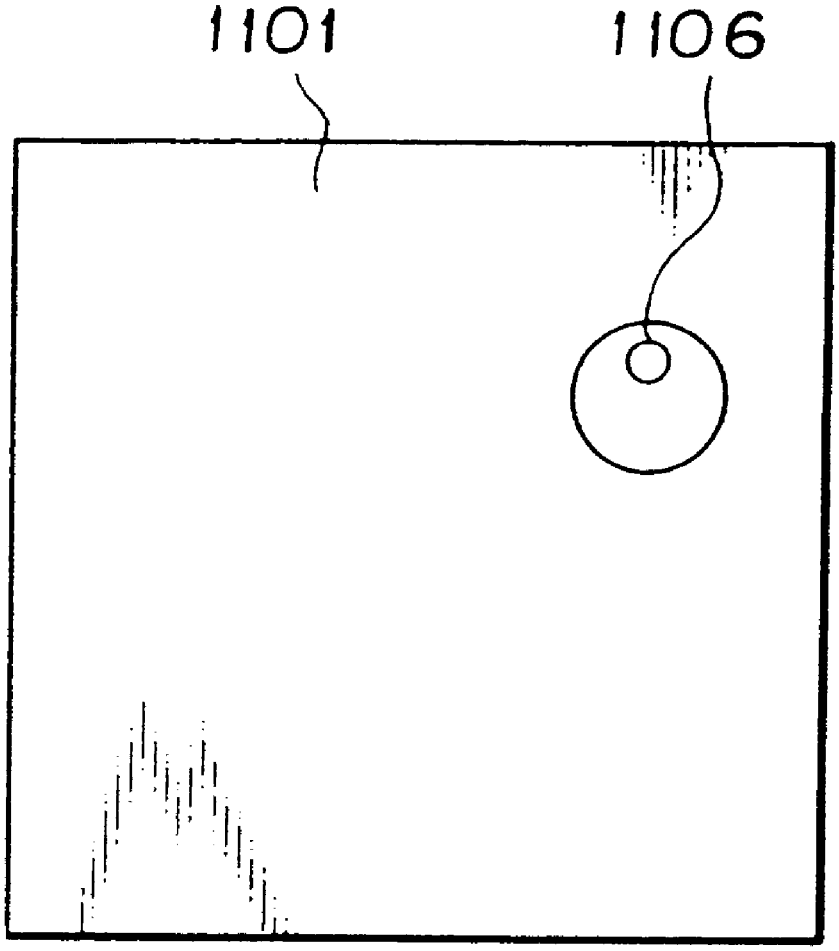
FIG. 39 PRIOR ART
FIG. 39 is a rear view of the conventional ink jet recording unit shown in FIG. 36.

FIG. 39 is a rear view of the ink jet recording unit as seen from the rear side where the atmospheric air intake port 1106 is formed through the ink tank cartridge 1101 on the ink jet recording unit shown in FIG. 37 and FIG. 38.

The atmospheric air intake port 1106 is molded as an independent component in consideration of the conveniences for molding the ink tank cartridge 1101 of a synthetic resin by employing, for example, an injection molding process.

With the ink jet recording unit constructed in the above-described manner, as a part of the ink absorbing member 1102 is compressed by the projection 1104 of the ink jet recording head 1103, the meniscus power having an intensity higher than that appearing in the other part of the ink absorbing member 1102 arises at the foregoing part of the latter, causing the ink contained in the ink absorbing member 1102 to be continuously displaced to the ink outflow port 1105 without any possibility that feeding of the ink is interrupted in the course of each recording operation.

To assure that any ink does not flow outside of the atmospheric air intake port 1106 after it enters the latter, the atmospheric air intake port 1106 is usually designed in a complicated manner with a plurality of chambers arranged therein to divide the interior of the atmospheric air intake port 1106 into a plurality segments, and it is inserted into the ink tank cartridge 1101 by a certain distance.

In the case that the volume of the ink tank cartridge 1101 is reduced so as to meet a requirement for designing a printer with small dimensions, it is necessary that in spite of the small volume of the ink tank cartridge 1101 itself, the volume of the ink absorbing member 1102 is enlarged as far as possible so that a possibly large quantity of ink is contained in the ink absorbing member 1102. In this case, a part of the atmospheric air intake port 1106 located inside of the ink tank cartridge 1101 comes directly in contact with a porous material such as a sponge or the like constituting the ink absorbing member 1102, causing the ink absorbing member such as at 1102 to be locally intensely compressed by the atmospheric air intake port 1106.

For this reason, the meniscus power arising in the ink absorbing member at 1112 in the vicinity of the atmospheric air intake port 1106 is enlarged not only in excess of the meniscus power caused by restrictively compressing the ink absorbing member 1102 with the side walls 1107 of the ink tank cartridge 1101 but also in excess of the meniscus power caused by compressing the ink absorbing member 1102 with the projection 1104 of the ink jet recording head 1103. This may lead to the result that the ink remaining in the ink absorbing member 1102 as it is increasingly consumed is irregularly distributed in the ink absorbing member 1102.

In other words, the ink is liable to remain in the vicinity of the atmospheric air intake port 1106, resulting in an ink utilization efficiency of the ink tank cartridge 1101 being degraded.

Due to the fact that the ink is liable to remain in the vicinity of the atmospheric air intake port 1106 as mentioned above, the ink jet recording unit has the case that the ink readily invades in the atmospheric air intake port 1106 in the case that the ink tank cartridge 1101 is exposed to a high temperature during transportation of the ink jet recording unit or in the case that a temperature cycle ranging from a low temperature to a high temperature is repeated with the ink jet recording unit.

In consideration of the foregoing, an ink jet recording unit constructed according to another embodiment of the present invention which can improve ink utilization efficiency of an ink tank cartridge more effectively will be described below.

(Embodiment 17)

An ink jet recording unit constructed according to a seventeenth embodiment of the present invention will be described below with reference to FIG. 40 that is a perspective view thereof.

Figure 40:
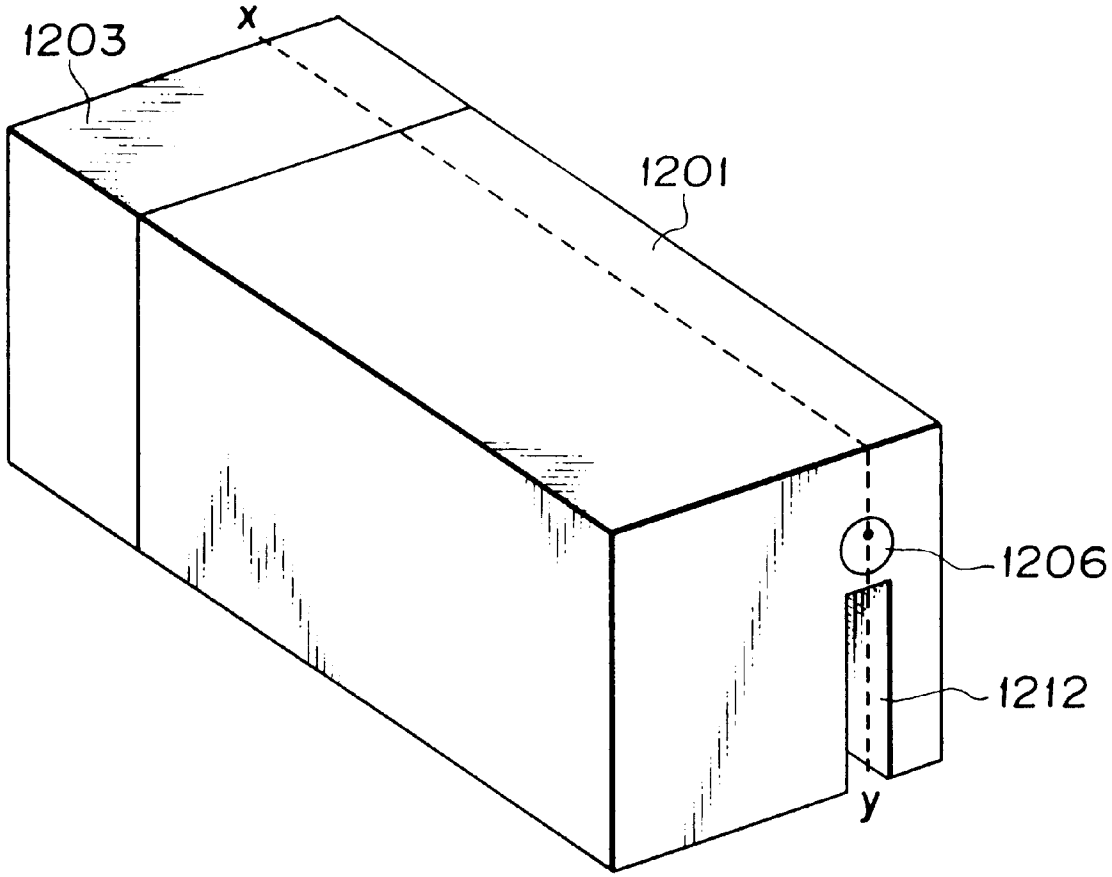
FIG. 40 is a schematic perspective view of an ink jet recording unit constructed according to a seventeenth embodiment of the present invention.

As shown in FIG. 40, the ink jet recording unit includes an ink jet recording head 1203 and an ink tank cartridge 1201 both of which are integrally connected to each other in the shown case but disconnected from each other as desired. Incidentally, FIG. 41 is a sectional view of the ink jet recording unit taken along line X-Y in FIG. 40, and FIG. 42 is a rear view of the ink jet recording unit as viewed from the rear side where an atmospheric air intake port 1206 is formed on the ink tank cartridge 1201.

Figure 41:
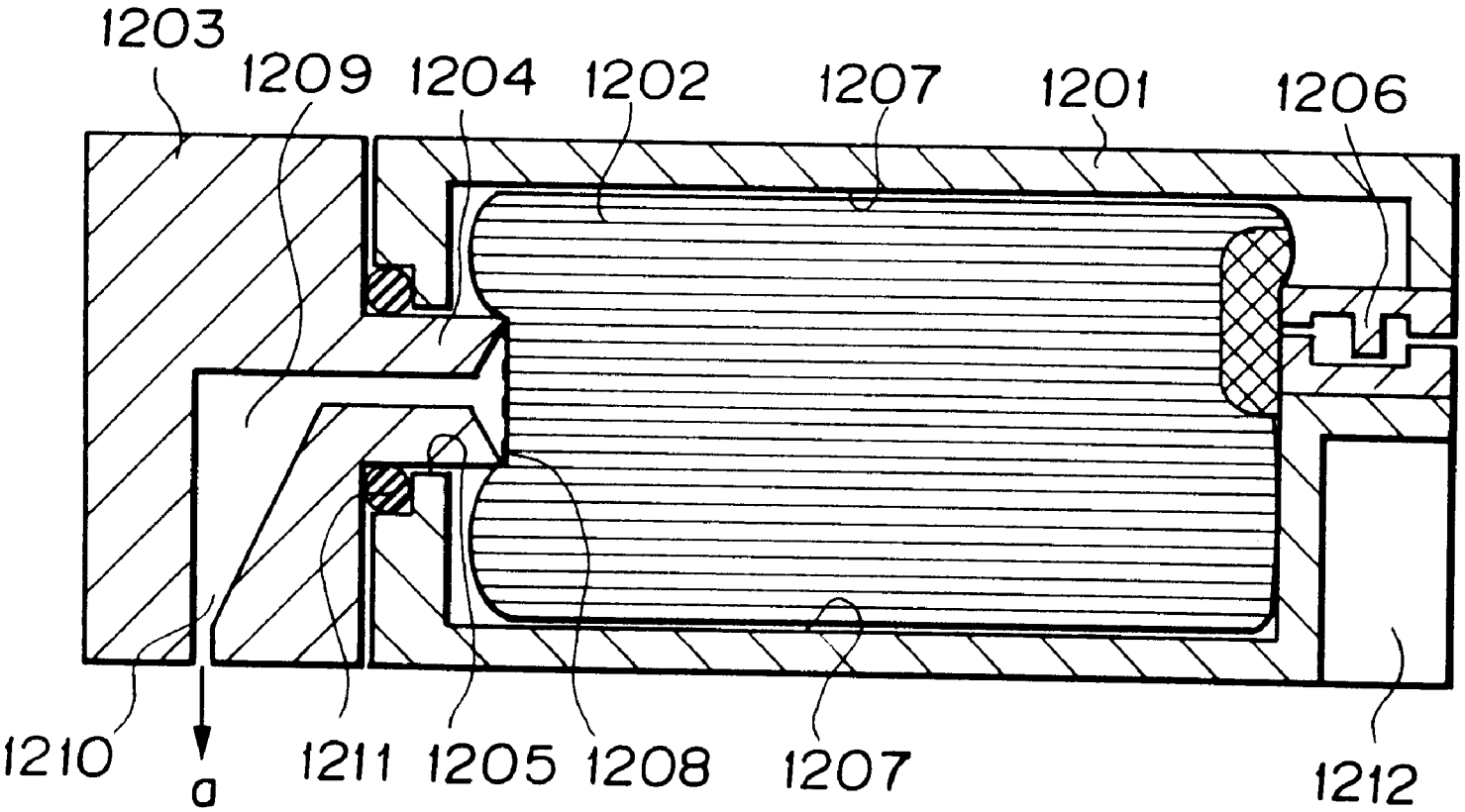
FIG. 41 is a sectional view of the ink jet recording unit shown in FIG. 40.
Figure 42:
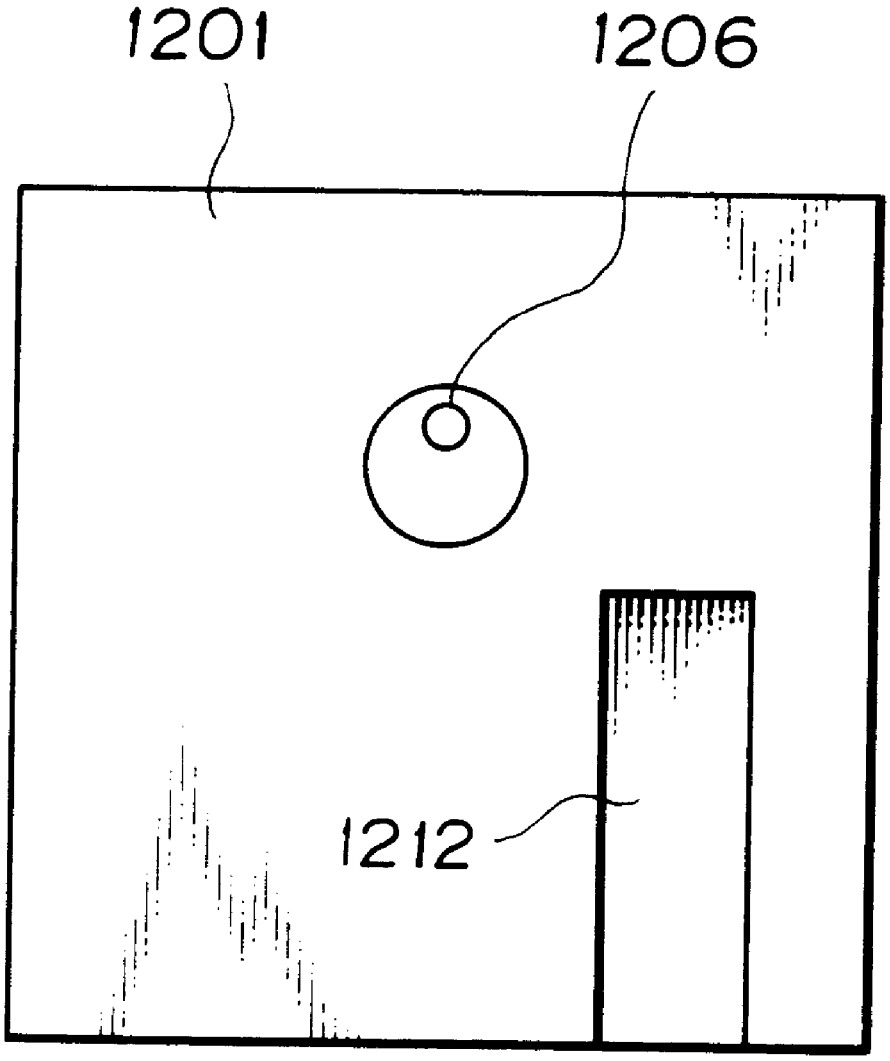
FIG. 42 is a rear view of the ink jet recording unit shown in FIG. 40.

Referring to FIG. 41, an ink absorbing member 1202 made of a sponge or the like is received in the ink tank cartridge 1201, and an ink outflow port 1205 adapted to receive a projection 1204 projecting from the ink jet recording head 1203 and an atmospheric air intake port 1206 through which atmospheric air is quickly taken therein so as to allow the introduced air to be substituted for ink contained in the ink absorbing member 1202 as the ink is increasingly consumed are formed through the ink tank cartridge 1201.

The space between the ink tank cartridge 1201 and the ink jet recording head 1203 is sealably closed with an elastic sealing member 1211 molded of a rubber or the like.

The ink absorbing member 1202 is compressed by side walls 1207 extending at a right angle relative to the front surface having the ink outflow part 1205 formed thereon on the ink tank cartridge 1201, causing the ink retaining power of the ink absorbing member 1202 to be restrictively maintained by both the side walls 1207.

The projection 1204 of the ink jet recording head 1203 is brought in contact with a part of the ink absorbing member 1202 to compress the foregoing part therewith, and the meniscus power arising in the foregoing part is set to be larger than that appearing in the other part of the ink absorbing member compressed mainly by both the side walls 1207. In the presence of the meniscus power as mentioned above, the ink contained in the ink absorbing member 1202 is continuously displaced to the ink outflow port 1205 as it is consumed. Thus, there does not arise a malfunction that feeding of the ink is interrupted during each recording operation.

A filter 1208 is secured to the projection 1204 of the ink jet recording head 1203 at which the foregoing part of the ink absorbing member 1202 comes in contact therewith so as to prevent dust or similar foreign materials in the ink absorbing member 1202 from flowing into the ink jet recording head 1203.

As the ink is taken from the ink absorbing member 1202 through the filter 108, it flows through an ink flow path 1209 to reach an ink discharging orifice 1210 so that it is discharged from the ink discharging orifice 1210 to a recording medium such as a paper or the like in the a arrow-marked direction by actuating ink discharging means (not shown).

As is best seen in FIG. 41, a cutout portion 1212 (serving as a projection relative to the ink absorbing member 1202) is formed below the atmospheric air intake port 1206 on the rear surface of the ink tank cartridge 1201 having the atmospheric air intake port 1206 formed thereon. Thus, a part of the ink tank cartridge 1201, i.e., the space located below the atmospheric air intake port 1206 is removed by forming the cutout portion 1212 in that way.

The arrangement of the cutout portion 1212 in the above-described manner makes it possible to prevent an occurrence of the hitherto known malfunction that the ink absorbing member 1202 is excessively compressed by the atmospheric air intake port 1206.

Specifically, the contact pressure induced by bringing a part of the atmospheric air intake port 1206 in close contact with the ink absorbing member 1202 can be attenuated by the arrangement of the cutout portion 1212. In other words, the ink absorbing member 1202 comes in close contact not only with the atmospheric air intake port 1206 but also with the cutout portion 1212 with an increased contact area. Thus, an occurrence of local excessive compression of the ink absorbing member 1202 can reliably be prevented with the aid of the cutout portion 1212.

Since the cutout portion 1212 is arranged on the rear side of the ink tank cartridge 1201 where the atmospheric air intake port 1206 is formed through the ink tank cartridge 1201, a largest quantity of ink can be filled in the ink tank cartridge 1201 in spite of the reduced interior volume of the latter without irregular distribution of the ink in the ink absorbing member 1202 caused as the ink is increasingly consumed. Thus, ink utilization efficiency of the ink tank cartridge 1201 can be improved with the ink jet recording unit constructed in the above-described manner.

In contrast with the ink jet recording unit wherein ink is locally collected in the vicinity of the atmospheric air intake port, the ink jet recording unit of the present invention can reliably prevent an occurrence of malfunction that the ink undesirably invades in the atmospheric air intake port 1206 and then leaks outside of the ink tank cartridge 1201 through the atmospheric air intake port 1206 in the case that the ink jet recording unit is exposed to a high temperature during transportation thereof or in the case that a temperature cycle ranging from a low temperature to a high temperature is repeated with the ink jet recording unit.

(Embodiment 18 to Embodiment 20)

Figure 43:
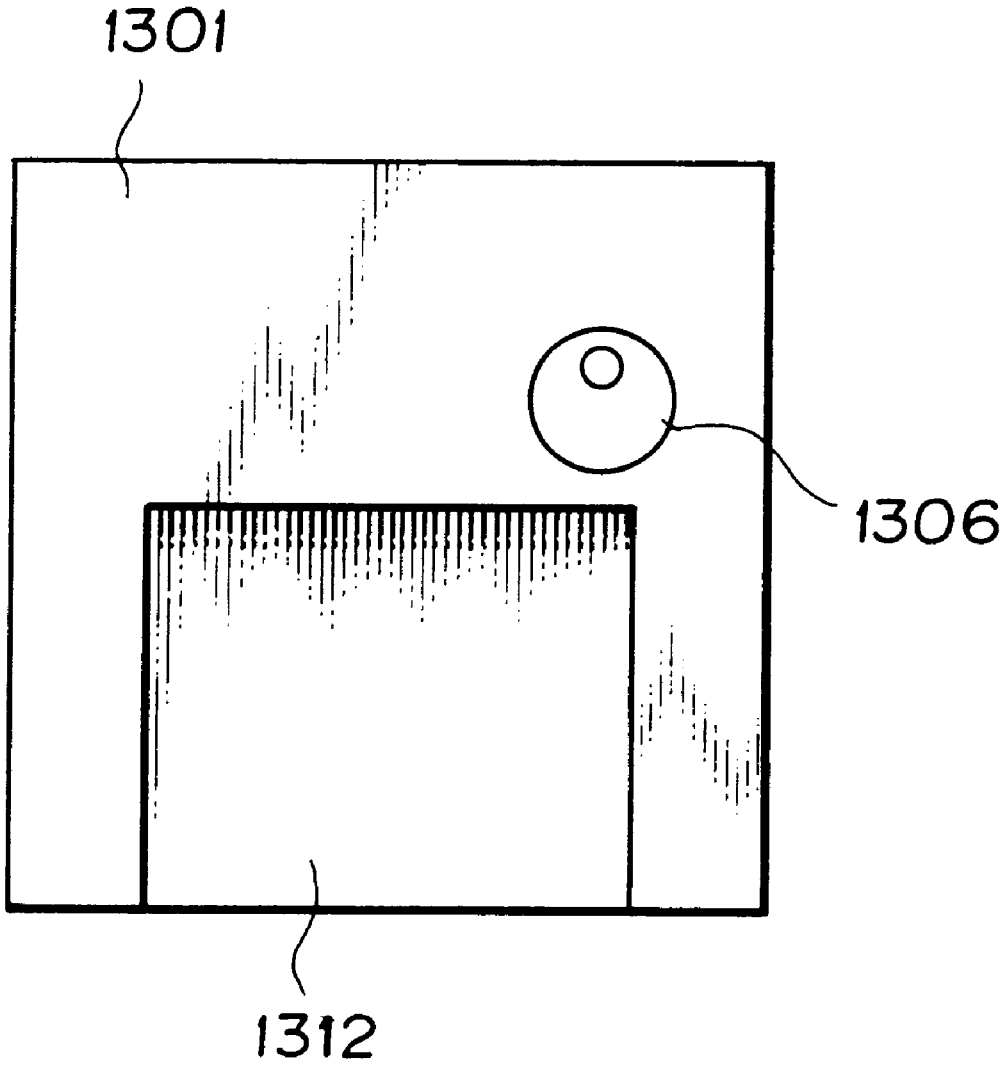
FIG. 43 is a rear view of an ink jet recording unit constructed according to an eighteenth embodiment of the present invention.
Figure 44:
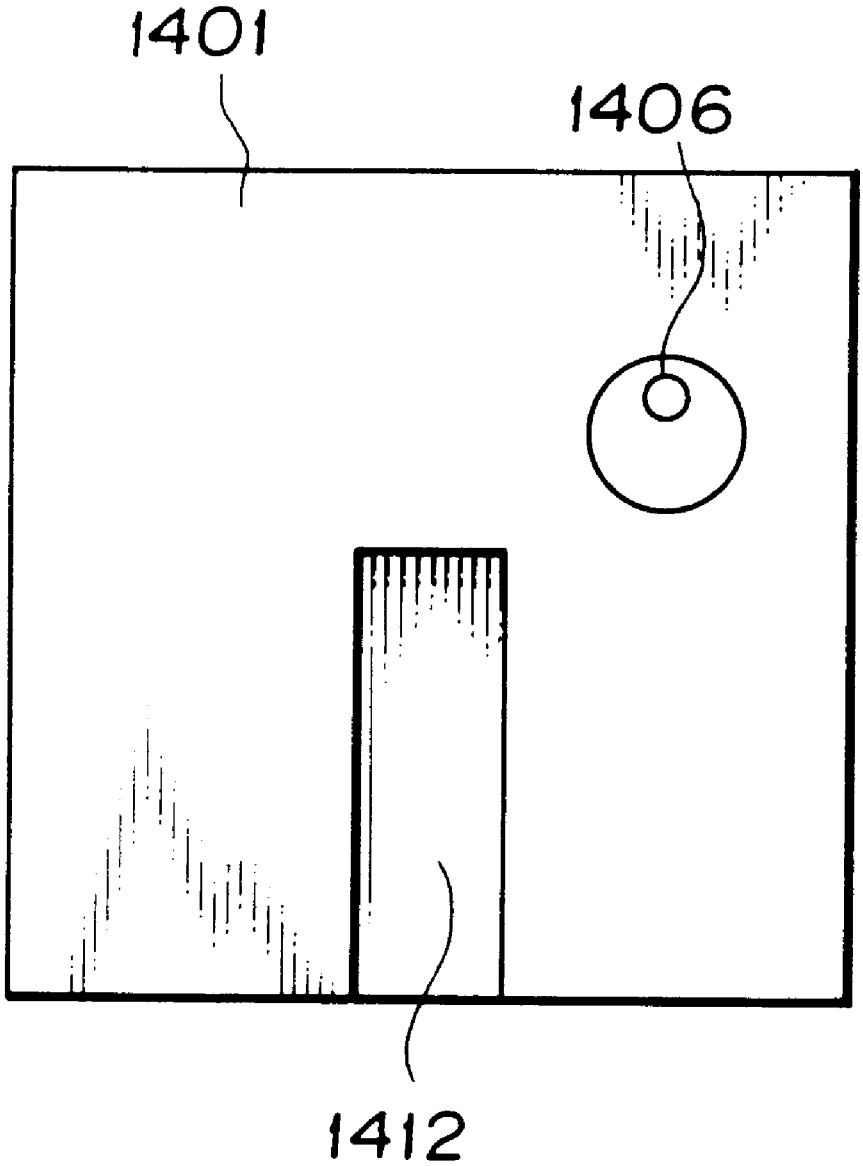
FIG. 44 is a rear view of an ink jet recording unit constructed according to a nineteenth embodiment of the present invention.
Figure 45:
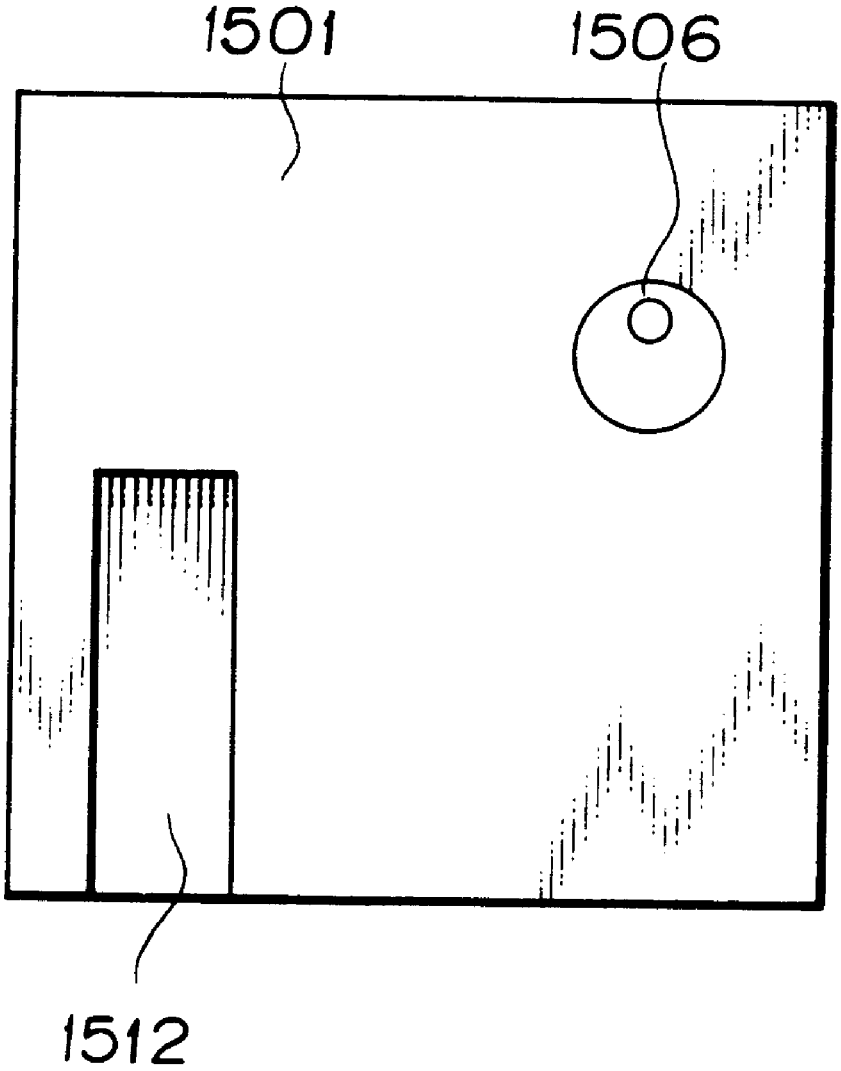
FIG. 45 is a rear view of an ink jet recording unit constructed according to a twentieth embodiment of the present invention.

FIGS. 43 to 45 show by way of rear views the structure of an ink jet recording unit constructed according to each of an eighteenth embodiment of the present invention to a twentieth embodiment of the same.

In FIGS. 43 to 45, reference numerals 1312, 1412 and 1512 designate cutout portions, respectively. The cutout portion 1321 is formed on the rear surface of an ink tank cartridge 1301 having an atmospheric intake port 1306 formed thereon, the cutout portion 1412 is formed on the rear surface of an ink tank cartridge 1401 having an atmospheric air intake port 1406 formed thereon, and the cutout portion 1502 is formed on the rear surface of an atmospheric air intake port 1506 formed thereon.

In the case shown in FIG. 43, the cutout portion 1312 has a wide width as if the cutout portion 1212 shown in FIG. 42 is transversely enlarged as it is.

In the case shown in FIG. 44, the cutout portion 1412 substantially same to the cutout portion 1212 shown in FIG. 42 is formed at the central part of the ink tank cartridge 1401.

In the case shown in FIG. 45, the cutout portion 1512 is formed at the position away from the atmospheric air intake port 1506, i.e, on the left-hand side of the ink tank cartridge 1501 as seen in FIG. 45.

According to each of the eighteenth to the twentieth embodiments, the same advantageous effects as those attainable from the ink tank cartridge 1201 shown in FIG. 40 to FIG. 42 are assured with the ink jet recording unit.

Specifically, the arrangement of the cutout portion 1312, 1412, 1512 shown in FIGS. 43 to 45 makes it possible to enlarge an area of the compressed part of an ink absorbing member (not shown) compressed by bringing the ink absorbing member in close contact with the atmospheric air intake port 1306, 1406, 1506 as well as the cutout portion 1312, 1412, 1512, respectively. Thus, there does not arise a malfunction that a part of the ink absorbing member is locally excessively compressed only by the atmospheric air intake port 1306, 1406, 1506.

Since the cutout portion 1312, 1412, 1512 is arranged along the rear surface of the ink tank cartridge 1301, 1401, 1501 having the atmospheric air intake port 1306, 1406, 1506 formed thereon, a largest quantity of ink can be filled in the ink tank cartridge 1301, 1401, 1501 having a reduced inner volume without an occurrence of irregular dispersion of the ink in the ink absorbing member caused as the ink is increasingly consumed. Thus, ink utilization efficiency of the ink tank cartridge 1301, 1401, 1501 can be improved with the ink jet recording unit.

(Embodiment 21 to Embodiment 23)

An ink jet recording unit constructed according to each of a twenty first embodiment of the present invention and a twenty third embodiment of the same will be described bellow with reference to FIGS. 46 to 48.

Figure 46:
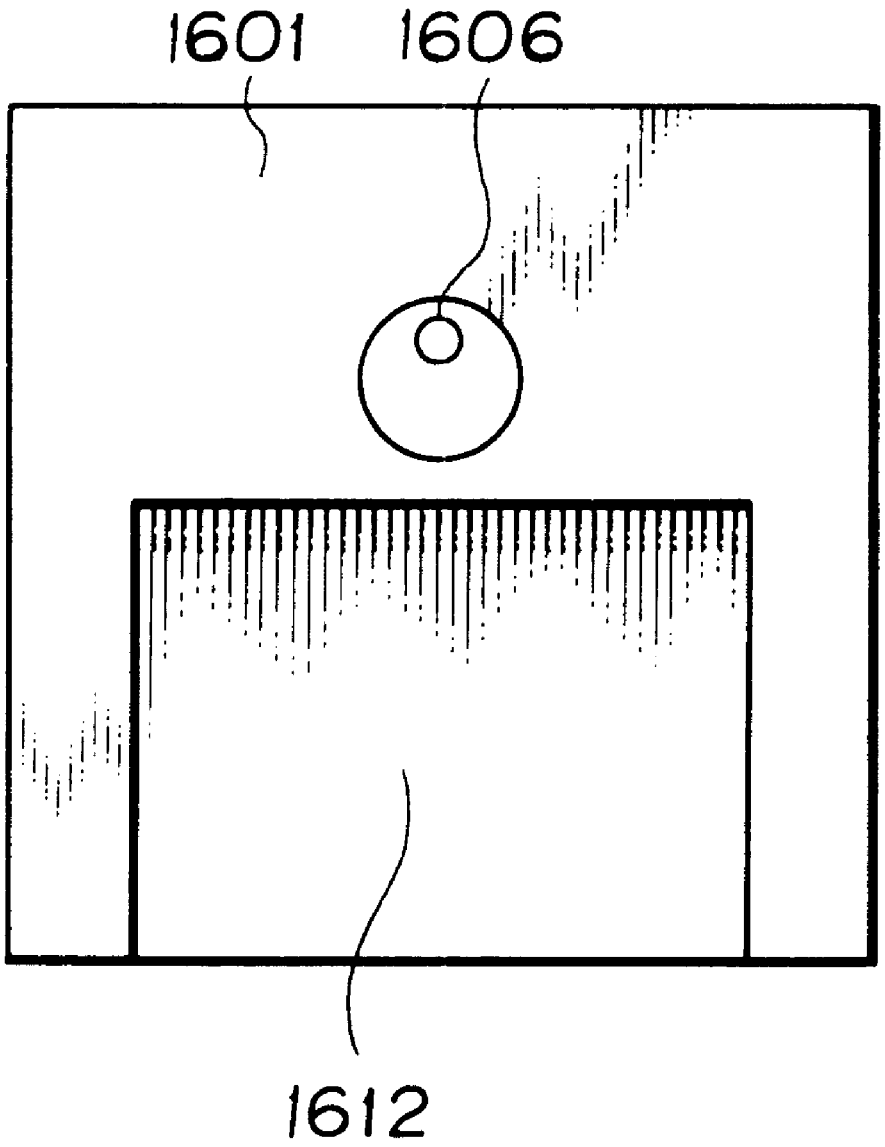
FIG. 46 is a rear view of an ink jet recording unit constructed according to a twenty first embodiment of the present invention.
Figure 47:
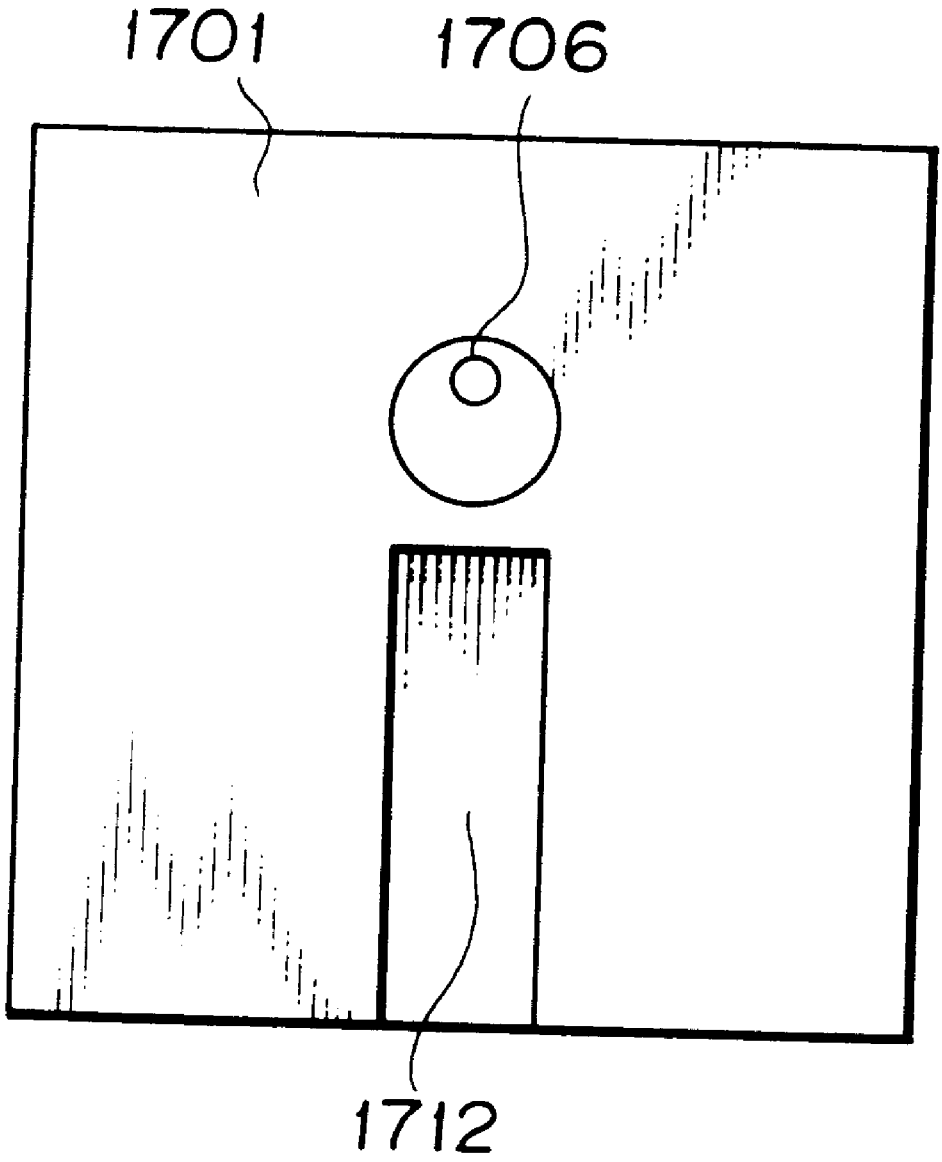
FIG. 47 is a rear view of an ink jet recording unit constructed according to a twenty second embodiment of the present invention.
Figure 48:
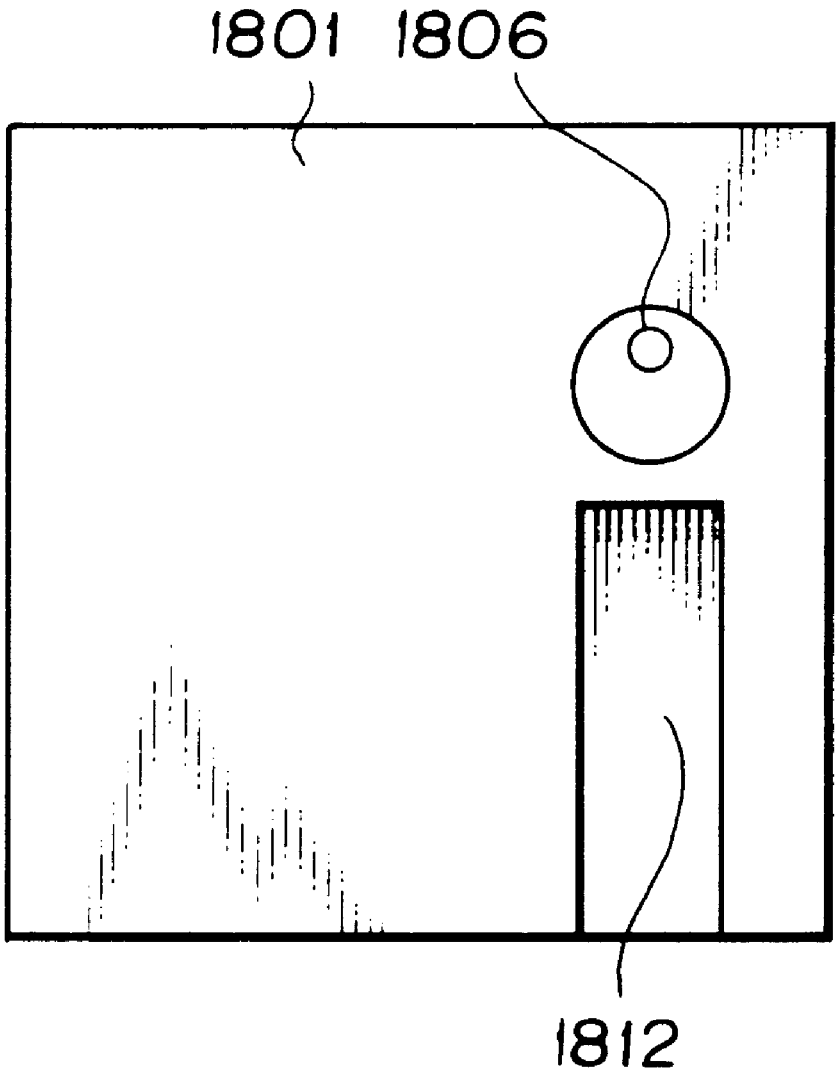
FIG. 48 is a rear view of an ink jet recording unit constructed according to a twenty third embodiment of the present invention.

In the embodiment shown in FIGS. 46 to 48, an atmospheric air intake port 1606, 1706, 1806 is formed at the central location of an ink tank cartridge 1601, 1701, 1801, respectively.

Referring to FIGS. 46 to 48, a cutout portion 1612, 1712, 1812 is arranged on the rear surface of the ink tank cartridge 1601, 1701, 1801 having the atmospheric air intake port 1606, 1706, 1806 formed thereon.

The arrangement of the cutout portion 1612, 1712, 1812 in that way assures the same advantageous effects as those attainable with the ink tank cartridge 1201, 1301, 1401, 1501 as shown in FIG. 40 to FIG. 45.

In each of the aforementioned embodiments, a quantity of projecting of the atmospheric air intake port is substantially equalized to a depth of the cutout portion as measured inside of the rear surface of the ink tank cartridge, and this depth of the cutout portion is determined within the range where the advantageous effects of the ink jet recording unit are assured. Therefore, both the factors, i.e, the quantity of projecting of the atmospheric air intake port and the depth of the cutout portion may slightly be different from each other, provided that the advantageous effects of the ink jet recording unit are not degraded.

The present invention has been described above with respect to the embodiments wherein the ink tank cartridge is exchangeably connected to an ink jet recording head (not shown). Alternatively, the present invention may equally be applied to the case that the ink tank cartridge is integrally connected to an ink jet recording head without any loss of the foregoing advantageous effects.

(Embodiment 24)

An ink tank cartridge for an ink jet recording unit according to a twenty fourth embodiment of the present invention will be described below with reference to FIGS. 51A to 51C.

Figure 51A:
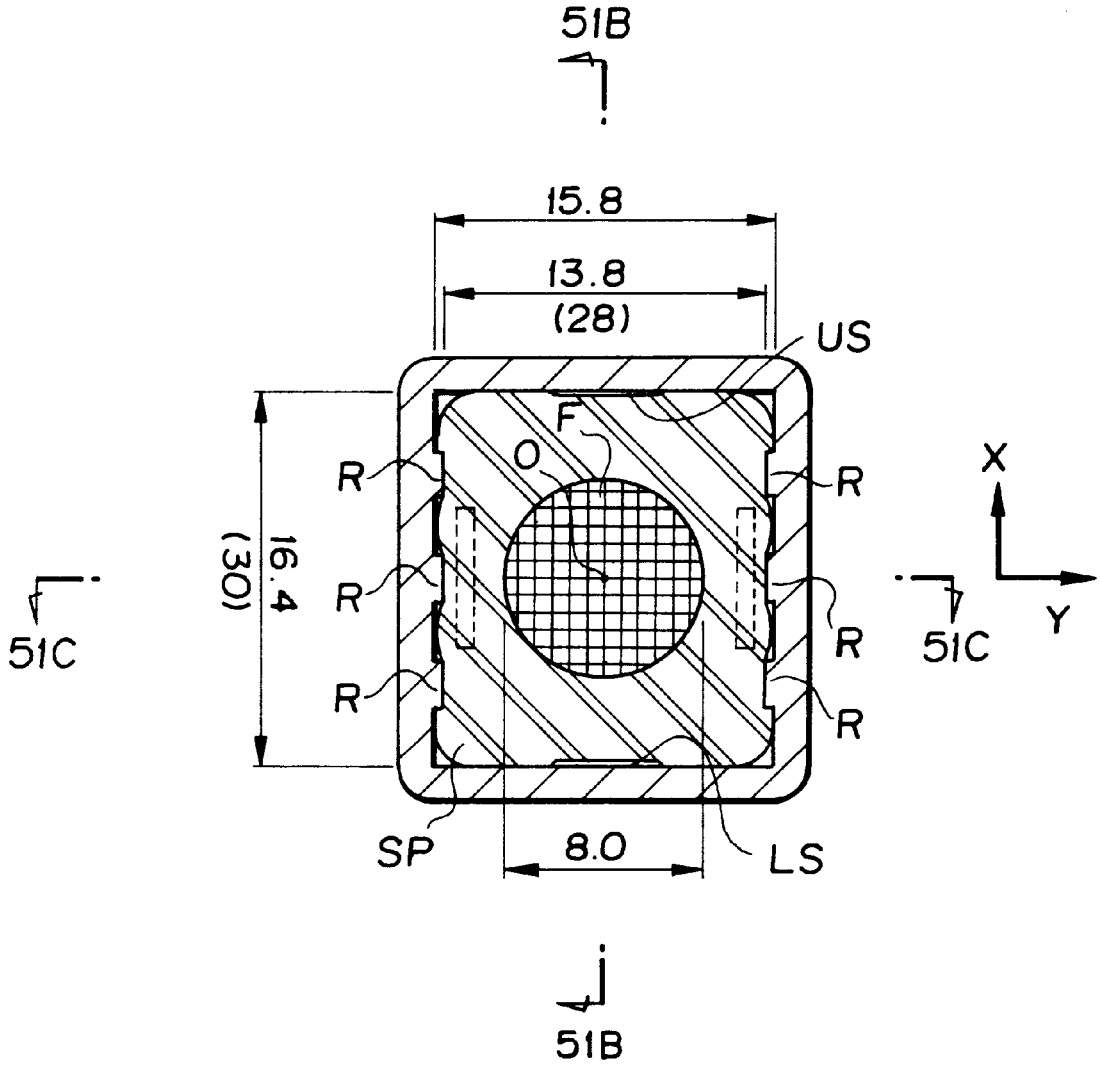
Figure 51B:
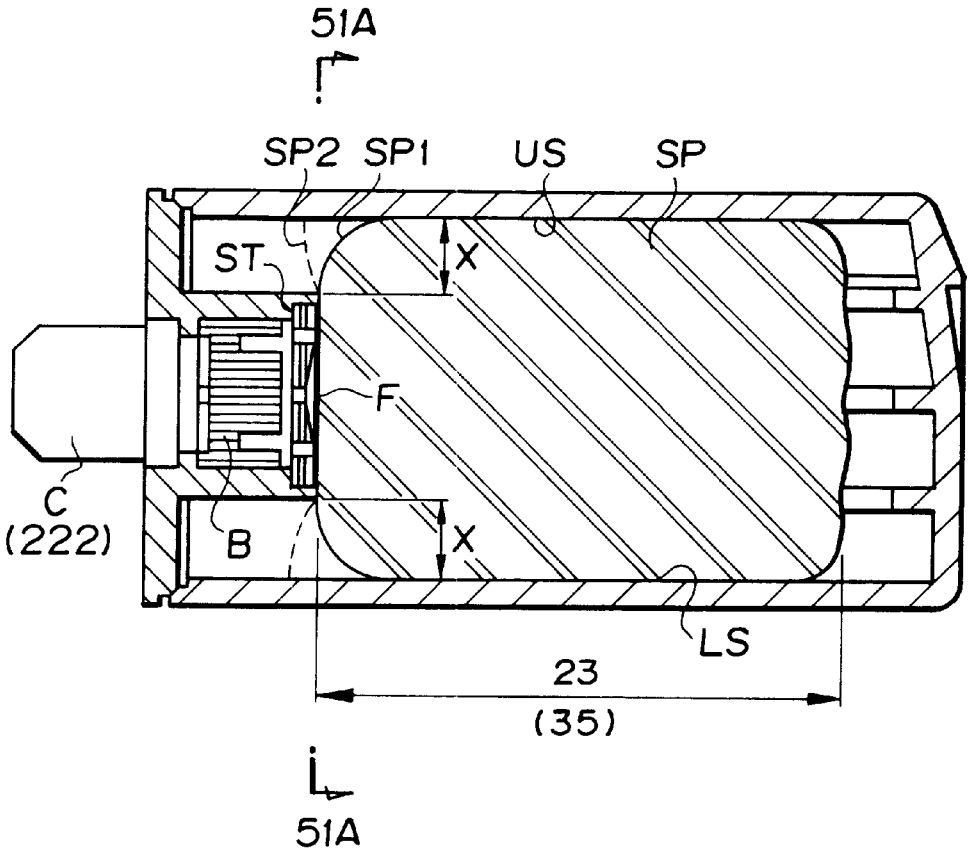
Figure 51C:
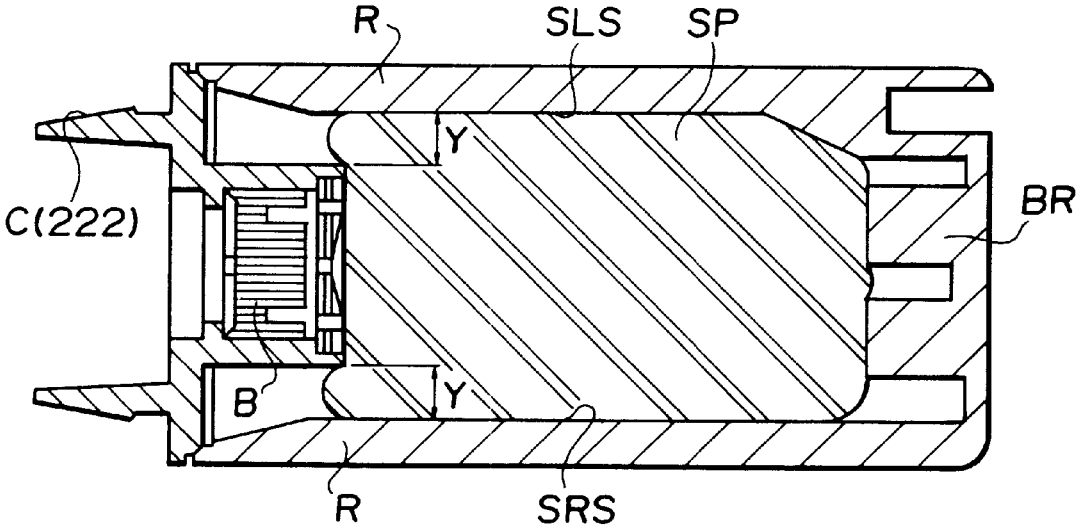

FIG. 51A shows by way of cross-sectional view that an end filter F comes in close contact with a porous member SP which likewise comes in close contact with the surrounding wall of an ink tank cartridge wherein the ink tank cartridge is taken along line 51A—51A in FIG. 51B, FIG. 51B shows by way of sectional view that the ink tank cartridge is taken along a symmetrical plane extending through a center O of the end filter F, i.e., along line 51B—51B in FIG. 51A wherein the ink tank cartridge is viewed in the X arrow-marked direction in FIG. 51A, and FIG. 51C shows by way of sectional view that the ink tank cartridge is taken along another symmetrical plane extending through the center O of the end filter F, i.e., along line 51C—51C in FIG. 51A wherein the ink tank cartridge is viewed in the Y arrow-marked direction in FIG. 51A.

Figure 64A:
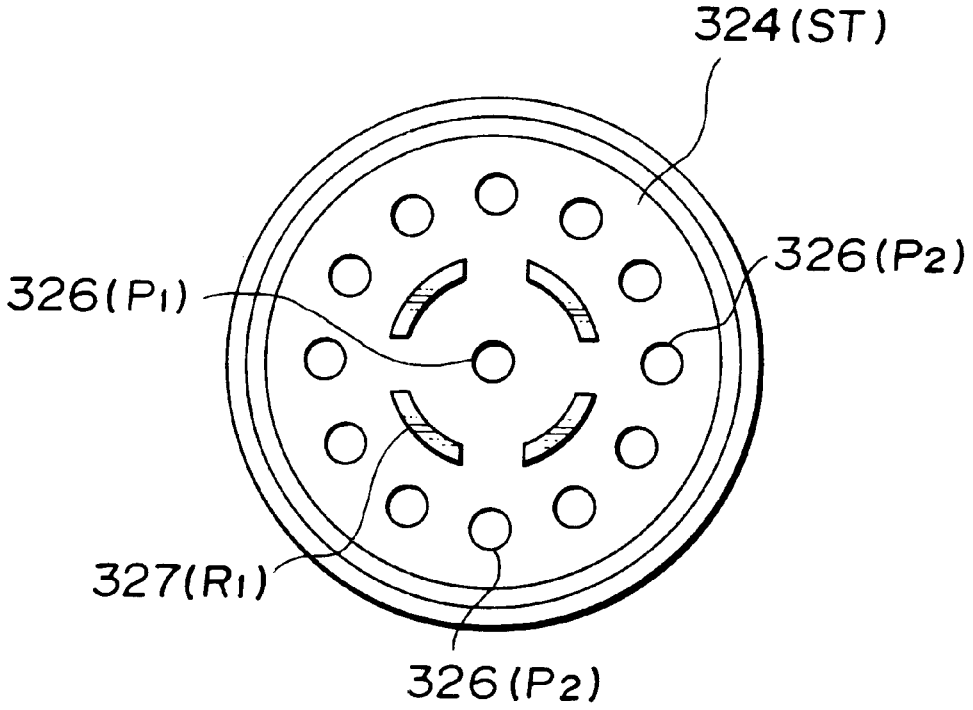
FIG. 64A is a plan view of a filter stopper for the ink tank cartridge to which the present invention is applied.

In the figures, reference character R designates a plurality of ribs each extending in the longitudinal direction by a distance longer than a length of the porous member SP to reach the end filter F as seen from FIG. 51C. In the shown case, three pairs of ribs R are formed along the opposite side walls of the ink tank cartridge. As is apparent from FIG. 51A, the liquid storage container i.e. the ink tank cartridge has two symmetrical planes with respect to the longitudinal cross sectional plane of the porous member SP which includes the center O of the end filter F. While the end filter F comes in close contact with the porous member SP, it is immovably held in the ink tank cartridge. With this construction, since exterior pressure applied to the porous member SP does not vary, feeding of a liquid can be achieved very stably. Reference character C designates a pair of clips for connecting the ink tank cartridge to an ink jet recording head at the time of liquid feeding. The clips C are substituted for a pair of clips 222 on the ink jet recording head side as will be described later. Reference character B designates a valve mechanism which is normally biased toward a joint portion for connecting the ink tank cartridge to an ink jet recording head. When a liquid feed pipe is inserted into the ink tank cartridge, the valve mechanism B is displaced to make communication between the porous member SP with the ink jet recording head via the liquid feed pipe. Reference character BR designates a plurality of rear ribs adapted to come in contact with the rear end of the porous member SP as seen in the longitudinal direction. Reference character ST designates a stopper which serves to hold the end filter F against the front end of the porous member SP while preventing the end filter F from being displaced to the valve mechanism B side. In practice, the stopper ST is designed to exhibit a configuration as shown in FIGS. 64A and 64B.

Figure 64B:
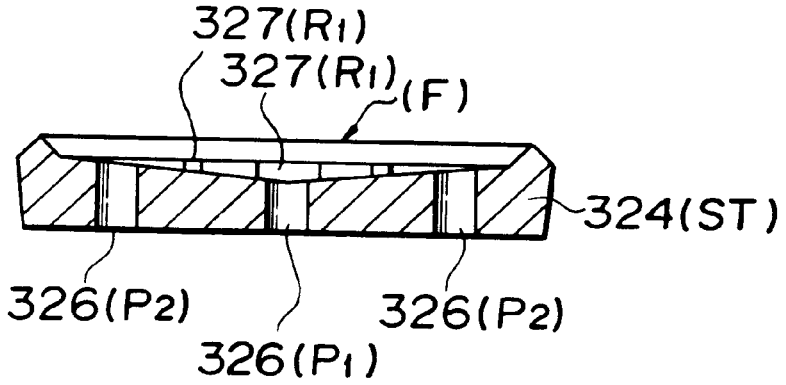
FIG. 64B is a sectional view of the filter stopper shown in FIG. 64A.

In FIG. 64B, reference character (F) designates a plane of the stopper ST along which the end filter F is supported. A plurality of through holes P2 (twelve holes in the shown case) each having a diameter larger than a mesh size of the end filter F are arranged in the equally spaced relationship as seen in the circumferential direction with the center O of the end filter F as a center, and another through hole P1 having the same diameter as that of each hole P2 is formed through the center of the stopper ST. The stopper ST has a flattened inverted conical sectional shape which is contoured such that a distance between the stopper and the end filter F is gradually increased toward the center of the end filter F from the periphery of the same to form a conical space therebetween so as to allow the liquid to be temporarily stored therein. Incidentally, reference character Rl designates a plurality of ribs each serving to suppress the displacement of the end filter F.

The symmetrical planes of the ink tank cartridge will be described below.

The contact range where the end filter F comes in contact with the porous member SP exhibits a circular shape of which center is positionally coincident with the center axis of the ink tank cartridge. As shown in FIG. 51B, an upper wall US of the container and a lower wall LS of the same each serving as a symmetrical plane are spaced away from the outer periphery of the contact range of the end filter F by a shortest-distance X. Similarly, as shown in FIG. 51C, a side wall SLS of the container and a side wall SRS of the same each serving as a symmetrical plane are spaced away from the outer periphery of the contact range of the end filter F by a shortest distance Y. In a typical example, the shortest distance X assumes a value of 4.2 mm, while the shortest distance Y assumes a value of 2.9 mm. When it is assumed that the end filter F has an effective diameter of 8 mm, the foregoing shortest distance X is slightly larger than a radius of 4 mm of the end filter F. In other words, the shortest distance X is increased in excess of the radius of the end filter F by a quantity of 5%. However, this substantial distances X and Y are less than the effective diameter actually, a half of the effective diameter×1.3) of the end filter F. For this reason, the porous member SP is substantially affected by the contact range of the end filter F.

In the foregoing typical example, the porous member SP is dimensioned with respect to the parallelepiped-shaped configuration as shown in FIG. 51A such that the working sectional area of the porous member SP inclusive of the contact range of the end filter F is represented by a width of 28 mm×a height of 30 mm in the non-compressed state but it is represented by a width of 13.8 to 15.8 mm×a height of 16.4 mm in the compressed state wherein the whole surface of the porous member SP is compressed by the periphery of the container. As shown in FIG. 51B, while the end filter F is brought in close contact with the porous member SP, a length of 35 mm of the porous member SP prior to insertion of the latter into the container is reduced to 23 mm after the porous member SP is compressed in that way.

Thus, a compression ratio of the porous member SP can be expressed by (13.5 to 15.8)/28 in the transverse direction, 16.4/30 in the vertical direction, and 23/35 in the longitudinal direction. When the foregoing values are examined in consideration of the working conditions employed for compressing the porous member SP, the compression ratio in the longitudinal direction is smaller than the compression ratio in the transverse direction as well as the compression ratio in the vertical direction, and the compression ratio in the transverse direction is substantially equal to the compression ratio in the vertical direction. In addition, a difference between the compression ratio in the longitudinal direction and the compression ratio in the circumferential direction lies within the range of 0.09 or more to 0.18 or less, while a difference between the compression ratio in the transverse direction and the compression ratio in the vertical direction lies within the substantially same range as mentioned above. Thus, it can be recognized that the porous member SP is substantially uniformly compressed not only in the transverse direction but also in the vertical direction. Consequently, the advantageous effects unattainable with the conventional ink tank cartridge are assured with the ink tank cartridge of the present invention.

Next, FIGS. 52 to 63 schematically show a mechanism advantageously employable for fitting the liquid storage container of the present invention to a specific carriage. In the figures, reference numeral 200 designates an ink jet recording head for discharging ink in response to an electrical signal, reference numeral 201 designates an ink tank cartridge in which the ink is stored and then fed to the ink jet recording head 200, reference numeral 203 designates a carrier which is mounted on an ink jet recording apparatus for holding the ink jet recording head 200 and the ink tank cartridge 201 for the purpose of performing a scanning operation, reference numeral 204 designates a head lever for holding the ink jet recording head 200 and releasing it from the held state, reference numeral 205 designates an ink tank lever for connecting the ink tank cartridge 201 to the ink jet recording head 201 and disconnecting the former from the latter, reference numeral 207 designates a head holder spring for firmly holding the ink jet recording head 200 on the carrier 203, and reference numeral 208 designates an ink tank case for holding the ink tank cartridge 201. An ink jet recording unit and a carrier section for the latter are constituted by the aforementioned components.

Figure 52:
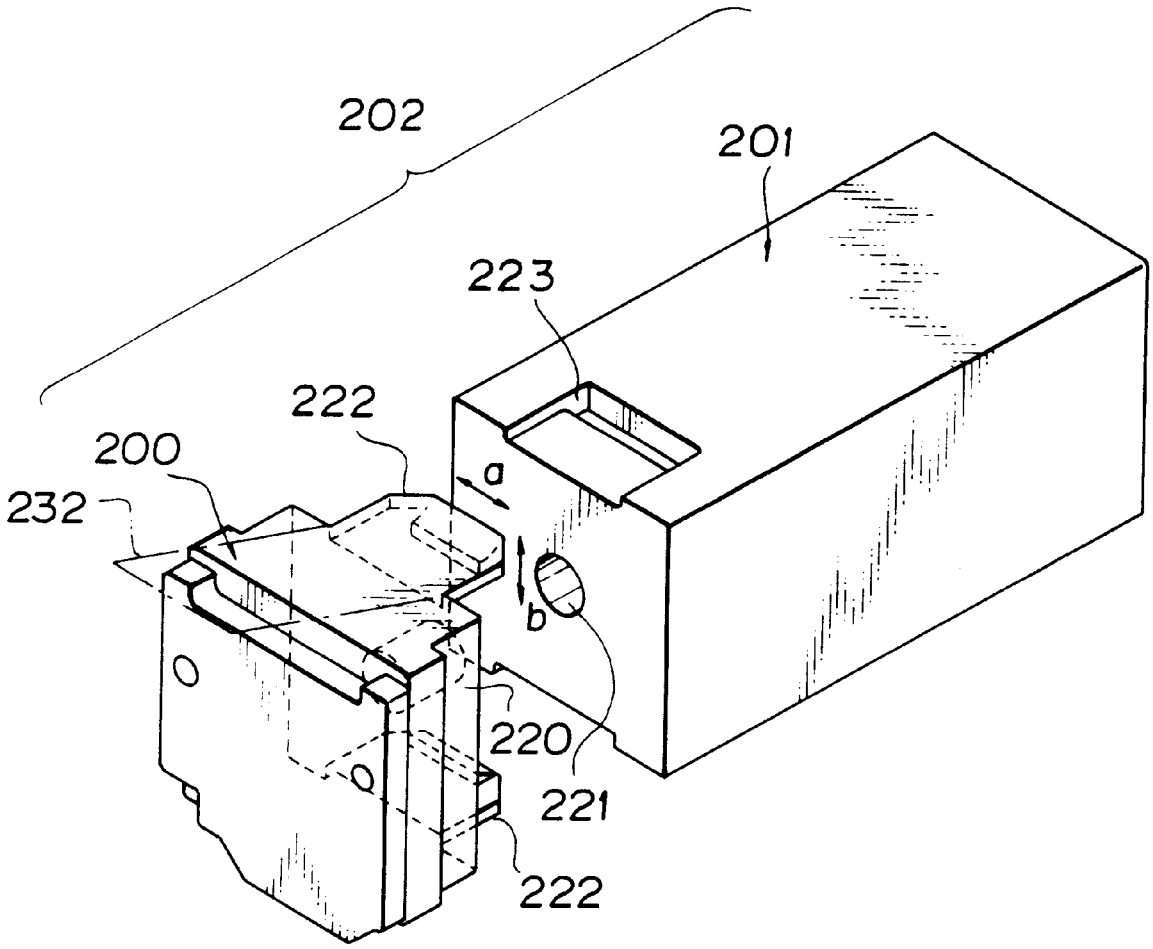
FIG. 52 is a perspective view of an ink jet recording unit constructed according to a twenty fifth embodiment of the present invention, particularly showing essential components constituting the ink jet recording unit in the disconnected state.

FIG. 52 shows by way of perspective view the arrangement of the ink jet recording head 200 and the ink tank cartridge 201. In this figure, reference numeral 220 designates an ink receiving sleeve which has a hole formed therein to serve as a path for feeding ink to the ink jet recording head 200, reference numeral 221 designates an ink feeding hole through which ink is fed from the ink tank cartridge 201 to the ink jet recording head 200, reference numeral 222 designates a connection pawl which serves as guiding means for holding the ink jet recording head 200 and the ink tank cartridge 201 when they are integrally connected to each other, reference numeral 223 designates a guide groove for guiding and engaging the connection pawl 222, and reference numeral 232 designates a head tab for easily performing a taking-out operation when the ink jet recording head 200 is taken out of the carrier 203. An ink jet recording unit 202 is constructed by the aforementioned components.

The ink jet recording head 200 includes a plurality of electrothermal converting elements for generating thermal energy to be utilized for discharging ink, a substrate having a driving circuit formed thereon for driving the electrothermal converting elements, a plurality of discharging orifices and ink paths which are formed on the sabstrate corresponding to the electrothermal converting elements, and a ceiling plate having a common ink chamber formed therein to make communication with the ink paths. The foregoing components are arranged one above another to build a laminated structure. In addition, the ink jet recording head 200 includes electrical contact by way of which a signal outputted from an ink jet recording apparatus is transmitted to the driving circuit. To detect the operative state of the ink jet recording head 200 from the ink jet recording apparatus side, a plurality of sensors (not shown) may be arranged in the ink jet recording head 200. Specifically, a temperature detecting sensor for detecting a temperature in the vicinity of the electrothermal converting element, an ink remaining quantity detecting sensor for detecting that feeding of the ink is interrupted and that no ink is present in the common ink chamber, and a head kind discriminating sensor for specifying the kind of an ink tank cartridge when the ink tank cartridge is exchanged with an ink tank cartridge having a different kind of ink stored therein, and moreover, the ink jet recording head is exchanged with a different kind of ink jet recording head can be noted as typical sensors for the ink jet recording unit 202. In response to signals transmitted from these sensors, the ink jet recording apparatus determines the present operative state of the ink jet recording head 200 in order to properly control a signal to be applied to the electrothermal converting element to optimize each recording operation to be performed.

The ink jet recording unit 202 is mounted on the ink jet recording apparatus in such a manner that an discharging surface having a plurality of ink discharging orifices of the ink jet recording head 200 arranged thereon faces to a recording medium such as a paper or the like.

The ink tank cartridge 201 is prepared in the form of a tank in which ink is stored so as to feed ink to the ink jet recording head 200 for the purpose of compensating a quantity of consumed ink. In the case that the ink tank cartridge 201 is present alone, the ink feeding hole 221 is sealed with sealing means (not shown) for preventing ink from leaking from the ink feed port 221. When the ink jet recording head 200 is integrally connected to the ink tank cartridge 201, the sealing means is automatically or manually disconnected from the ink feeding hole 221 to form an ink path for the ink jet recording head 200. It is recommendable that the sealing means is designed in such a manner as to allow a metallic ball to be normally biased by a coil spring to come in close contact with a rubber plug for the ink feeding hole 221.

To assure that the ink jet recording unit 202 is properly operated, it is desirable that it includes a mechanism for introducing atmospheric air into the ink tank cartridge 201 corresponding to the quality of ink reduced as the ink is increasingly consumed. In addition, it is desirable that the ink jet recording unit 202 includes a mechanism for maintaining the pressure of ink to be fed to the ink jet recording head 200 at a level of slightly negative pressure in order to improve a quality of each recording operation without an occurrence of ink leakage.

In this embodiment, a flexible bag (not shown) having ink stored therein is received in the ink tank cartridge 201 while making communication with the ink feeding hole 221. The space remaining in the ink tank cartridge 201 is filled with air of which pressure is adequately adjusted by a pressure adjusting valve (not shown). Specifically, the pressure adjusting valve serves to generate negative pressure and then maintain it within the predetermined negative pressure range.

To realize a pressure adjusting mechanism with a substantially simplified structure, it is recommendable that an ink absorbing member made of a spongy material is received in the ink tank cartridge 201 so as to allow ink to be contained therein. In this case, since a power for retaining the ink in the ink absorbing member attributable to appearance of a capillary phenomenon is applied to the ink absorbing member, the negative pressure state is automatically generated and maintained when the ink is taken out of the ink absorbing member. To this end, air is taken in the ink tank cartridge 201 from the outside by a quantity corresponding to the volume of consumed ink, an atmospheric air intake port is formed through the ink tank cartridge 201.

While the ink jet recording head 200 and the ink tank cartridge 201 are integrally connected to each other, the ink jet recording unit 202 is mounted on an ink jet recording apparatus to perform a recording operation therewith. Next, a method of integrally connecting the ink jet recording head 200 to the ink tank cartridge 201 will be described below.

Basically, since the ink jet recording head 200 and the ink tank cartridge 201 are integrally connected to each other by jointing the ink receiving sleeve 220 to the ink feeding hole 221, a joint portion is configured so as to avoid a malfunction that ink leaks from the joint portion therebetween or air invades in the ink flow path via the joint portion. In this embodiment, a method of utilizing a solid pipe and a plug made of an elastic material is employed for the ink tank cartridge 201 as shown in FIG. 5. Specifically, the ink receiving sleeve 220 is molded of a synthetic resin to exhibit a cylindrical configuration, while the ink feeding hole 221 to cooperate with the ink receiving sleeve 220 is molded of a rubber in the form of a cylindrical member having a hole formed therethrough. An outer diameter of the ink receiving sleeve 220 is dimensioned to be slightly larger than an inner diameter of the ink feeding hole 221. When the ink receiving sleeve 220 is press-fitted into the ink feeding hole 221, the ink feeding hole 221 is slightly deformed in the radial direction so that the ink receiving sleeve 220 and the ink feeding hole 221 are integrated with each other to exhibit a tightly fitted state.

Incidentally, the joint portion should not be limited only to the combination of a solid material with an elastic material in structure. Alternatively, the combination of a pipe molded of a synthetic resin with a hole molded of a synthetic resin so as to allow the pipe to be sealably fitted into the hole by slight elastic deformation of the pipe and the hole. Otherwise, the joint portion may be constructed by the combination of an injection needle-shaped pipe with a sealing member molded of a rubber without any hole formed therethrough.

When the ink jet recording head 200 and the ink tank cartridge 201 are integrally connected to each other, it suffices that the ink receiving sleeve 220 is jointed to the ink feeding hole 221. To assure that the ink jet recording head 200 is easily not disconnected from the ink tank cartridge 201 when unexpected exterior force is applied to the ink jet recording unit 202 or certain guiding means is available when they are easily integrally connected to each other, in this embodiment, the reliable integral connection of the ink jet recording head 200 to the ink tank cartridge 201 is achieved by fitting the connection pawl 222 into the guide groove 223. The connection pawl 222 is integrally molded of a synthetic resin together with the ink jet recording head including the ink receiving sleeve 220 in such a manner as to be elastically deformed, and a projection is formed at the fore end part of the connection pawl 222. When the connection pawl 222 is fitted into the guide groove 223, the projection of the connection pawl 222 is brought in engagement with a recess formed in the guide groove 223 while the connection pawl 222 is elastically deformed. On completion of the engagement of the-projection of the connection pawl 222 with the recess of the guide groove 223, the integral connection therebetween is achieved.

In addition, the connection pawl 222 serves as guiding means for easily locating the ink receiving sleeve 220 in alignment with the ink feeding hole 221 when the ink jet recording head 200 and the ink tank cartridge 201 are connected to each other. To this end, the connection pawl 222 is dimensioned to have a length longer than that of the ink feeding hole 221 so that the connection pawl 222 comes in contact with the ink tank cartridge 201 before the ink receiving sleeve 220 is fitted into the ink feeding hole 221. A part of the connection pawl 222 is slantwise cut out at the foremost end thereof so that the slantwise cut part of the connection pawl 222 serves as guiding means effective in the a arrow-marked direction for easily fitting the ink receiving sleeve 220 into the ink feeding hole 221. In addition, a part of the projection formed at the fore end part of the connection pawl 222 is slantwise cut out so that the slantwise cut part of the projection serves as guiding means effective in the b arrow-marked direction for easily fitting the ink receiving sleeve 220 into the ink feeding hole 221.

In this embodiment, the connection pawl 222 is arranged on the ink jet recording head 200 side. However, the present invention should not be limited only to this arrangement. Alternatively, the connection pawl 222 may be arranged on the ink tank cartridge 201 side. Otherwise, an opposing pair of connection pawls may be arranged on both of the ink jet recording head 200 and the ink tank cartridge 201.

Next, a method of mechanically and electrically connecting the ink jet recording head 200 to the carrier 203 will be described below with reference to FIGS. 53 and 54.

Figure 53:
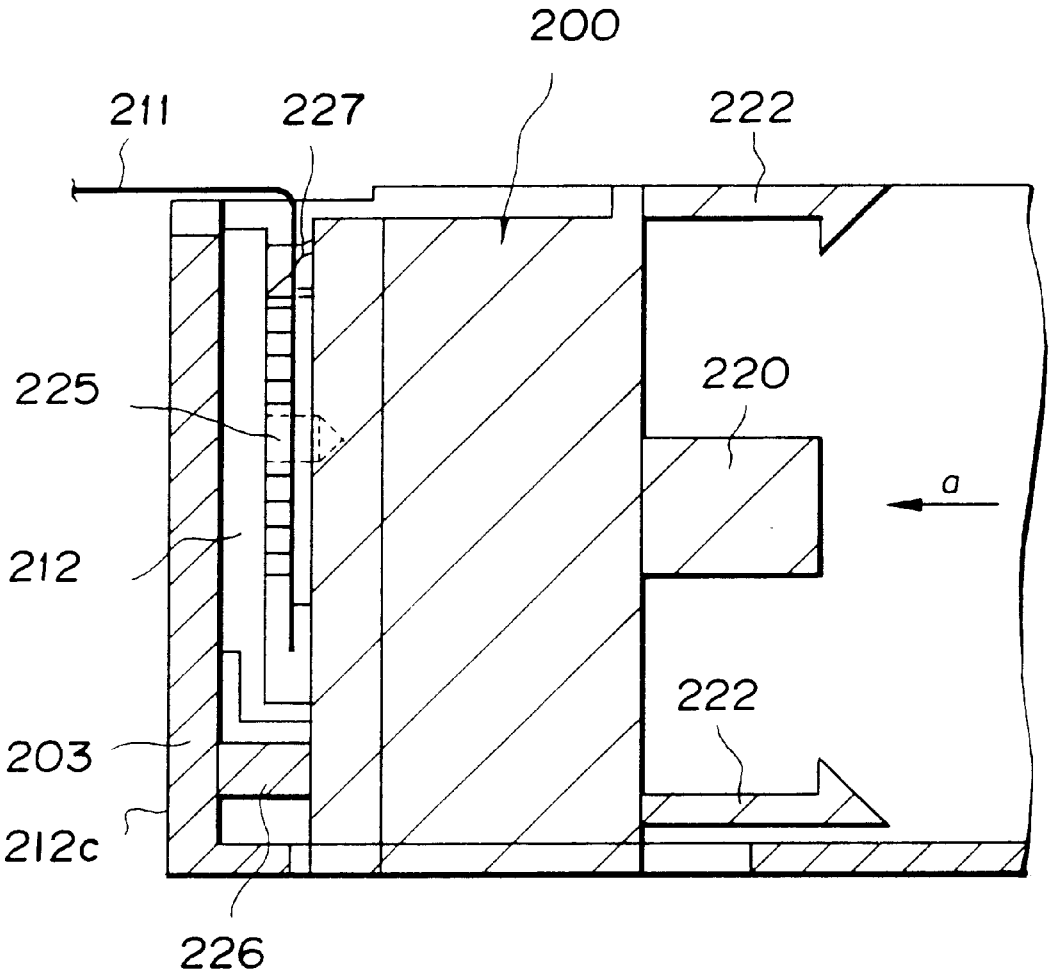
FIG. 53 is a fragmentary enlarged sectional view of the ink jet recording unit shown in FIG. 52, particularly showing a carrier portion attached to the ink jet recording unit.
Figure 54:
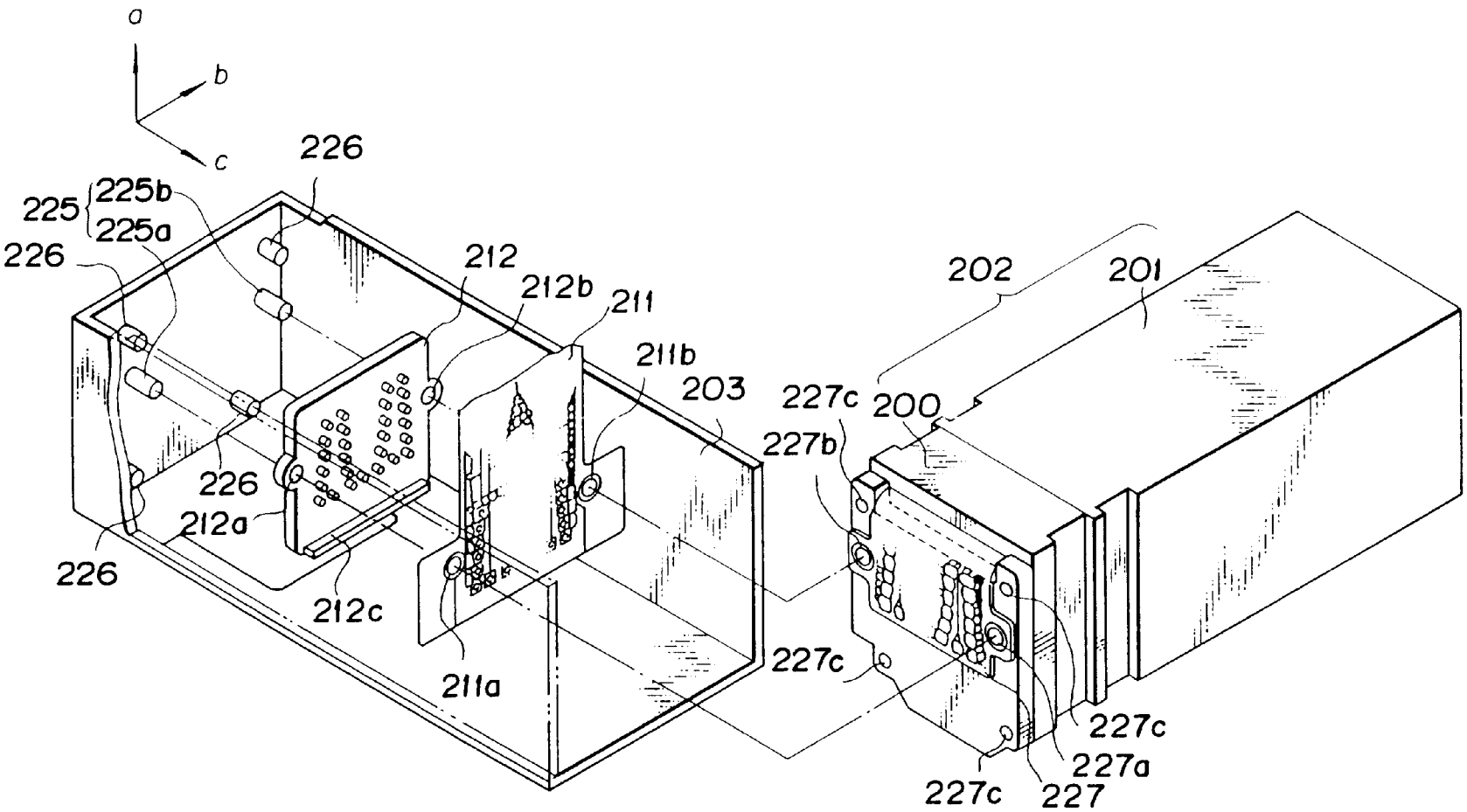
FIG. 54 illustrates by way of a schematic perspective view of the ink jet recording unit shown in FIG. 52, particularly showing how the ink jet recording unit is connected to the carrier portion.

FIG. 53 is a fragmentary sectional view of a joint portion between the ink jet recording head 200 and the carrier 203, and FIG. 54 is a schematic perspective view of the ink jet recording unit, particularly showing how the ink jet recording head 200 is connected to the carrier 203.

In the figures, reference numeral 225 designates a locating pin fixedly secured to the carrier 203 to be fitted into a hole formed in the ink jet recording head 200 so as to correctly locate the head 200 not only in the a arrow-marked direction but also in the b arrow-marked direction as seen in FIG. 54, reference numeral 226 designates a stopper fixedly secured to the carrier 203 to hold the ink jet recording head 200 thrusted in the a arrow-marked direction as seen in FIG. 53, reference numeral 211 designates a flexible cable for electrically connecting an ink jet recording apparatus (not shown) to the ink jet recording head 200, reference numeral 211*a* designates a first locating hole formed through the flexible cable 211, reference numeral 211*b* designates a second locating hole formed through the flexible cable 211, reference numeral 212 designates a flexible cable pad held between the flexible cable 211 and the carrier 203 in the clamped state to elastically support the flexible cable 211, reference numeral 212*a* designates a first locating hole formed through the flexible cable pad 212, reference numeral 212*b* designates a second locating hole formed through the flexible cable pad, reference numeral 212*c* designates an ink barrier for preventing ink from invading in a contact portion, reference numeral 227 designates a head contact portion disposed on the ink jet recording head 200 to be electrically connected to a heater portion in the ink jet recording head 200, reference numeral 227*a* designates a first locating hole formed through the head contact portion 227, reference numeral 227*b* designates a second locating hole formed through the head contact portion 227, and reference numeral 227*c* designates a stopper contact location where the stopper 226 comes in contact with the head contact portion 227.

The ink jet recording head 200 is thrusted in the a arrow-marked direction by the resilient force of a head holder spring 207 with the aid of a lever (not shown), and the position of the ink jet recording head 200 is definitely determined by the holes formed through the ink jet recording head 200, the engaged state of the locating pins 225 relative to the foregoing holes, and the interfered state of the ink jet recording head 200 relative to the stoppers 226. With this construction, the ink jet recording head 200 is mechanically connected to the carrier 203.

In addition, a plurality of electrical contacts are arranged at predetermined positions not only on the head contact portion 227 secured to the ink jet recording head 200 but also on one surface of the flexible cable 211, and when the electrical contacts are thrusted against the ink jet recording head 200 with a predetermined intensity of force, the ink jet recording apparatus is electrically connected to the ink jet recording head 200 via these electrical contacts. At this time, since it is necessary that the electrical contacts are simultaneously thrusted against the ink jet recording head 200, the flexible cable pad 212 molded of an elastic material is inserted into a thrusting section so as to enable the electrical contacts to be uniformly thrusted against the ink jet recording head 200. Usually, the flexible cable pad 212 is molded of a silicone rubber and includes a plurality of projections at the positions corresponding to the electrical contacts, causing a predetermined intensity of thrusting force to be concentratively applied to the respective electrical contacts with the aid of the foregoing projections. Incidentally, each of the electrical contacts arranged on the flexible cable 211 may be designed in a projection-shaped contour in order to assure that they are reliably electrically connected to the ink jet recording head 200 with a more concentratively applied thrusting force.

Since the reactive force arising when the electrical contacts are thrusted against the ink jet recording head 200 is set to be much smaller than the resilient force of the head holder spring 207 adapted to thrust the ink jet recording head 200 against the electrical contacts, there does not arise a malfunction that the ink jet recording head 200 is dislocated from the original position due to the reactive force arising from the flexible cable pad 212.

To maintain reliable electrical connection between the ink jet recording head 200 and the ink jet recording apparatus, and moreover, perform each recording operation at a high quality by activating the ink jet recording head 200, it is required that an assembly of the carrier 203, the flexible cable pad 212, the flexible cable 211, the head contact portion 227 and the recording head unit 202 is exactly arranged at the predetermined position. To meet this requirement, the following measures are taken.

Specifically, while two locating pins 225 are taken as references, one of the locating pins 225*a* is fitted through the first locating holes 212*a*, 211*a* and 227*a* and the other locating pin 225*b* is likewise fitted through the second locating holes 212*b*, 211*b* and 227*b*, whereby the assembly is exactly located not only in the a arrow-marked direction but also in the b arrow-marked direction as seen in FIG. 54.

In addition, the stopper 226 is thrusted in the a arrow-marked direction as seen in FIG. 53 until the end surface of the stopper 226 comes in contact with the stopper contact locatio 227*c*, whereby the position of the ink jet recording head 200 as seen in the c arrow-marked direction of FIG. 54 is exactly determined relative to the carrier 203.

If ink invades in the electrical contact plane, i.e., the space between the flexible cable 211 and the head contact portion 227 for some reason, there arises a problem that electrical short-circuit occurs with the ink jet recording head 200. In this embodiment, to cope with the foregoing problem, a part of the flexible cable pad 212 is designed in a projection-shaped contour to serves as an ink barrier 212C which in turn is brought in contact with the end surface of the' ink jet recording head 200 so as to prevent the ink flowing outside of the discharging orifices of the ink jet recording head 200 from invading in the electrical contact plane.

The present invention has been described above with respect to the embodiment wherein the electrical/mechanism joint portion is located on the ink jet recording head 200 side. However, the preset invention should not be limited only to the embodiment. Alternatively, it may be located on the ink tank cartridge 201 side or it may be located not only on the ink jet recording head 200 side but also on the ink tank cartridge 210 side. Otherwise, the electrical joint portion and the mechanical joint portion may separatively be located on the ink jet recording head 200 and/or the ink tank cartridge 201.

Next, a method of handling the ink jet recording head 200 and the ink tank cartridge 201, i.e., a method of exchanging the ink tank cartridge 201 containing no ink with a new one or exchanging the ink jet recording head 200 kept inoperative for some reason with a new one will be described below with reference to FIGS. 55 to 63.

A first type of exchanging method is practiced such that an ink jet recording head 200 is first released from the fixed state relative to the carrier 203, an assembly of the ink jet recording head 200 integrated with an ink tank cartridge 201 is then removed from the carrier 203 as an ink jet recording unit, and subsequently, the ink jet recording head 200 and the ink tank cartridge 201 are disconnected from or connected to each other in such a state that they are disengaged from the carrier 203 (hereinafter referred to simply as an off-carrier state).

FIG. 55 shows by way of perspective view the case that an assembly of the ink jet recording had 200 and the ink tank cartridge 201 is removed from the carrier 203 as a unit. In this case, a head lever 204 is turned in the a arrow-marked direction to the position where it stands upright as shown in FIG. 55, and subsequently, a cam (not shown) disposed on the head lever 204 displaces a shaft (not shown) which serves to thrust the ink jet recording head 200 therewith, whereby the thrusting force applied to the ink jet recording head 200 disappears.

At this time, since a tank case 208 received in the carrier 203 is displaced while a projection on the tank case 208 comes in contact with the end surface of the ink tank cartridge 201 located on the ink jet recording head 200 side, the assembly of the ink jet recording head 200 and the ink tank cartridge 201 is displaced as an integrated unit in the b arrow-marked direction as seen in FIG. 55. Thus, while locating pins 225 are disengaged from the corresponding holes formed on the ink jet recording head 200, the ink jet recording head 200 and the ink tank cartridge 201 can be displaced as an integrated unit in the c arrow-marked direction as seen in FIG. 55 to assume an off-carrier state. At this time, the head tab 232 secured to the ink jet recording head 200 is seized with user's fingers and it is then raised up so that the whole head cartridge 202 (ink jet recording unit) can easily be removed from the carrier 203. It should be noted that the head tab 232 is molded of a flexible material (e.g., polyester resin), and at least a part of the head tab 232, i.e., the surface of the same coming in contact with the flexible cable 211 is made of an electrical insulative material. While a recording operation is performed, the head tab 232 is interposed between the head lever 205 and the flexible cable 211 so as to protect the flexible cable 211 from damage or injury, and at the same time, make electrical insulation relative to the outside. After the off-carrier state is assumed, a certain intensity of force effective in the opposite direction to the connecting direction at the time of connection of the ink jet recording head 200 to the ink tank cartridge 201 is applied to the assembly of the ink jet recording head 200 and the ink tank cartridge 201 so as to enable the ink jet recording head 200 to be disconnected from the ink tank cartridge 201. Subsequently, a new ink tank cartridge to be exchanged with the ink tank cartridge 201 is integrated with the ink jet recording head 200 so that an assembly of the ink jet recording head 200 and the new ink tank cartridge is received in the carrier 203 in accordance with the order reverse to the aforementioned one. On completion of the receipt of the foregoing assembly, an exchanging operation is completed.

In this embodiment, the ink jet recording head is released from the thrusted state by turnably actuating the head lever 204. However, the present invention should not be limited only to this embodiment. Alternatively, the lever for thrusting the ink jet recording head 200 may directly be displaced by actuating certain means. In addition, the ink jet recording head fixing method is practiced such that the ink jet recording head 200 is thrusted by the head holder spring 207. However, the present invention should not be limited only to the foregoing method. Alternatively, the ink jet recording head 200 may fixedly be secured with the aid of a latch hook or the like.

In the case that the first type of exchanging method is employed for the ink jet recording unit, advantageous effects as noted below are obtainable with this method.

Specifically, in the case that it is required that either one of the ink jet recording head and the ink tank cartridge is exchanged with a new one, it suffices that only one of them which should be exchanged with a new one is practically exchanged with it, resulting in an economical efficiency of the ink jet recording unit being improved.

A second type of exchanging method is practiced such that only the ink tank cartridge 201 is removed from the carrier 203 by disconnecting the ink tank cartridge 201 from the ink jet recording head 200 on the carrier 203 in such a state that the ink jet recording head 200 is firmly held on the carrier 203 (hereinafter referred to simply as an on-carrier state).

Figure 56:
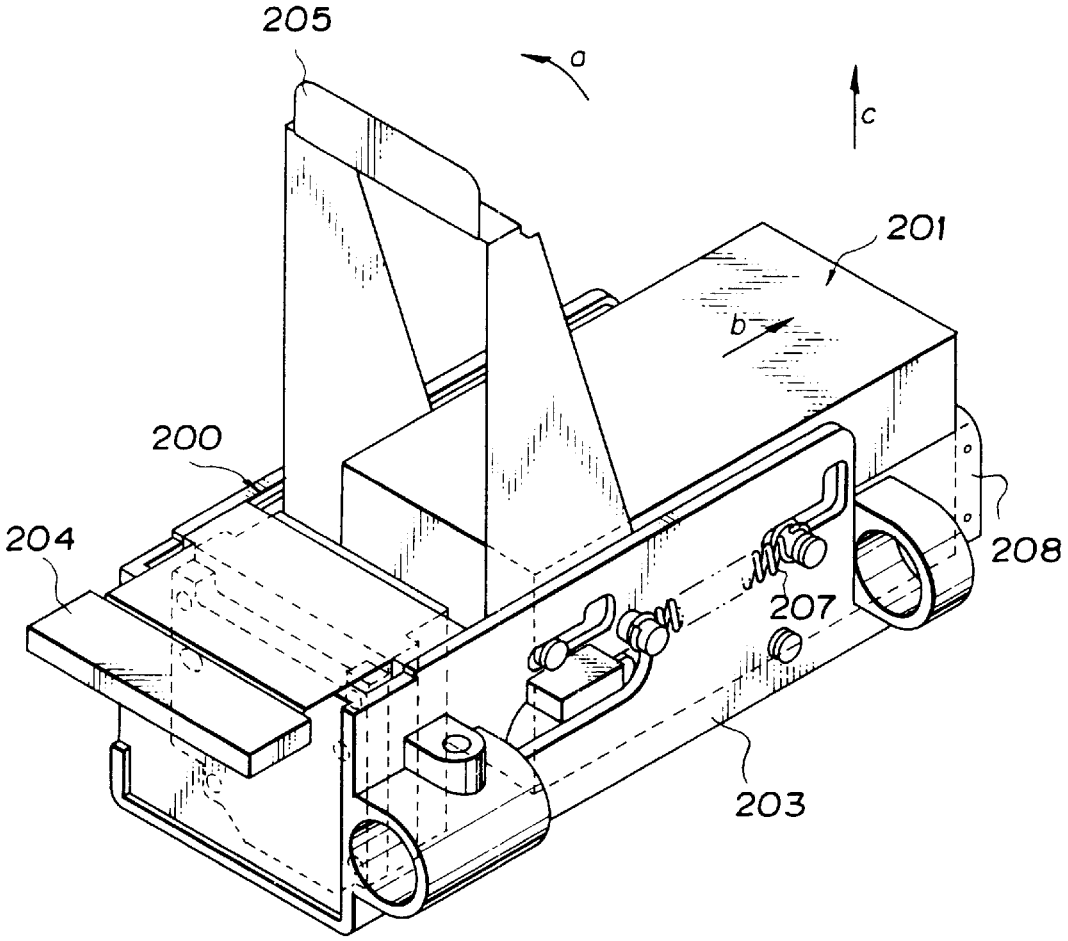
FIG. 56 is a perspective view of the ink jet recording unit shown in FIG. 52, particularly showing that the ink jet recording unit is exchanged with another one in a second type of fashion.

FIG. 56 shows by way of perspective view that the ink tank cartridge 201 is disconnected from the ink jet recording head 200 on the carrier 203. In this case, a cam (not shown) disposed on the tank lever 205 serves for displacing the tank case 208 in the b arrow-marked direction as seen in FIG. 56 by turning the tank lever 205 in the a arrow-marked direction to reach the shown position where it stands upright. While a projection on the tank case 208 comes in contact with the end surface of the ink tank cartridge 201 on the ink jet recording head 201 side, the ink tank cartridge 201 is displaced in the b arrow-marked direction. At this time, since both of the ink jet recording head 200 and the ink tank 201 are not displaced together at all, the joint portion between the ink jet recording head 200 and the ink tank cartridge 201 is released from the connected state. Thus, the ink tank cartridge 201 can be disconnected from the ink jet recording head 200. Subsequently, the ink tank cartridge 201 can be removed from the carrier 203 by displacing it in the c arrow-marked direction as seen in FIG. 56.

On the contrary, when-a new ink tank cartridge 201 is connected to the ink jet recording head 200, it is inserted into the tank case 208 and the tank lever 205 is then actuated in accordance with the order reverse to the aforementioned one. This causes the tank case 208 to thrust the ink tank cartridge 201 at the rear end of the latter, whereby the ink tank cartridge 201 can be connected to the ink jet recording head 200 by the thrusting power given by the tank case 208.

In the case that the ink jet recording head 200 is resiliently thrusted by the head holder spring 207 that is the case with the preceding embodiment, there may arise a problem that the ink jet recording head 200 is released from the fixed state when the thrusting power is eccentrically applied to the ink tank cartridge 201. To cope with the foregoing problem, it is recommendable that a measure as noted below is taken.

Figure 57:
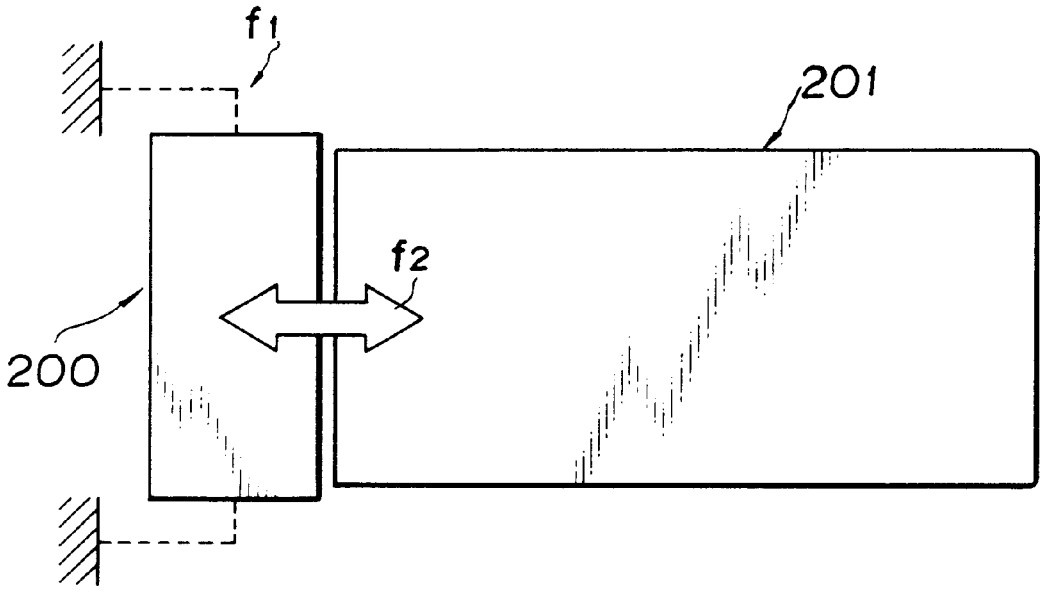
FIG. 57 is a schematic plan view of the ink jet recording unit shown in FIG. 52, particularly showing how a force is applied to the ink jet recording unit.
Figure 58:
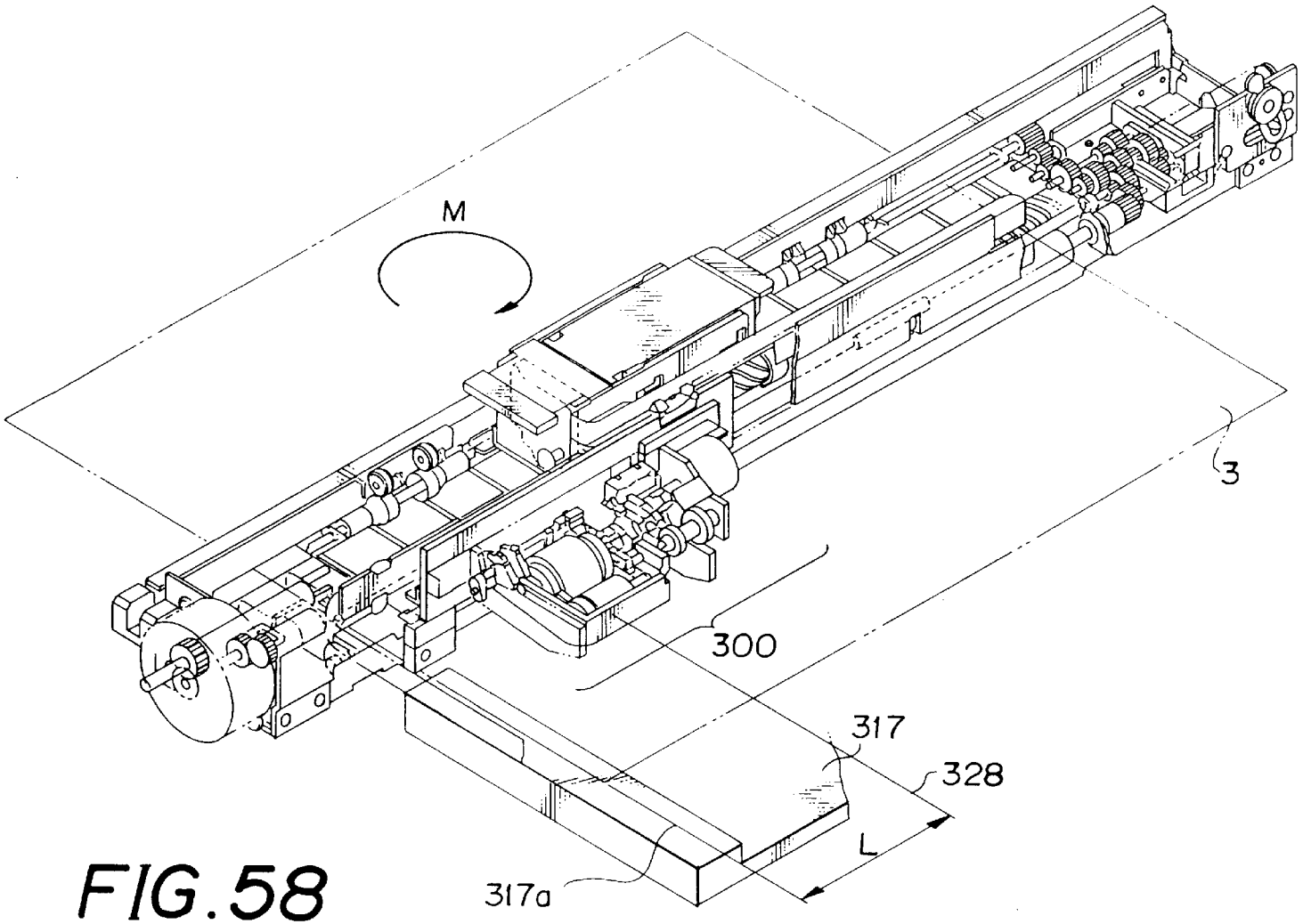
FIG. 58 is a perspective view of the ink jet recording apparatus shown in FIG. 50A, particularly showing an automatic paper feeding section for the ink jet recording apparatus.

FIG. 57 is a schematic plan view of the ink jet recording unit, particularly showing how the thrusting force is applied to the ink jet recording head 200 via the ink tank cartridge 201. Referring to FIG. 57, the ink jet recording head 200 is thrusted against the carrier 203 with a force of $f_1$ by the head holder spring 207. To disconnect the ink tank cartridge 201 from the ink jet recording head 200, it is necessary that the connection pawl 222 is disengaged from the guide groove 223 and the ink receiving sleeve 220 is disconnected from the ink feeding hole 221 with a force of $f_2$. At this time, when the relationship between the force $f_1$ and the force $f_2$ is determined so as to establish an inequality of $f_1>f_2$ therebetween, there does not arise a malfunction that the ink jet recording head 200 is released from the fixed state during the disconnecting operation.

In this embodiment, the force corresponding to the magnitude of force $f_2$ is generated by turnably actuating the tank lever 205 in order to disconnect the ink tank cartridge 201 from the ink jet recording head 200. However, the present invention should not be limited only to this embodiment. The ink tank cartridge 201 may be disconnected directly from the ink jet recording head 200 by pulling the ink tank cartridge 201 in the b arrow-marked direction as seen in FIG. 56 while it is seized by user's fingers.

When the second type of exchanging method is employed for the ink jet recording unit, advantageous effects as noted below are obtainable with this method in addition to those attainable in the case that the first type of exchanging method is employed.

Specifically, when the ink tank cartridge 201 is disconnected from the ink jet recording head 200, drawing speed can adequately be controlled by designing the cam on the tank lever 205 to another contour more advantageously acceptable for the purpose of disconnection, and moreover, there does not arise a malfunction that ink is scattered away from the ink receiving sleeve 220 and/or the ink feeding hole 211.

In addition, since there is no need of seizing the ink jet recording head 200 directly with user's fingers, there is no possibility that a user's hand is brought in contact with the location in the vicinity of the ink discharging orifices of the ink jet recording head 200. Thus, there does not arise a malfunction that the ink discharging orifices are uselessly contaminated with ink, resulting in a qualiity of recording being degraded.

Further, since the location where the thrusting force is applied to the ink tank cartridge 201 is specifically determined, it suffices that only the foregoing location is reinforced enough to stand against the thrusting force. Thus, the other part rather than the foregoing location is designed to have a small thickness while maintaining a light weight. This makes it possible to enlarge the working volume of the ink tank cartridge 201.

Next, in connection with this embodiment, description will be made below with respect to a method of preventing the ink tank cartridge 201 from being erroneously inserted into the tank case 208 received in the carrier 203. The ink tank cartridge 201 includes an end surface having an ink feeing port 221 formed thereon so as to be connected to the ink jet recording head 200 and another end surface located opposite to the foregoing one. The direction of inserting the ink tank cartridge 201 into the tank case 208 is restrictively determined depending on the direction of fitting the connection pawl 222 into the guide groove 223. In this embodiment, to preliminarily determine the inserting direction, a projection is formed on the tank case 208 side, while a recess adapted to receive the projection therein is formed on the ink tank 201 side.

Figure 59:
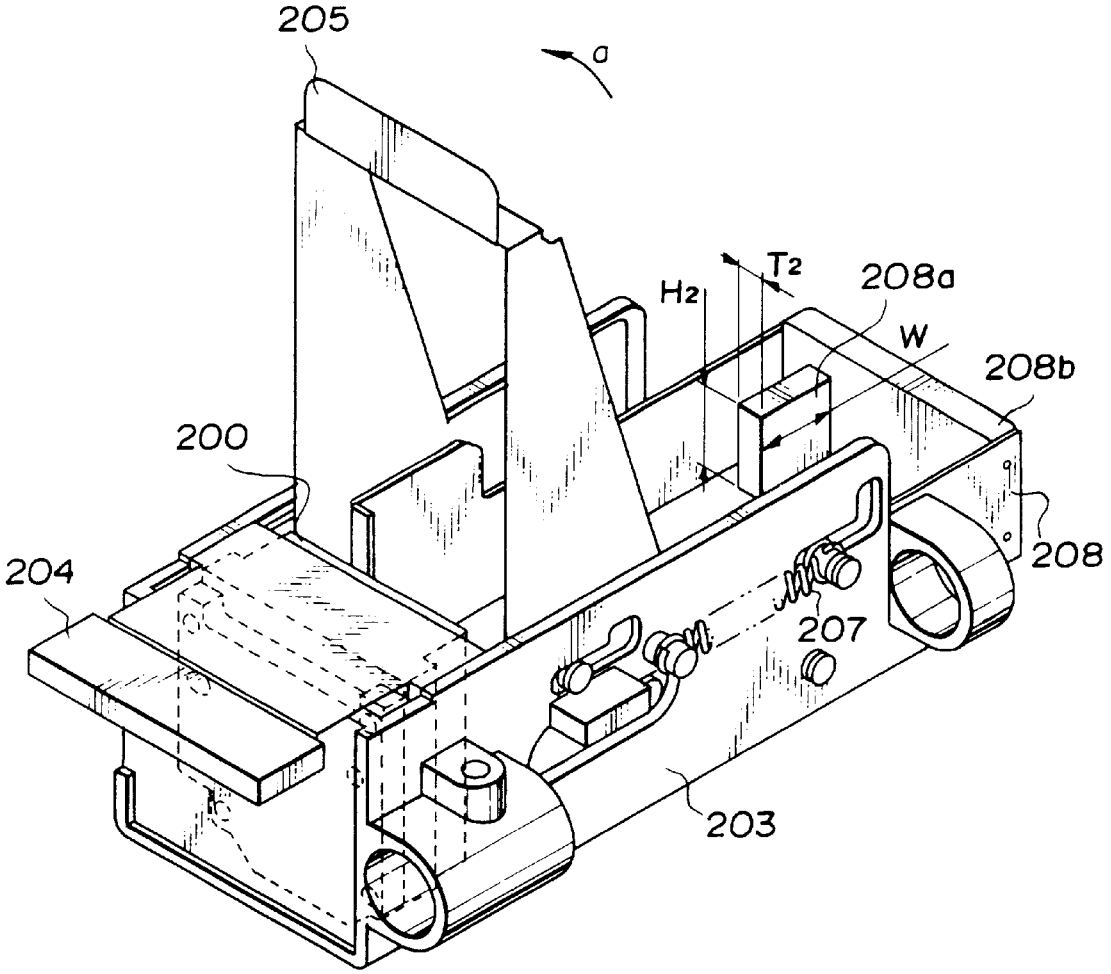
FIG. 59 is a perspective view of the printer cartridge shown in FIG. 50B, particularly showing that an ink tank cartridge is disconnected from the carrier.

FIG. 59 shows by way of perspective view the structure of the tank case 208. In this figure, reference numeral 208*a* designates a tank case end projection projecting inside of the tank case 208 to reach the location to which the ink tank 201 is inserted into the tank case 208, and reference numeral 208*b* designates a tank case end which serves to thrust the ink tank cartridge 201. The rear end part of the tank case 208 is dimensionally defined by the tank case end projection 208*a* and the tank case end 208*b*. The tank case end projection 208*a* exhibits a parallelepiped-shaped contour, but is not limited to, and is dimensioned to have a height of $H_2$, a width of $W_2$, and a thickness of $T_2$.

Figure 60:
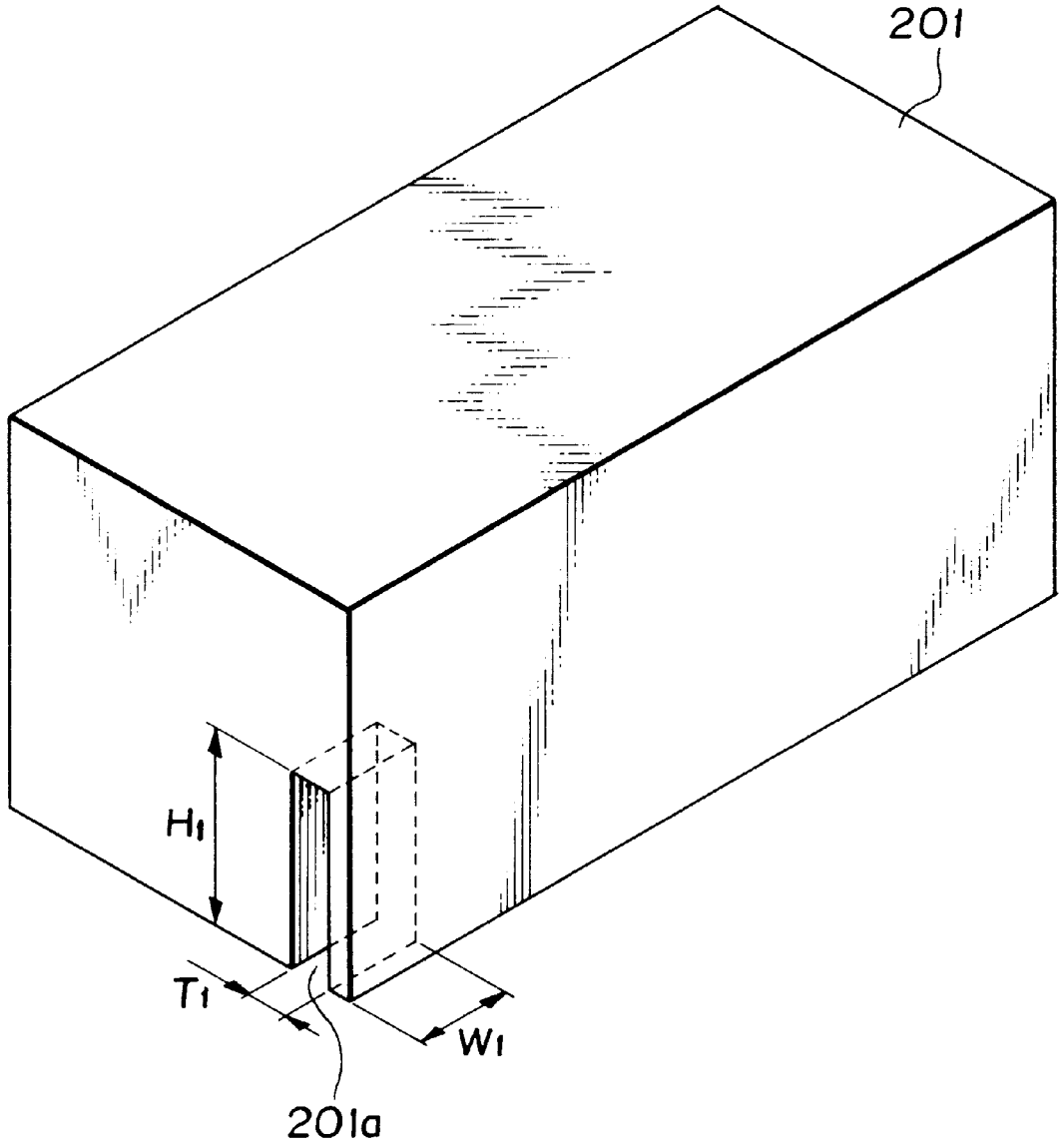
FIG. 60 is a perspective view of an ink tank carriage for the ink jet recording unit shown in FIG. 52, particularly showing the ink tank cartridge as viewed from the opposite side to the ink jet recording head fitting side.

FIG. 60 is a schematic perspective view of the ink tank 201 as seen in the opposite direction relative to the direction of connecting the ink jet recording head 200 (not shown) to the ink tank cartridge 201. In the figure, reference numeral 201*a* designates an ink tank slit or a cutout which is recessed inside of the ink tank cartridge 201. The ink tank slit 201*a* exhibits a parallelepiped-shaped contour and is dimensioned to have a height of $H_1$, a width of $W_1$ and a depth of $T_1$. Incidentally, the three dimensional contour of the ink tank slit 201*a* should not be limited only to a parallelepiped-shaped one.

The arrangement of the tank case end projection 208*a* and the ink tank slit 201*a* in that way restrictively determines the direction of inserting the ink tank cartridge 201 into the ink tank case 208. When the ink tank cartridge 201 is correctly inserted into the ink tank case 208, the ink tank end projection 208*a* is received in the ink tank slit 201*a*, then the ink tank cartridge 201 is received in the tank case 208. In the case that the ink tank cartridge 201 is incorrectly inserted for some reason, the tank case end projection 208 interferes with the ink tank cartridge 201, resulting in the ink tank cartridge 201 failing to be inserted into a predetermined-position. This makes it possible for a user to recognize that he or she has inserted the ink tank cartridge 201 a wrong direction. Thus, there does not arise a malfunction that the ink jet recording apparatus is damaged or broken due to the incorrect insertion of the ink tank cartridge 201.

Figure 61:
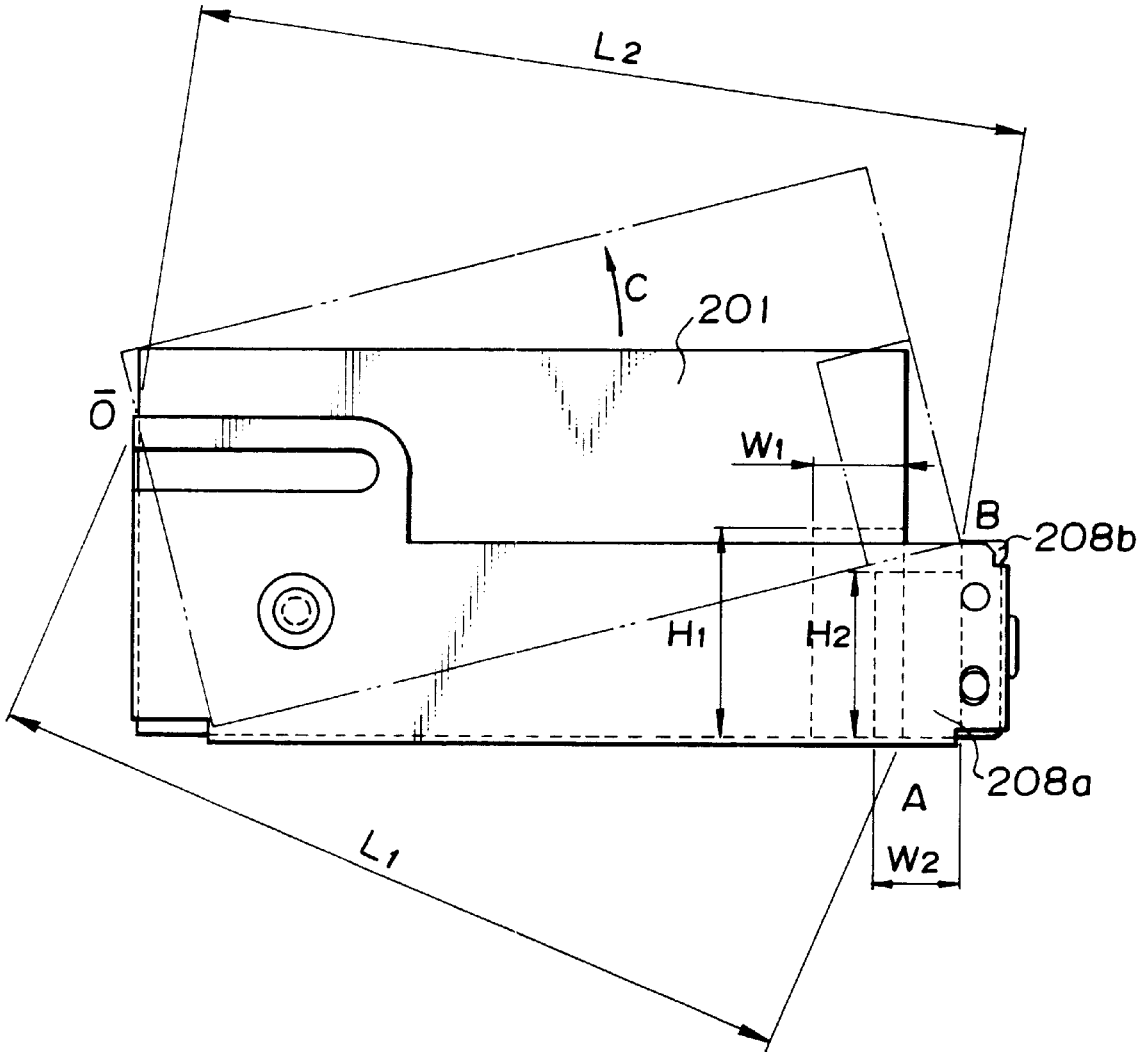
FIG. 61 is a schematic fragmentary front view of the ink jet recording unit shown in FIG. 52, particularly showing dimensions of an ink tank case.

Next, description will be made below with respect to dimensional restriction on the tank case 208 and the ink tank cartridge 201. FIG. 61 shows by way of schematic side view the dimensional relationship between the tank case 208 and the ink tank cartridge 201. In the figure, a position O represents a center of turning movement about which the ink tank cartridge 201 is turned in the anticlockwise direction, i.e., in the c arrow-marked direction as seen in the figure, a position A represents a lower corner on the right-hand side, opposite to the ink jet recording head side, of the ink tank cartridge 201, a position B designates an upper corner of the tank case end 208*b*, a length $L_1$ represents a distance as slantwise measured from the position O to the position B, and a length $L_2$ represents a distance slantwise measured from the position O to the position B.

Figure 62A:
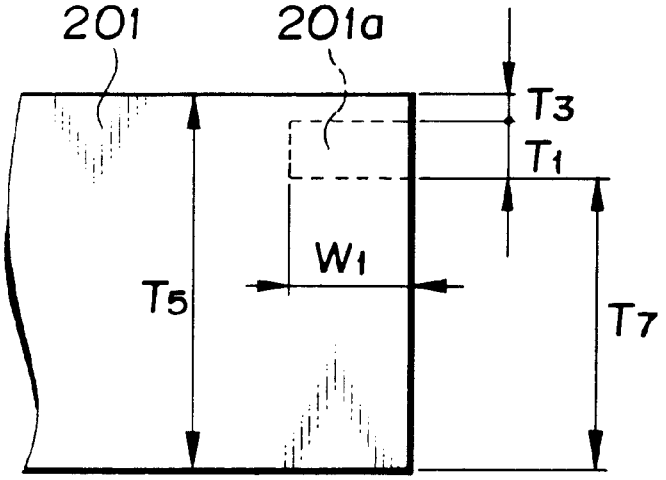
FIG. 62A and FIG. 62B show by way of fragmentary plan views dimensions of the ink tank case and the ink tank cartridge for the-ink jet recording unit shown in FIG. 52.
Figure 62B:
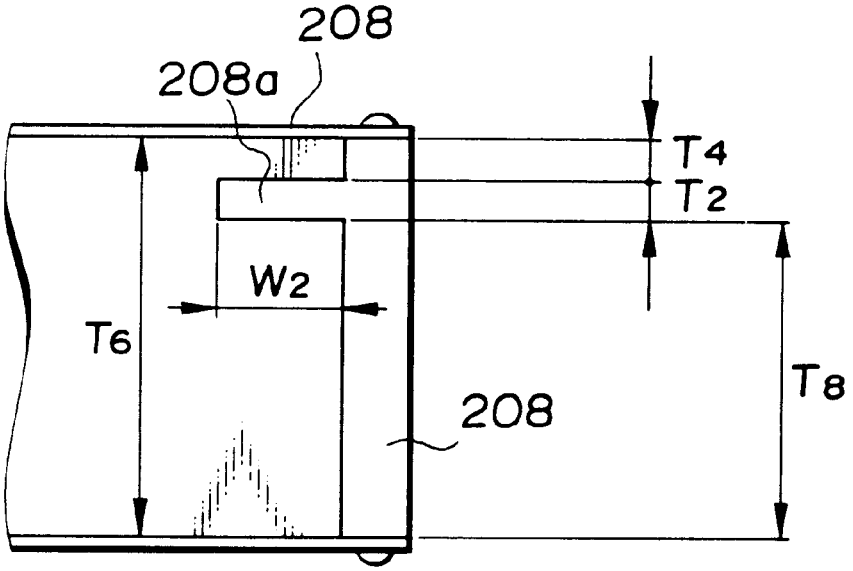

FIGS. 62A and 62B show by way of fragmentary plan view the dimensional relationship between the tank case 208 and the ink tank cartridge 201. In the figures, a length $T_3$ represents a distance measured from the outer side wall surface of the ink tank cartridge 201 to the ink tank slits 201*a*, a length $T_4$ represents a distance measured from the inner side wall surface of the tank case 208 to the tank case end projection 208*a*, a length $T_5$ represents a width of the ink tank cartridge 201, a length $T_6$ represents an inner width of the tank case 208, a length $T_7$ represents a distance as measured from the outer side wall surface of the ink tank cartridge 201 to the ink tank slit 201*a* in the opposite direction to the-length $T_3$, and a length $T_8$ represents a distance as measured from the inner side wall surface of the tank case 208 to the tank case end projection 208*a* in the opposite direction to the length $T_4$.

Referring to FIG. 61, since an inequality represented by $L_1<L_2$ is established between the length $L_1$ and the length $L_2$, the ink tank cartridge 201 can be removed from the tank case 208 by the turning movement thereof in the counter-clockwise direction in contrast with the conventional ink tank cartridge which can be removed from the opponent tank case merely by the linear drawing operation thereof in the upward direction. Thus, maneuverability of the ink tank cartridge 201 can be improved. However, in the case that the length $L_2$ is dimensioned to be excessively large, the maneuverability of the ink tank cartridge 201 can be improved further but the carrier 203 is correspondingly enlarged, causing the whole ink jet recording apparatus to be designed with larger dimensions. In the circumstance as mentioned above, it is desirable that the length L2 is dimensioned to satisfy the condition represented by the following inequality.

(length $L_2$)<(length of the ink tank cartridge 201 measured in the main scanning direction)×2

When the dimensional relationship between the width $W_2$ of the tank case end projection 208*a* and the width $W_1$ of the ink tank slit 201*a* represented by an inequality of $W_1>W_2$ is established, the ink tank cartridge 201 can be thrusted by the tank case end 208*a* at the right-hand end thereof. Thus, the thrusting force can stably be imparted by the ink tank case end 208*b* irrespective of the existing of the ink tank end projection 208*a* to the ink tank cartridge 201 at all times so that the ink tank cartridge 201 and the ink jet recording head 200 can smoothly be connected to each other. The dimensional relationship between the height $H_1$ of the ink tank slit 201*a* and the height $H_2$ of the tank case end projection 208*a* will be described later.

Referring to FIGS. 62A and 62B, to assure that the ink tank cartridge 201 is correctly received in the tank case 208, the dimensional relationship represented by an inequality of $T_5<T_6$ should be established between the length $T_5$ and the length $T_6$. In addition, to assure that the ink tank cartridge 201 is smoothly inserted into the tank case 208 without any interference with the tank end case projection 208*a*, it is necessary that the following inequalities are established among the lengths $T_1$, $T_2$, $T_3$, $T_4$, $T_7$ and $T_8$.

(length $T_2$)+(length $T_4$)<(length $T_1$)+(length $T_3$)

(length $T_2$)+(length $T_8$)<(length $T_1$)+(length $T_7$)

When the above dimensional relationship is established, the tank case end projection 208*a* can smoothly be inserted into the ink tank slit 201*a*.

Next, the dimensional restriction associated with the head cartridge (ink jet recording unit) and the carrier 203 will be described below with reference to FIG. 63.

Figure 63:
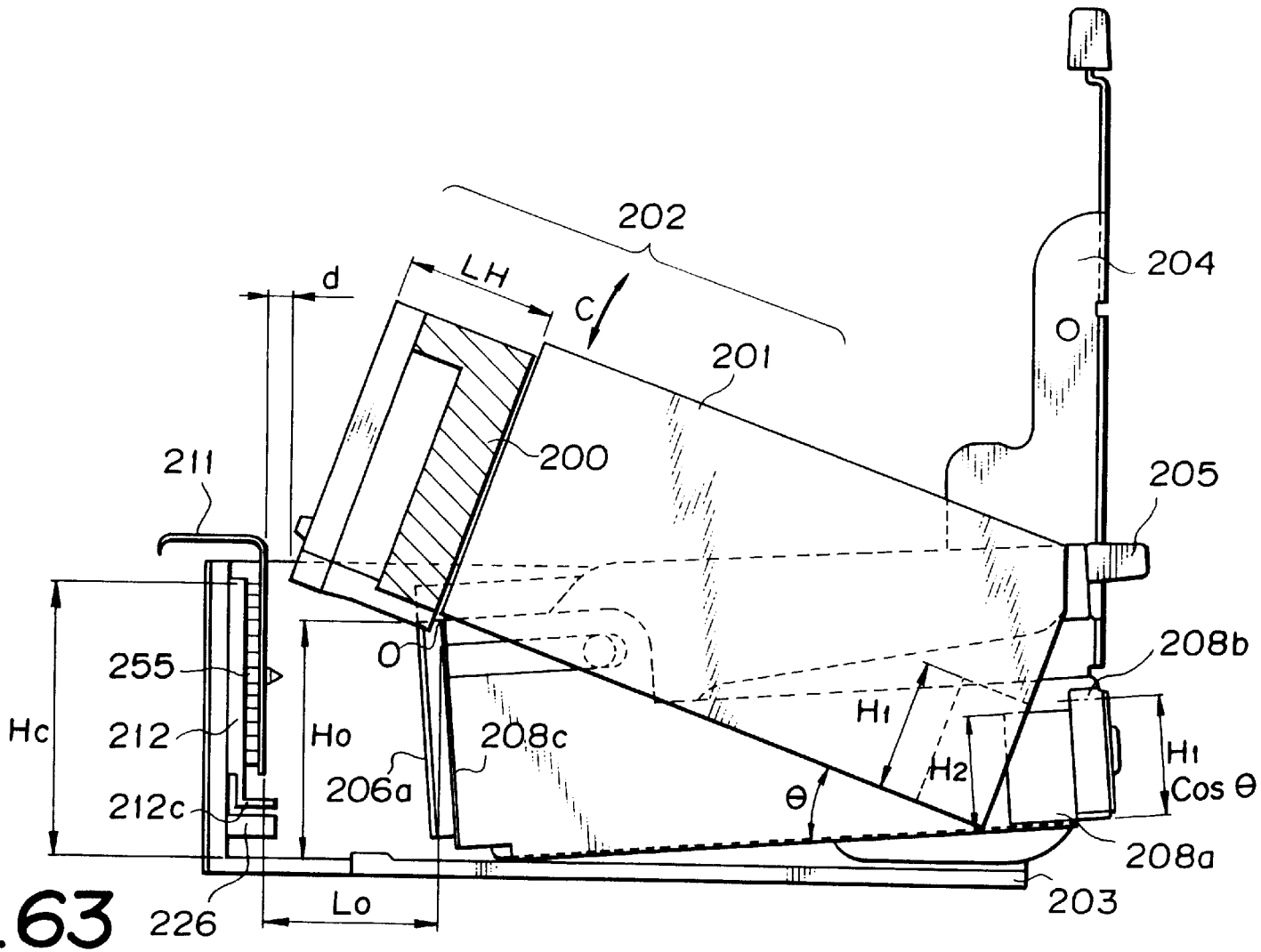
FIG. 63 is a schematic front view of the ink jet recording unit shown in FIG. 52, particularly showing dimensions of the ink jet recording unit and the carrier section.

FIG. 63 is a schematic side view of an assembly of the head cartridge 202 and the carrier 203, particularly showing essential dimensions defining the head cartridge 202 and the carrier 203. In FIG. 63, reference numeral 208*c* designates a tank case projection located at the left-hand end of the tank case 208 to be engaged with the left-hand end of the ink tank cartridge 201, reference numeral 206*a* designates a head holder projection located at the right-hand end of a head holder 206 to thrust the ink jet recording head 200, and a position O represents an upper end of the tank case 208 positionally coincident with the center of the turning movement of the ink tank cartridge 201 as shown in FIG. 61.

FIG. 63 shows the intermediate state of the head cartridge 202 in the course of fitting of the head cartridge 202 into the carrier 203 (or in the course of removing the head cartridge 202 from the carrier 203), and the fitting of the head cartridge 202 into the carrier 203 or the removing of the former from the latter is achieved by displacing the head cartridge 202 in the upward/downward direction while it is turned in the C arrow-marked direction by an angle of θ. Otherwise, it is possible to fit the head cartridge 202 into the carrier 203 and remove the former from the latter without any turning movement of the head cartridge 202 merely by displacing it in the upward/downward direction.

In the case that the head cartridge 202 is fitted into the carrier 203 and removed from the latter by the turning movement of the head cartridge 202 as shown in FIG. 63, the ink tank cartridge 201 does not interfere with the tank case end projection 208*a*, provided that the dimensional relationship between the length $H_1$ of the ink tank slit 201*a* and the length $H_2$ of the tank case end projection 208*a* represented by the following inequality is satisfactorily established.

$$(\text{length } H_1)\times\cos\theta>(\text{length } H_2)$$

When ink is solidified in the vicinity of the ink discharging orifices of the ink jet recording head 200 while the head cartridge 202 is fitted into the carrier 203 or removed from the same, there is a possibility that electrical short-circuit occurs due to adhesion of the ink to the contact portion of the flexible cable 211. For this reason, it is desirable that the ink jet recording head 200 and the flexible cable 211 are arranged such that a gap d between them is reliably maintained within the range of zero or more during fitting of the head cartridge 202 into the carrier 203 and removing the former from the latter. Since the tank case projection 208*c* and the head holder projection 206*a* pass merely past a part of the ink jet recording head 200 identified by hatched lines in FIG. 63 during the fitting/removing of the head cartridge 202, the dimensional relationship between a distance $L_O$ as measured from the position O to the contact surface of the flexible cable 211 and a length $L_h$ of the ink jet recording head 200 as measured in the main scanning direction is represented by the following inequality.

$$(\text{length } L_O)-(\text{length } L_h)>0$$

As long as the above inequality is established, and moreover, the dimensional relationship between a height $H_O$ of the position O and a maximum height $H_C$ of the contact surface of the flexible cable 211 represented by the following inequality is established, there does not arise a malfunction that the ink adheres to the flexible cable 211.

$$(\text{length } H_O)+(\text{length } L_h)\times\sin\theta>(\text{length } H_C)$$

Figure 65A:
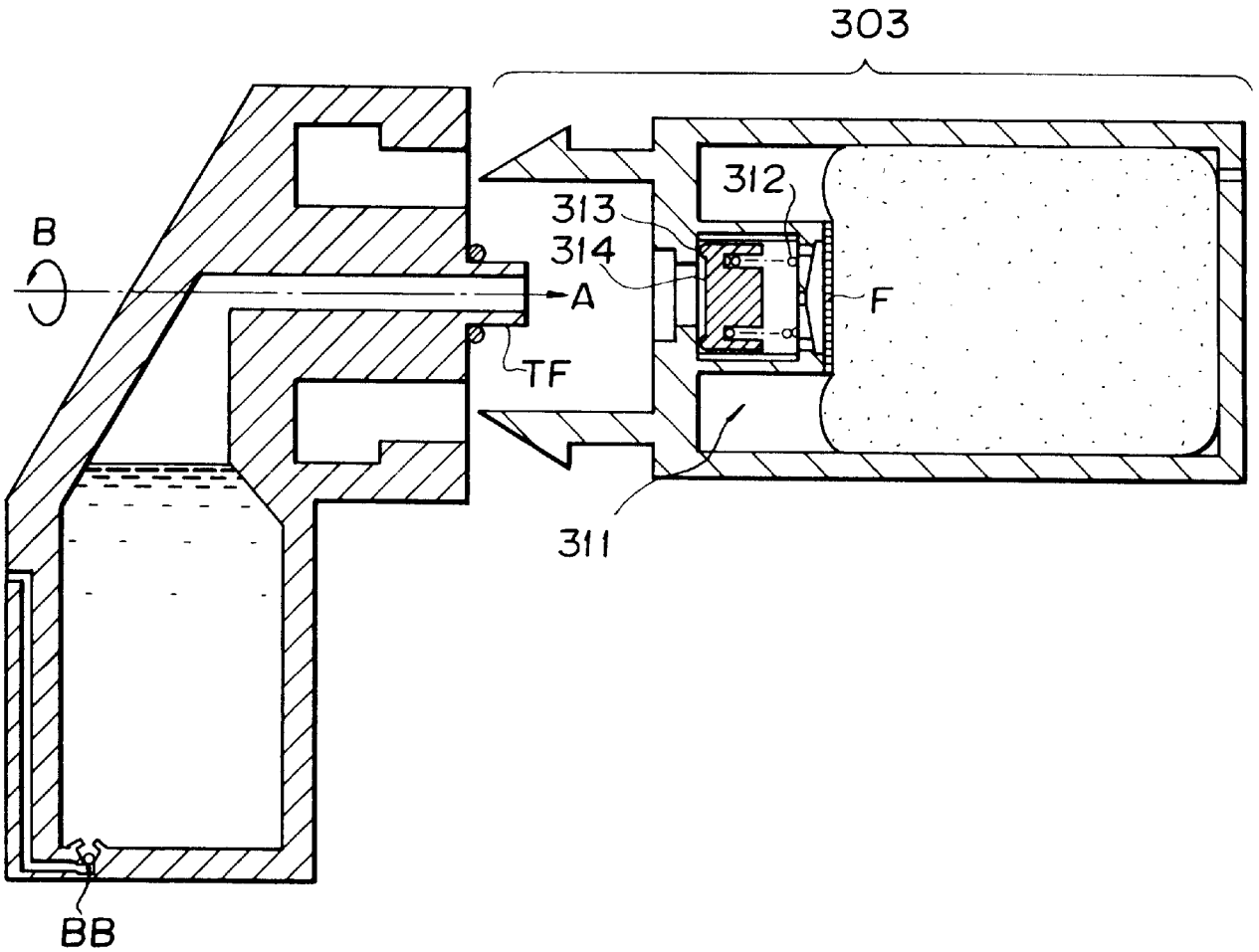
FIGS. 65A and 65B show by way of sectional views the ink tank cartridge for the ink jet recording unit to which the present invention is applied, particularly showing how the ink tank cartridge is fed with an ink.
Figure 65B:
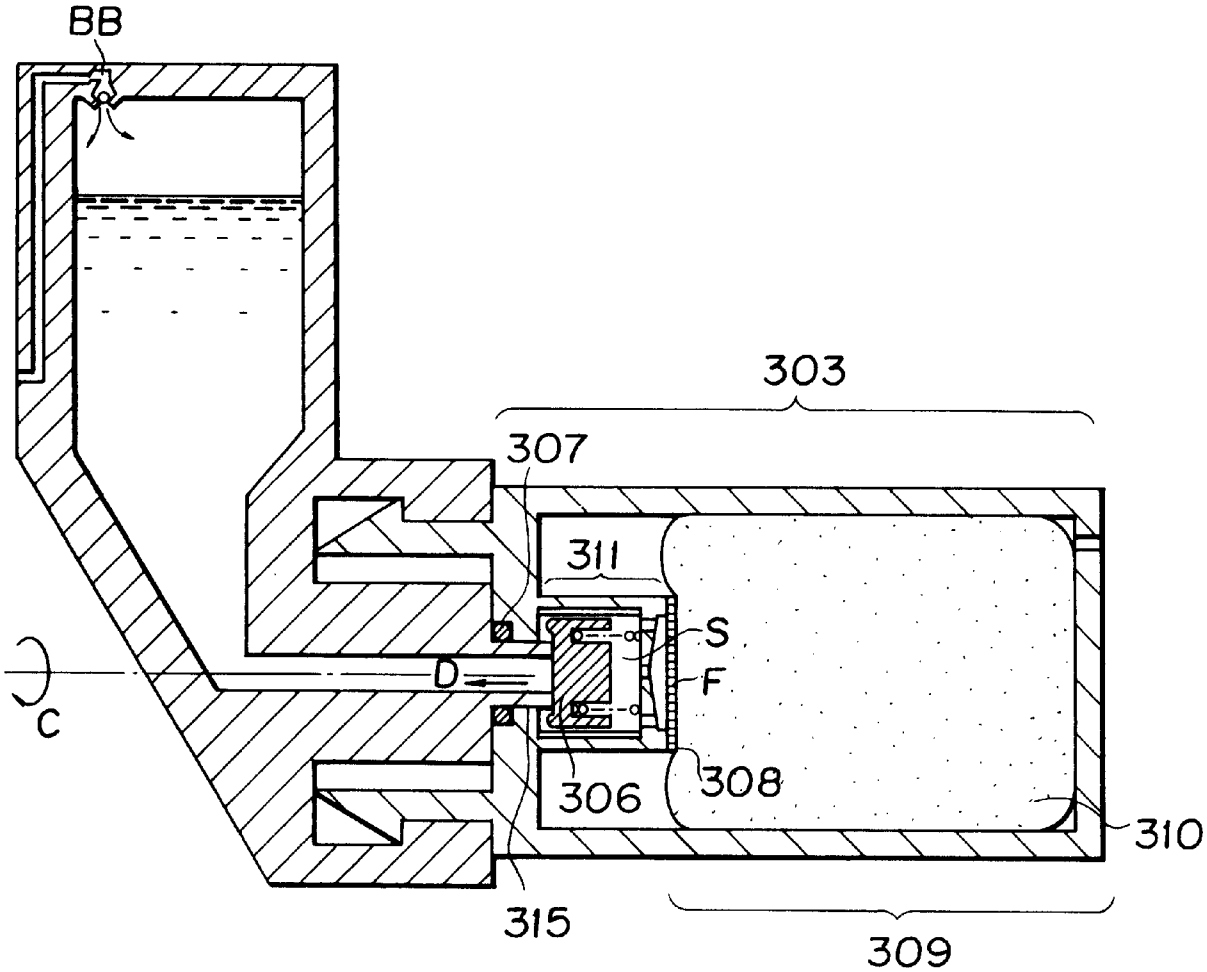

FIGS. 65A and 64B are sectional views to explain a method for filling a liquid storage container such as an ink tank cartiridge with a liquid such as ink according to the present invention. Specifically, FIG. 65A is a sectional view of the liquid storage container 303 shown in FIGS. 5 and 51A to 51C, particularly showing the state of the liquid storage container 303 before the valve mechanism 311 is shifted from the closed state to the opened state by fitting to the liquid storage container 303 a liquid filling container having a connecting mechanism TF similar to the aforementioned ink jet recording head, and FIG. 65B is a sectional view of the liquid storage container 303, particularly showing that the liquid filling container is fitted to the liquid storage container 303 and then turned about a center line C of the connecting mechanism TF. In the figures, reference character BB designates a ball valve. When the ball valve BB is held in the state as shown in FIG. 65A, it interrupts the communication between the atmosphere and the interior of the liquid filling container. On the contrary, when it is held in the state as shown in FIG. 65B, the ball value BB permits the communication therebetween. The connecting mechanism TF serves to form a space between the valve mechanism 311 and a filter F by the same function as that of the ink jet recording head. Thus, advantageous effects attainable with the liquid filling method of the present invention are assured.

Incidentally, it is preferable that the structure as represented by the aforementioned inequalities is employed for practicing the liquid filling method with the aid of restorative sucking means (not shown) for the liquid storage container 303.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. An ink tank comprising:

a joint portion for accepting an ink feed pipe of an ink jet head for connection and disconnection of said ink let head and said ink tank;

a storing portion for storing ink to be fed to said ink jet head;

a communicating portion which communicates said storing portion with the atmosphere;

a valve mechanism in said joint portion comprising a cylindrical member projectingly provided at said joint portion, and a valve body movably arranged within said cylindrical member; and a filter disposed between said valve mechanism and said ink storing portion, wherein said valve mechanism allows an outflow of ink to said ink jet head through said joint portion when connected to said ink feed pipe, and closes said joint portion when disconnected from said ink feed pipe, said valve body is urged by a resilient member within said valve mechanism in a direction where said joint portion is closed, said resilient member is retained by a stopper positioned between a distal end portion of said cylindrical member and said filter, and said stopper comprises ribs for inhibiting deformation of said filter.

2. An ink tank according to claim 1, wherein said filter is disposed at a distal end of said cylindrical member, said ink storing portion is provided with an ink absorbing member, and said filter is in compressed contact with said ink absorbing member.

3. An ink tank according to claim 1, wherein said valve mechanism comprises a groove disposed at least between said cylindrical member and said valve body.

4. An ink tank according to claim 1, wherein said valve body comprises a radially extending groove at an outer end thereof.

5. An ink tank comprising:

a joint portion for accepting an ink feed pipe of an ink jet head for connection and disconnection of said ink jet head and said ink tank, said joint portion including a cylindrical member;

a storing portion for storing ink to be fed to said ink jet head, wherein said cylindrical member projects into said storing portion;

a communication portion communicating said storing portion with the atmosphere;

a flat filter disposed at an end portion of said cylindrical member on said ink storing portion side, said flat filter having a diameter larger than an amount of projection of said cylindrical member into said storing portion; and a stopper member positioned inside said cylindrical member, said stopper member comprising ribs for inhibiting deformation of said filter.

6. An ink tank according to claim 5, wherein said filter is disposed at a distal end of said cylindrical member, said ink storing portion is provided with an ink absorbing member, and said filter is in compressed contact with said ink absorbing member.

* * * * *

UNITED STATES PATENT AND TRADEMARK OFFICE

CERTIFICATE OF CORRECTION

PATENT NO. : 6,170,939 B1
DATED : January 9, 2001
INVENTOR(S) : Ujita et al.

It is certified that error appears in the above-identified patent and that said Letters Patent is hereby corrected as shown below:

Drawings,
Sheet 15, Fig. 20, "IMTERFACE" should read -- INTERFACE --; and "CARRIDGE" (both occurrences) should read -- CARTRIDGE --.

Column 3,
Line 14, "measured" should read -- measures --;
Line 43, "increased" should read -- be increased --; and
Line 58, "certain a " should read -- a certain --.

Column 8,
Line 4, "arbitrailly" should read -- arbitrarily --.

Column 12,
Line 20, "-filter" should read -- filter --.

Column 15,
Line 55, "illustrates" should read -- illustrate --.

Column 19,
Line 29, "the-front" should read -- the front --; and
Line 51, "strew" should read -- screw --.

Column 20,
Line 27, "is-" should read -- is --; and
Line 43, "a-quality" should read -- a quality --.

Column 21,
Line 27, "that-the" should read -- that the --.

UNITED STATES PATENT AND TRADEMARK OFFICE

CERTIFICATE OF CORRECTION

PATENT NO. : 6,170,939 B1
DATED : January 9, 2001
INVENTOR(S) : Ujita et al.

It is certified that error appears in the above-identified patent and that said Letters Patent is hereby corrected as shown below:

Column 24,
Line 43, "a-quality" should read -- a quality --; and
Line 49, "disconnetable" should read -- disconnectable --.

Column 25,
Line 15, "be" should read -- being --; and
Line 26, "refereed" should read -- referred --.

Column 29,
Line 43, "fed" should read -- be fed --.

Column 32,
Line 28, "can" should read -- can be --.

Column 35,
Table 1, "105 to 125 mm ag" should read -- 105 to 125 mm aq --;
Line 43, "cartridge" should read -- cartridge. --; and
Line 50, "-air" should read -- air --.

Column 38,
Line 50, "Do" should read -- $D_o$ --; and
Line 59, "the-" should read -- the --.

Column 39,
Line 56, "section-" should read -- section --.

Column 44,
Line 60, "Ink" should read -- ink --.

UNITED STATES PATENT AND TRADEMARK OFFICE

CERTIFICATE OF CORRECTION

PATENT NO. : 6,170,939 B1
DATED : January 9, 2001
INVENTOR(S) : Ujita et al.

It is certified that error appears in the above-identified patent and that said Letters Patent is hereby corrected as shown below:

Column 48,
Line 40, "bellow" should read -- below --.

Column 50,
Line 15, "-distance" should read -- distance --.

Column 55,
Line 43, "locatio" should read -- location --.

Column 57,
Line 45, "when-a" should read -- when a --.

Column 61,
Line 49, "cartiridge" should read -- cartridge --.

Column 62,
Line 64, "consists" should read -- consist --.

Signed and Sealed this

Fifth Day of March, 2002

*Attest:*

*Attesting Officer*

JAMES E. ROGAN
*Director of the United States Patent and Trademark Office*